US012696964B2

(12) United States Patent
Higgins et al.

(10) Patent No.: US 12,696,964 B2
(45) Date of Patent: Aug. 4, 2026

(54) IDENTIFICATION OF HAIR CARE APPLIANCE ATTACHMENTS

(71) Applicant: SharkNinja Operating LLC, Needham, MA (US)

(72) Inventors: Colby Jackson Higgins, Randolph, MA (US); Karen Hamaguchi, Boston, MA (US); Gabriel Baczewski, Gardner, MA (US)

(73) Assignee: SharkNinja Operating LLC, Needham, MA (US)

( * ) Notice: Subject to any disclaimer, the term of this patent is extended or adjusted under 35 U.S.C. 154(b) by 479 days.

(21) Appl. No.: 18/480,017

(22) Filed: Oct. 3, 2023

(65) Prior Publication Data

US 2024/0245190 A1 Jul. 25, 2024

Related U.S. Application Data

(60) Provisional application No. 63/480,680, filed on Jan. 19, 2023.

(51) Int. Cl.
*A45D 20/12* (2006.01)
*A45D 1/04* (2006.01)
(Continued)

(52) U.S. Cl.
CPC ..... *A45D 20/12* (2013.01); *A45D 1/28* (2013.01); *A45D 2/367* (2013.01); *A45D 20/122* (2013.01);
(Continued)

(58) Field of Classification Search
CPC ..... A45D 20/12; A45D 20/08; A45D 1/28; A45D 1/04; A45D 2/367; A46B 5/0095; A46B 15/0014
(Continued)

(56) References Cited

U.S. PATENT DOCUMENTS 3,397,463 A 8/1968 Nikolaus
4,571,772 A 2/1986 Dyson
(Continued)

FOREIGN PATENT DOCUMENTS

CA 2863118 C 5/2020
CN 1257692 C 5/2006
(Continued)

OTHER PUBLICATIONS

U.S. Appl. No. 18/416,526 entitled "Hair Care Appliance With Powered Attachment", filed on Jan. 18, 2024, 49 pages.
(Continued)

*Primary Examiner* — Deming Wan

(74) *Attorney, Agent, or Firm* — Mintz, Levin, Cohn, Ferris, Glovsky and Popeo, P.C.

(57) ABSTRACT

Various exemplary attachments for hair care appliances and methods of using attachments for hair care appliances are provided. In general, a hair care appliance in an exemplary embodiment is in the form of a hair dryer that has an air inlet and at least one air outlet, and various internal components that facilitate use and operation of the hair care appliance, such as a fan, motor, and heater. In an exemplary embodiment, the hair care appliance is configured to releasably couple to an attachment so that the hair care appliance and the attachment are in electrical communication. The hair care appliance is configured to automatically identify the attachment releasably coupled to the hair care appliance.

20 Claims, 25 Drawing Sheets

(51) Int. Cl.

| | |
|---|---|
| ***A45D 1/28*** | (2006.01) |
| ***A45D 2/36*** | (2006.01) |
| ***A45D 20/08*** | (2006.01) |
| ***A45D 20/50*** | (2006.01) |
| ***A46B 5/00*** | (2006.01) |
| ***A46B 15/00*** | (2006.01) |
| *A46B 9/02* | (2006.01) |

(52) U.S. Cl.
CPC ..... *A45D 20/50* (2013.01); *A46B 5/0095* (2013.01); *A46B 15/0014* (2013.01); *A46B 15/003* (2013.01); *A46B 15/0051* (2013.01); *A46B 9/023* (2013.01); *A46B 9/025* (2013.01); *A46B 9/026* (2013.01); *A46B 2200/104* (2013.01)

(58) Field of Classification Search
USPC ..... 34/90; 132/266, 212, 132; 219/240
See application file for complete search history.

(56) References Cited

U.S. PATENT DOCUMENTS 4,593,429 A 6/1986 Dyson
4,643,748 A 2/1987 Dyson
4,853,011 A 8/1989 Dyson
5,160,356 A 11/1992 Dyson
5,212,366 A * 5/1993 McDougall ..... A45D 20/50 132/229
5,558,697 A 9/1996 Dyson et al.
5,568,691 A 10/1996 Rubin
5,628,123 A 5/1997 Chan
5,846,273 A 12/1998 Dyson
6,003,239 A 12/1999 Liebenthal et al.
6,222,988 B1 4/2001 Behrendt et al.
6,316,858 B1 11/2001 Phillips
6,408,481 B1 6/2002 Dyson
6,425,931 B1 7/2002 Croggon
6,478,291 B1 11/2002 Courtney
6,482,246 B1 11/2002 Dyson et al.
6,493,612 B1 12/2002 Bisset et al.
6,519,807 B1 2/2003 Thomson
6,526,623 B1 3/2003 Dyson
6,544,520 B1 4/2003 Murray et al.
6,572,078 B1 6/2003 Thomson et al.
6,601,265 B1 8/2003 Burlington
6,605,156 B1 8/2003 Clark et al.
6,691,849 B1 2/2004 Dyson et al.
6,774,596 B1 8/2004 Bisset
6,835,222 B2 12/2004 Gammack
6,974,488 B2 12/2005 Dyson
6,989,039 B2 1/2006 Vuijk
6,991,666 B2 1/2006 Organ
6,994,740 B2 2/2006 Gammack et al.
7,000,288 B2 2/2006 Nighy
7,018,439 B2 3/2006 Vuijk
7,085,624 B2 8/2006 Aldred et al.
7,165,341 B2 1/2007 Saida et al.
7,356,943 B2 4/2008 Behbehani
7,425,225 B2 9/2008 Genn et al.
7,437,799 B2 10/2008 Rocke
7,443,125 B2 10/2008 Clothier et al.
D598,532 S 8/2009 Dyson et al.
D602,143 S 10/2009 Gammack et al.
D602,144 S 10/2009 Dyson et al.
7,603,745 B2 10/2009 Frederickson
7,618,470 B2 11/2009 Eddington et al.
D605,748 S 12/2009 Gammack et al.
D614,280 S 4/2010 Dyson et al.
7,701,164 B2 4/2010 Clothier et al.
7,721,385 B2 5/2010 Genn et al.
7,731,770 B2 6/2010 Strutt et al.
7,750,594 B2 7/2010 Clothier et al.
7,757,343 B2 7/2010 Courtney
7,786,628 B2 8/2010 Childe et al.
7,823,251 B2 11/2010 Dyson et al.
7,828,866 B2 11/2010 Courtney et al.
7,979,959 B2 7/2011 Courtney
D643,098 S 8/2011 Wallace et al.
D645,615 S 9/2011 Eagle
8,042,224 B2 10/2011 White et al.
D648,893 S 11/2011 Kaizuka
D650,942 S 12/2011 Choi
8,100,999 B2 1/2012 Ashbee et al.
8,101,777 B2 1/2012 Dyson et al.
8,225,457 B2 7/2012 Sanderson et al.
8,240,317 B2 8/2012 Aguti et al.
D668,751 S 10/2012 Fitton et al.
D670,027 S 10/2012 Choi
D672,023 S 12/2012 Wallace et al.
D672,024 S 12/2012 Fitton et al.
D674,887 S 1/2013 Dyson
8,347,455 B2 1/2013 Dyson et al.
8,347,457 B2 1/2013 Dyson et al.
8,353,077 B2 1/2013 Dyson et al.
8,375,511 B2 2/2013 Dyson et al.
D679,055 S 3/2013 Dyson et al.
D682,472 S 5/2013 Dyson et al.
8,444,731 B2 5/2013 Gomiciaga-Pereda et al.
8,459,273 B2 6/2013 Silva
8,474,091 B2 7/2013 Dyson et al.
8,490,633 B1 7/2013 Kennedy et al.
8,529,226 B2 9/2013 Li
8,562,705 B2 10/2013 Courtney et al.
8,572,802 B2 11/2013 Dyson et al.
D694,952 S 12/2013 Choi
D698,994 S 2/2014 Xu
8,673,487 B2 3/2014 Churchill
8,707,508 B2 4/2014 Dyson et al.
D705,483 S 5/2014 Xu
8,720,002 B2 5/2014 Gammack et al.
8,734,121 B2 5/2014 Tsen
D706,983 S 6/2014 Courtney
D707,395 S 6/2014 Courtney
8,770,946 B2 7/2014 Fitton et al.
D711,042 S 8/2014 Kaizuka
8,826,492 B2 9/2014 Dyson et al.
D715,995 S 10/2014 Dyson et al.
D715,996 S 10/2014 Dyson et al.
D716,492 S 10/2014 Dyson et al.
8,882,451 B2 11/2014 Fitton et al.
D727,569 S 4/2015 Leonard
D728,092 S 4/2015 Poulton et al.
9,004,878 B2 4/2015 Gammack et al.
9,011,116 B2 4/2015 Li
D728,769 S 5/2015 Dyson et al.
D728,770 S 5/2015 Dyson et al.
D729,372 S 5/2015 McPherson et al.
D729,373 S 5/2015 Dos et al.
D729,374 S 5/2015 Dos et al.
D729,375 S 5/2015 Dos et al.
D729,376 S 5/2015 McPherson et al.
D729,447 S 5/2015 Gammack
D729,448 S 5/2015 Gammack
D729,925 S 5/2015 McPherson et al.
D729,978 S 5/2015 Bates et al.
D729,979 S 5/2015 Gammack
D730,575 S 5/2015 Bates et al.
D730,576 S 5/2015 Gammack
D731,117 S 6/2015 Bates et al.
9,085,785 B2 7/2015 Reed et al.
9,095,246 B2 8/2015 Macnaughton
9,144,286 B2 9/2015 Courtney et al.
D741,544 S 10/2015 Gammack
9,173,468 B2 11/2015 Moloney et al.
9,185,957 B2 11/2015 Richmond et al.
9,186,027 B2 11/2015 Genn
D746,425 S 12/2015 Dyson et al.
9,217,445 B2 12/2015 Lo
D746,966 S 1/2016 Dyson et al.
D747,450 S 1/2016 Dyson et al.
D747,453 S 1/2016 Stewart et al.
9,226,560 B1 1/2016 Birk
9,237,789 B2 1/2016 Prehodka

(56) References Cited

U.S. PATENT DOCUMENTS

D749,231 S 2/2016 Dyson et al.
9,282,800 B2 3/2016 Courtney et al.
9,282,859 B2 3/2016 Dyson et al.
9,282,864 B2 3/2016 Guder et al.
D757,361 S 5/2016 Gammack
D757,362 S 5/2016 Dyson et al.
D758,010 S 5/2016 Bates et al.
D758,011 S 5/2016 Gammack
D758,012 S 5/2016 Bates et al.
9,366,449 B2 6/2016 Staniforth et al.
9,370,286 B2 6/2016 Stephen et al.
9,414,662 B2 8/2016 Moloney et al.
9,420,864 B2 8/2016 Gammack et al.
9,420,865 B2 8/2016 Gammack et al.
9,420,927 B2 8/2016 Ventress et al.
D768,840 S 10/2016 Steven et al.
9,510,395 B2 11/2016 Coulton et al.
D775,418 S 12/2016 Stephens et al.
D775,419 S 12/2016 Stephens et al.
9,512,959 B2 12/2016 Atkinson
9,516,982 B2 12/2016 Stephen et al.
9,521,937 B2 12/2016 Follows et al.
D776,345 S 1/2017 Tang
D782,643 S 3/2017 Poulton et al.
D782,731 S 3/2017 Smith et al.
D782,732 S 3/2017 Smith et al.
D782,733 S 3/2017 Smith et al.
D782,734 S 3/2017 Sutter et al.
D782,735 S 3/2017 Stephens et al.
D782,736 S 3/2017 Stephens et al.
9,596,916 B2 3/2017 Moloney et al.
D783,140 S 4/2017 Poulton et al.
D783,141 S 4/2017 Poulton et al.
D783,142 S 4/2017 Poulton et al.
D783,143 S 4/2017 Poulton et al.
D784,614 S 4/2017 Stephens et al.
D785,240 S 4/2017 Smith et al.
D785,241 S 4/2017 Stephens et al.
9,609,986 B2 4/2017 Dimbylow et al.
9,609,990 B2 4/2017 Stephen et al.
9,627,717 B1 4/2017 Langlois et al.
D790,681 S 6/2017 Poulton et al.
9,681,726 B2 6/2017 Moloney et al.
9,687,058 B2 6/2017 Atkinson
D791,407 S 7/2017 Smith et al.
9,788,697 B2 10/2017 Peace
9,797,613 B2 10/2017 Staniforth et al.
9,808,065 B2 11/2017 Moloney et al.
9,808,066 B2 11/2017 Moloney et al.
9,808,067 B2 11/2017 Sutter et al.
9,848,745 B2 12/2017 Hill et al.
9,879,290 B2 1/2018 Kurek et al.
D811,009 S 2/2018 Smith et al.
9,893,585 B2 2/2018 Cowdry
9,927,136 B2 3/2018 Staniforth et al.
9,929,440 B2 3/2018 Sastry et al.
9,936,788 B2 4/2018 Stephens et al.
9,936,789 B2 4/2018 Stephens et al.
9,943,203 B2 4/2018 Samuels et al.
9,949,605 B2 4/2018 Isley et al.
D817,007 S 5/2018 Guy-Rabi et al.
9,955,838 B2 5/2018 Millington et al.
9,957,534 B2 5/2018 Kurek et al.
9,986,810 B2 6/2018 Bobillier et al.
10,004,313 B2 6/2018 Atkinson
10,021,951 B2 7/2018 Bobillier et al.
10,064,470 B2 9/2018 Warne
10,076,172 B2 9/2018 Stephens et al.
10,080,414 B2 9/2018 Douglas et al.
D830,630 S 10/2018 Chia et al.
10,085,537 B2 10/2018 Maclaine
10,085,538 B2 10/2018 Saunders et al.
10,094,581 B2 10/2018 Staniforth et al.
10,117,491 B2 11/2018 Moloney et al.
10,143,285 B2 12/2018 Stephens et al.
D838,907 S 1/2019 Bates et al.
10,165,843 B2 1/2019 Hedges
10,165,844 B2 1/2019 Stephens et al.
10,165,921 B2 1/2019 Millington et al.
10,186,822 B2 1/2019 Hogan
10,194,728 B2 2/2019 Stephens et al.
10,213,001 B2 2/2019 Stephens et al.
D843,652 S 3/2019 McLuckie et al.
D843,653 S 3/2019 Teyu et al.
D843,654 S 3/2019 Teyu et al.
10,226,112 B2 3/2019 Kerr et al.
10,238,199 B2 3/2019 Stephens et al.
D847,421 S 4/2019 Tappenden et al.
D847,422 S 4/2019 Tappenden et al.
D847,423 S 4/2019 Tappenden et al.
D847,424 S 4/2019 Tappenden et al.
D847,425 S 4/2019 Tappenden et al.
D847,426 S 4/2019 Tappenden et al.
10,244,912 B2 4/2019 Box et al.
10,258,211 B2 4/2019 Mcleod
D848,063 S 5/2019 Tappenden et al.
D848,064 S 5/2019 Tappenden et al.
D848,065 S 5/2019 Heffer et al.
D848,066 S 5/2019 Coulton et al.
D848,067 S 5/2019 Heffer et al.
D848,068 S 5/2019 Heffer et al.
D848,675 S 5/2019 Chia et al.
D850,001 S 5/2019 Coulton et al.
D850,002 S 5/2019 Bates et al.
10,278,471 B2 5/2019 Shelton et al.
10,299,648 B2 5/2019 Peters et al.
10,304,324 B2 5/2019 Smith et al.
D852,415 S 6/2019 Coulton et al.
D852,416 S 6/2019 Coulton et al.
10,306,965 B2 6/2019 Wilkinson et al.
10,307,028 B2 6/2019 Gray
10,307,029 B2 6/2019 Sharpley et al.
10,327,528 B2 6/2019 Cowdry et al.
D853,637 S 7/2019 Coulton et al.
D853,638 S 7/2019 Tappenden et al.
D853,639 S 7/2019 Tappenden et al.
D853,640 S 7/2019 Tappenden et al.
D853,641 S 7/2019 Tappenden et al.
D853,642 S 7/2019 Coulton et al.
D854,316 S 7/2019 Stockinger et al.
D854,745 S 7/2019 Chia et al.
D855,252 S 7/2019 Coulton et al.
10,344,776 B2 7/2019 Lamb
D856,579 S 8/2019 Chia et al.
D856,580 S 8/2019 Chia et al.
10,378,783 B2 8/2019 Tun
D860,528 S 9/2019 Atkinson et al.
D860,529 S 9/2019 Atkinson et al.
D860,530 S 9/2019 Atkinson et al.
D860,531 S 9/2019 Atkinson et al.
D860,532 S 9/2019 Atkinson et al.
10,403,937 B2 9/2019 Coowar et al.
D865,286 S 10/2019 Atkinson et al.
10,441,049 B2 10/2019 Douglas et al.
10,441,050 B2 10/2019 Blanc et al.
10,448,722 B2 10/2019 McLuckie
D866,067 S 11/2019 Thompson et al.
10,465,928 B2 11/2019 Staniforth et al.
10,470,545 B2 11/2019 Thiebaut et al.
D869,763 S 12/2019 Atkinson et al.
D869,764 S 12/2019 Atkinson et al.
D875,310 S 2/2020 Thompson et al.
10,555,650 B2 2/2020 Genn et al.
10,582,751 B2 3/2020 Courtney
10,602,826 B2 3/2020 Wilkinson et al.
10,610,000 B2 4/2020 Courtney et al.
10,612,565 B2 4/2020 Staniforth et al.
D884,966 S 5/2020 Flynn et al.
D885,663 S 5/2020 Flynn et al.
D885,664 S 5/2020 Dyson et al.
10,648,486 B2 5/2020 Daly
10,660,417 B2 5/2020 Bennett
10,667,662 B2 6/2020 Carswell et al.
10,687,595 B2 6/2020 Courtney et al.

(56) References Cited

U.S. PATENT DOCUMENTS

D890,902 S 7/2020 Carling et al.
D890,903 S 7/2020 Carling et al.
D891,597 S 7/2020 Carling et al.
10,702,037 B2 7/2020 Boateng et al.
10,722,017 B1 7/2020 Abehasera
D892,291 S 8/2020 Jennings et al.
10,729,218 B2 8/2020 Childe et al.
D895,781 S 9/2020 Peet et al.
D895,895 S 9/2020 Atkinson et al.
D896,440 S 9/2020 Lim et al.
10,765,191 B2 9/2020 Stephens et al.
10,786,061 B2 9/2020 Thiebaut et al.
D901,772 S 11/2020 Huang
D902,482 S 11/2020 Koenemann et al.
10,842,332 B2 11/2020 Nicolaou
D903,846 S 12/2020 Macqueen et al.
D903,941 S 12/2020 Koenemann et al.
10,869,529 B2 12/2020 Chia et al.
D908,956 S 1/2021 Kwok
10,893,785 B2 1/2021 Crouch et al.
10,918,184 B1 2/2021 Abehasera
10,939,747 B2 3/2021 Mikitovic et al.
10,953,359 B2 3/2021 Nicolaou et al.
10,973,298 B2 4/2021 Kennedy et al.
10,978,682 B2 4/2021 Chen et al.
D917,886 S 5/2021 Ma
D919,178 S 5/2021 Knox et al.
D919,179 S 5/2021 Knox et al.
D919,180 S 5/2021 Knox et al.
11,011,795 B2 5/2021 Kim et al.
D921,291 S 6/2021 Zhang
D923,874 S 6/2021 Kirkbride et al.
11,022,146 B2 6/2021 Mogridge et al.
11,033,088 B2 6/2021 Atkinson et al.
11,033,089 B2 6/2021 Goldman et al.
11,044,979 B2 6/2021 Maclaine
11,071,365 B2 7/2021 Maclaine et al.
11,110,380 B2 9/2021 Biltcliffe et al.
D935,692 S 11/2021 Courtney et al.
D936,367 S 11/2021 Goodsir et al.
11,168,924 B2 11/2021 Naicker et al.
11,172,745 B2 11/2021 Tam et al.
11,197,531 B2 12/2021 Hogan
11,253,040 B2 2/2022 Kim et al.
11,274,321 B2 3/2022 Reed et al.
11,330,884 B2 5/2022 Degrood et al.
11,344,834 B2 5/2022 Biltcliffe et al.
D955,636 S 6/2022 Zou
11,363,871 B2 6/2022 Bridgett
D957,054 S 7/2022 Yang
D957,612 S 7/2022 Francis et al.
11,375,792 B2 7/2022 Min et al.
D961,154 S 8/2022 Kirkbride et al.
D961,155 S 8/2022 Kirkbride et al.
11,425,979 B2 8/2022 Conrad
11,425,980 B2 8/2022 Conrad
11,454,247 B2 9/2022 Macqueen et al.
D967,520 S 10/2022 Smith et al.
11,457,713 B2 10/2022 Conrad
11,464,312 B2 10/2022 Pang et al.
11,510,472 B2 11/2022 Julemont
D973,273 S 12/2022 Kirkbride et al.
D973,274 S 12/2022 Kirkbride et al.
D973,275 S 12/2022 Flynn et al.
D973,370 S 12/2022 Guo
11,517,091 B2 12/2022 Conrad
11,517,166 B2 12/2022 Percy-Raine et al.
D975,918 S 1/2023 Yuan
D979,253 S 2/2023 Janowick et al.
11,571,056 B2 2/2023 Min et al.
11,576,474 B2 2/2023 Kim et al.
11,583,053 B2 2/2023 Kennedy et al.
11,583,153 B2 2/2023 Britain et al.
11,589,660 B2 2/2023 Thompson et al.
11,589,662 B2 2/2023 Kim et al.
11,602,208 B2 3/2023 Lo
11,633,028 B2 4/2023 Kim et al.
11,647,822 B2 5/2023 Kim et al.
11,680,581 B2 6/2023 Jukes et al.
11,682,988 B2 6/2023 Zheng et al.
11,712,098 B2 8/2023 Guerreiro et al.
11,744,689 B2 9/2023 Follows et al.
11,766,157 B2 9/2023 Percy-Raine et al.
11,767,853 B2 9/2023 Horton et al.
11,767,859 B2 9/2023 Peet et al.
11,802,571 B2 10/2023 Pouget et al.
11,815,099 B2 11/2023 Fanning et al.
11,857,052 B2 1/2024 Conrad
11,871,828 B2 1/2024 Nicolson et al.
2003/0170229 A1 9/2003 Friede et al.
2004/0096974 A1 5/2004 Herron et al.
2005/0152892 A1 7/2005 Friede et al.
2005/0214285 A1 9/2005 Dyson et al.
2009/0239761 A1 9/2009 Blackburn et al.
2010/0011532 A1 1/2010 Norton et al.
2011/0219636 A1 9/2011 Rowling
2011/0236219 A1 9/2011 Fitton et al.
2011/0236228 A1 9/2011 Fitton et al.
2012/0051884 A1 3/2012 Junkel et al.
2012/0247501 A1* 10/2012 Choi ..... A46B 9/023 132/269
2013/0025106 A1 1/2013 Hernandez-Laines
2013/0045084 A1 2/2013 Tu et al.
2013/0111777 A1 5/2013 Jeong
2013/0142676 A1 6/2013 Zou
2013/0172408 A1 7/2013 Süss-Fink et al.
2013/0233336 A1 9/2013 Lazzaro et al.
2013/0234347 A1 9/2013 Staniforth et al.
2015/0089828 A1 4/2015 Moloney et al.
2015/0157107 A1 6/2015 Gosnay et al.
2015/0320271 A1 11/2015 Dimbylow et al.
2016/0000201 A1 1/2016 Doran
2016/0206077 A1 7/2016 Stephens et al.
2016/0235178 A1 8/2016 Atkinson et al.
2016/0338466 A1 11/2016 Atkinson et al.
2017/0150796 A1 6/2017 Stephens et al.
2017/0150797 A1 6/2017 Imhasly et al.
2017/0150798 A1 6/2017 Bobillier et al.
2017/0164709 A1 6/2017 Laveni et al.
2017/0231358 A1 8/2017 Jeong
2017/0273421 A1 9/2017 Heffer et al.
2017/0273422 A1 9/2017 Heffer et al.
2017/0273423 A1 9/2017 Mason et al.
2017/0273425 A1 9/2017 Stephens et al.
2017/0273426 A1 9/2017 Thompson et al.
2017/0273430 A1 9/2017 Heffer et al.
2017/0273431 A1 9/2017 Courtney et al.
2017/0353095 A1 12/2017 Keil et al.
2018/0055177 A1 3/2018 Thompson et al.
2018/0055181 A1 3/2018 Spark et al.
2018/0055183 A1 3/2018 Carson et al.
2018/0055184 A1 3/2018 McVeigh et al.
2018/0055187 A1 3/2018 Galligan
2018/0106810 A1 4/2018 Tainsky et al.
2018/0172013 A1 6/2018 Dymond et al.
2018/0178154 A1 6/2018 Nicolaou
2018/0185779 A1 7/2018 Nicolaou et al.
2018/0192841 A1 7/2018 Nicolaou et al.
2018/0193786 A1 7/2018 Imhasly
2018/0193788 A1 7/2018 Nicolaou et al.
2019/0098979 A1 4/2019 Atkinson et al.
2019/0098980 A1 4/2019 Atkinson et al.
2019/0170162 A1 6/2019 Jennings et al.
2019/0183224 A1 6/2019 Sunderland
2019/0242392 A1 8/2019 Whitmire
2019/0382808 A1 12/2019 Reed
2020/0085161 A1 3/2020 James et al.
2020/0093254 A1 3/2020 Charraud et al.
2020/0146413 A1 5/2020 Mathiaszyk et al.
2020/0163507 A1 5/2020 Percy-Raine et al.
2020/0172856 A1 6/2020 Reed et al.
2020/0214516 A1 7/2020 Percy-Raine et al.
2020/0260831 A1 8/2020 Buttery et al.
2020/0280932 A1 9/2020 Down et al.

(56) References Cited

U.S. PATENT DOCUMENTS

2020/0315415 A1 10/2020 Carswell et al.
2020/0400152 A1 12/2020 Shorter et al.
2020/0400335 A1 12/2020 Shorter et al.
2020/0412198 A1 12/2020 Dymond et al.
2021/0007458 A1 1/2021 Nilsen
2021/0095681 A1 4/2021 Adkin et al.
2021/0219688 A1 7/2021 Courtney et al.
2021/0251362 A1 8/2021 Loke et al.
2021/0251364 A1 8/2021 Thompson et al.
2021/0260414 A1 8/2021 Mundy et al.
2021/0260415 A1 8/2021 Darling et al.
2021/0267341 A1* 9/2021 Yoo ..... A45D 20/10
2021/0270283 A1 9/2021 Macqueen et al.
2021/0270292 A1 9/2021 Macqueen
2021/0283544 A1 9/2021 Jennings et al.
2021/0285328 A1 9/2021 Mahmoodilari et al.
2021/0289909 A1 9/2021 Kirkbride et al.
2021/0298445 A1 9/2021 Courtney
2021/0315350 A1 10/2021 Kim et al.
2021/0330052 A1 10/2021 Lelieveld
2021/0353974 A1 11/2021 Courtney et al.
2021/0393024 A1 12/2021 Forbes et al.
2022/0047895 A1 2/2022 Moone
2022/0074610 A1 3/2022 Morrison et al.
2022/0087391 A1 3/2022 Nicolaou et al.
2022/0148557 A1 5/2022 Reid et al.
2022/0160092 A1 5/2022 Beaumont et al.
2022/0169094 A1 6/2022 Harris et al.
2022/0180850 A1 6/2022 Reid et al.
2022/0180851 A1 6/2022 Reid et al.
2022/0182749 A1 6/2022 Reid et al.
2022/0183438 A1 6/2022 Beaumont et al.
2022/0194166 A1 6/2022 Harris et al.
2022/0296060 A1 9/2022 Cheung et al.
2022/0325722 A1 10/2022 Barnes et al.
2022/0330673 A1 10/2022 Shin et al.
2022/0354231 A1 11/2022 Pulfrey et al.
2022/0357001 A1 11/2022 Dyson et al.
2022/0361646 A1 11/2022 Valle
2022/0400827 A1 12/2022 Yao et al.
2022/0408895 A1 12/2022 Lelieveld
2022/0408996 A1 12/2022 King et al.
2023/0014059 A1 1/2023 Lee et al.
2023/0087034 A1 3/2023 Williams et al.
2023/0098664 A1 3/2023 Conrad
2023/0166205 A1 6/2023 Sim et al.
2023/0172348 A1 6/2023 Van Kempen et al.
2023/0180920 A1 6/2023 Van Kempen
2023/0181937 A1 6/2023 Darling et al.
2023/0181938 A1 6/2023 Pattullo et al.
2023/0181939 A1 6/2023 Leat et al.
2023/0191168 A1 6/2023 Pattullo et al.
2023/0209237 A1 6/2023 Darling et al.
2023/0209243 A1 6/2023 Lowson et al.
2023/0263347 A1 8/2023 Camplani et al.
2023/0270221 A1 8/2023 Wei et al.
2023/0270222 A1 8/2023 Hickey et al.
2023/0292901 A1 9/2023 Hickey et al.
2023/0292902 A1 9/2023 Hickey et al.
2023/0292903 A1 9/2023 Hickey et al.
2023/0309674 A1 10/2023 Hickey et al.
2023/0321290 A1 10/2023 McLuckie et al.
2023/0329413 A1 10/2023 Boon et al.
2023/0329414 A1 10/2023 Tibbetts et al.
2023/0337804 A1 10/2023 Hickey et al.
2023/0346180 A1 11/2023 Teo et al.
2023/0363509 A1 11/2023 Ford
2023/0369999 A1 11/2023 Potgieter et al.
2023/0375224 A1 11/2023 Ford
2023/0380564 A1 11/2023 Huang et al.
2023/0380567 A1 11/2023 Lim
2023/0387838 A1 11/2023 Oakham et al.
2023/0389671 A1 12/2023 Bracken-Lobb
2023/0397705 A1 12/2023 Carlyle et al.
2023/0404237 A1 12/2023 Beaumont et al.
2023/0404238 A1 12/2023 Beaumont et al.
2023/0413969 A1 12/2023 Beaumont et al.
2024/0001172 A1 1/2024 Middleton et al.
2024/0008616 A1 1/2024 Hickey et al.
2024/0008618 A1 1/2024 Coulton et al.
2024/0011494 A1 1/2024 Jukes
2024/0015856 A1 1/2024 Ford
2024/0016275 A1 1/2024 Conrad
2024/0024817 A1 1/2024 Van Der Waals et al.
2024/0081506 A1 3/2024 Purnell et al.

FOREIGN PATENT DOCUMENTS

CN 201739198 U 2/2011
CN 201739199 U 2/2011
CN 201771875 U 3/2011
CN 201786778 U 4/2011
CN 101662969 B 8/2011
CN 103099418 A 5/2013
CN 102197913 B 3/2014
CN 203524053 U 4/2014
CN 203524054 U 4/2014
CN 102939706 B 6/2015
CN 102939713 B 6/2015
CN 102948068 B 6/2015
CN 103081341 B 8/2015
CN 102440717 B 9/2015
CN 102939710 B 12/2015
CN 103565076 B 12/2015
CN 102948067 B 1/2016
CN 103081342 B 3/2016
CN 103549750 B 3/2016
CN 103262406 B 4/2016
CN 103519541 B 8/2016
CN 102038459 B 9/2016
CN 102525080 B 12/2016
CN 103860103 B 4/2017
CN 103876440 B 8/2017
CN 108024674 A 5/2018
CN 108078142 A 5/2018
CN 108669760 A 10/2018
CN 108968289 A 12/2018
CN 109512119 A 3/2019
CN 105889034 B 4/2019
CN 109820321 A 5/2019
CN 208926670 U 6/2019
CN 110037425 A 7/2019
CN 110215039 A 9/2019
CN 110215040 A 9/2019
CN 110338542 A 10/2019
CN 110464101 A 11/2019
CN 110495694 A 11/2019
CN 110680070 A 1/2020
CN 110934408 A 3/2020
CN 106572731 B 5/2020
CN 108143072 B 5/2020
CN 111109814 A 5/2020
CN 111374420 A 7/2020
CN 111374421 A 7/2020
CN 111432684 A 7/2020
CN 111802776 A 10/2020
CN 111820569 A 10/2020
CN 111887565 A 11/2020
CN 106793856 B 1/2021
CN 112198831 A 1/2021
CN 112220184 A 1/2021
CN 112230588 A 1/2021
CN 112273830 A 1/2021
CN 212465222 U 2/2021
CN 212650551 U 3/2021
CN 111387670 B 4/2021
CN 212933307 U 4/2021
CN 106877556 B 5/2021
CN 107105858 B 6/2021
CN 112971308 A 6/2021
CN 113017227 A 6/2021
CN 113040496 A 6/2021
CN 108433318 B 7/2021
CN 113080594 A 7/2021

(56) References Cited

FOREIGN PATENT DOCUMENTS

| | | | |
|---|---|---|---|
| CN | 113080595 | A | 7/2021 |
| CN | 213639954 | U | 7/2021 |
| CN | 213639956 | U | 7/2021 |
| CN | 213639957 | U | 7/2021 |
| CN | 107224087 | B | 8/2021 |
| CN | 109998417 | B | 8/2021 |
| CN | 113243646 | A | 8/2021 |
| CN | 214047871 | U | 8/2021 |
| CN | 214072187 | U | 8/2021 |
| CN | 107259761 | B | 9/2021 |
| CN | 113545583 | A | 10/2021 |
| CN | 214340665 | U | 10/2021 |
| CN | 113576139 | A | 11/2021 |
| CN | 113576140 | A | 11/2021 |
| CN | 113576141 | A | 11/2021 |
| CN | 109645651 | B | 12/2021 |
| CN | 113762440 | A | 12/2021 |
| CN | 110150824 | B | 2/2022 |
| CN | 113219293 | B | 3/2022 |
| CN | 110051100 | B | 4/2022 |
| CN | 114599251 | A | 6/2022 |
| CN | 115023167 | A | 9/2022 |
| CN | 115098769 | A | 9/2022 |
| CN | 115227020 | A | 10/2022 |
| CN | 115245232 | A | 10/2022 |
| CN | 115245233 | A | 10/2022 |
| CN | 113163997 | B | 12/2022 |
| CN | 115517444 | A | 12/2022 |
| CN | 115474756 | B | 4/2023 |
| DE | 112014006549 | T5 | 12/2016 |
| DE | 202014011043 | U1 | 7/2017 |
| DE | 102012210275 | B4 | 8/2017 |
| DE | 202020003368 | U1 | 8/2020 |
| DK | 1268076 | T3 | 2/2005 |
| EP | 1334670 | B1 | 12/2004 |
| EP | 1425986 | B1 | 11/2005 |
| EP | 1839520 | B1 | 11/2008 |
| EP | 2046476 | B1 | 6/2010 |
| EP | 1834540 | B1 | 1/2012 |
| EP | 2582280 | B8 | 10/2014 |
| EP | 2641500 | B1 | 5/2016 |
| EP | 2884866 | B1 | 11/2016 |
| EP | 2197312 | B1 | 5/2017 |
| EP | 3240455 | B1 | 11/2018 |
| EP | 3206524 | B1 | 12/2018 |
| EP | 3412172 | A1 | 12/2018 |
| EP | 3235397 | B1 | 2/2019 |
| EP | 2958479 | B1 | 5/2019 |
| EP | 3104761 | B1 | 5/2019 |
| EP | 3104760 | B1 | 7/2019 |
| EP | 3531862 | A1 | 9/2019 |
| EP | 2869726 | B1 | 4/2020 |
| EP | 3264935 | B1 | 6/2021 |
| EP | 3927209 | A1 | 12/2021 |
| EP | 3758547 | B1 | 9/2022 |
| ES | 2683018 | T3 | 9/2018 |
| GB | 179201 | A | 4/1922 |
| GB | 278037 | A | 9/1927 |
| GB | 314909 | A | 7/1929 |
| GB | 420822 | A | 12/1934 |
| GB | 517682 | A | 2/1940 |
| GB | 1565911 | A | 4/1980 |
| GB | 2372434 | A | 8/2002 |
| GB | 2372470 | A | 8/2002 |
| GB | 2413943 | B | 6/2007 |
| GB | 2416483 | B | 12/2007 |
| GB | 2469039 | B | 2/2013 |
| GB | 2469052 | B | 2/2013 |
| GB | 2501176 | A | 10/2013 |
| GB | 2475312 | B | 1/2014 |
| GB | 2475313 | B | 1/2014 |
| GB | 2505927 | B | 8/2014 |
| GB | 2484121 | B | 10/2014 |
| GB | 2507074 | B | 11/2014 |
| GB | 2508901 | B | 11/2014 |
| GB | 2510359 | B | 4/2015 |
| GB | 2500007 | B | 6/2015 |
| GB | 2500008 | B | 6/2015 |
| GB | 2515816 | B | 12/2015 |
| GB | 2515812 | B | 2/2016 |
| GB | 2510197 | B | 4/2016 |
| GB | 2521145 | B | 4/2016 |
| GB | 2521146 | B | 4/2016 |
| GB | 2518641 | B | 6/2016 |
| GB | 2510196 | B | 7/2016 |
| GB | 2515814 | B | 9/2016 |
| GB | 2518642 | B | 9/2016 |
| GB | 2524093 | B | 11/2016 |
| GB | 2524305 | B | 11/2016 |
| GB | 2521144 | B | 12/2016 |
| GB | 2503683 | B | 4/2017 |
| GB | 2524304 | B | 4/2017 |
| GB | 2503684 | B | 9/2017 |
| GB | 2548817 | A | 10/2017 |
| GB | 2503685 | B | 11/2017 |
| GB | 2539440 | B | 12/2017 |
| GB | 2503686 | B | 1/2018 |
| GB | 2539438 | B | 1/2018 |
| GB | 2542423 | B | 1/2018 |
| GB | 2543313 | B | 1/2018 |
| GB | 2552445 | A | 1/2018 |
| GB | 2539439 | B | 5/2018 |
| GB | 2544104 | B | 5/2018 |
| GB | 2539434 | B | 10/2018 |
| GB | 2563667 | A | 12/2018 |
| GB | 2555418 | B | 3/2019 |
| GB | 2561093 | B | 4/2019 |
| GB | 2567448 | A | 4/2019 |
| GB | 2567753 | A | 4/2019 |
| GB | 2548820 | B | 5/2019 |
| GB | 2561094 | B | 5/2019 |
| GB | 2548822 | B | 8/2019 |
| GB | 2548814 | B | 9/2019 |
| GB | 2574026 | A | 11/2019 |
| GB | 2574027 | A | 11/2019 |
| GB | 2565356 | B | 12/2019 |
| GB | 2574604 | A | 12/2019 |
| GB | 2574606 | A | 12/2019 |
| GB | 2565698 | B | 1/2020 |
| GB | 2548813 | B | 2/2020 |
| GB | 2565360 | B | 3/2020 |
| GB | 2563668 | B | 4/2020 |
| GB | 2565368 | B | 6/2020 |
| GB | 2567449 | B | 7/2020 |
| GB | 2567450 | B | 7/2020 |
| GB | 2576017 | B | 4/2021 |
| GB | 2585280 | B | 5/2021 |
| GB | 2580339 | B | 7/2021 |
| GB | 2580340 | B | 7/2021 |
| GB | 2590612 | A | 7/2021 |
| GB | 2581371 | B | 9/2021 |
| GB | 2580337 | B | 10/2021 |
| GB | 2580338 | B | 10/2021 |
| GB | 2581372 | B | 12/2021 |
| GB | 2588155 | B | 12/2021 |
| GB | 2591833 | B | 12/2021 |
| GB | 2596086 | A | 12/2021 |
| GB | 2597677 | A | 2/2022 |
| GB | 2590382 | B | 4/2022 |
| GB | 2590387 | B | 4/2022 |
| GB | 2599397 | A | 4/2022 |
| GB | 2575621 | B | 5/2022 |
| GB | 2603177 | A | 8/2022 |
| GB | 2580416 | B | 9/2022 |
| GB | 2597679 | B | 9/2022 |
| GB | 2597682 | B | 9/2022 |
| GB | 2577855 | B | 10/2022 |
| GB | 2597676 | B | 10/2022 |
| GB | 2597687 | B | 11/2022 |
| GB | 2606415 | A | 11/2022 |
| GB | 2600734 | B | 12/2022 |
| GB | 2600739 | B | 12/2022 |
| GB | 2608119 | A | 12/2022 |
| GB | 2608120 | A | 12/2022 |

(56) References Cited

FOREIGN PATENT DOCUMENTS

| | | | |
|---|---|---|---|
| GB | 2590396 | B | 2/2023 |
| GB | 2587506 | B | 3/2023 |
| GB | 2599385 | B | 3/2023 |
| GB | 2610691 | A | 3/2023 |
| GB | 2600730 | B | 4/2023 |
| GB | 2600733 | B | 4/2023 |
| GB | 2600736 | B | 4/2023 |
| GB | 2612567 | A | 5/2023 |
| GB | 2599384 | B | 7/2023 |
| GB | 2600735 | B | 7/2023 |
| GB | 2600737 | B | 7/2023 |
| GB | 2600738 | B | 7/2023 |
| GB | 2605750 | B | 7/2023 |
| GB | 2614601 | A | 7/2023 |
| GB | 2614604 | A | 7/2023 |
| GB | 2599399 | B | 8/2023 |
| GB | 2601788 | B | 8/2023 |
| GB | 2616031 | A | 8/2023 |
| GB | 2591811 | B | 9/2023 |
| GB | 2601995 | B | 9/2023 |
| GB | 2616902 | A | 9/2023 |
| GB | 2603101 | B | 10/2023 |
| GB | 2617152 | A | 10/2023 |
| GB | 2603174 | B | 11/2023 |
| GB | 2618449 | A | 11/2023 |
| GB | 2618927 | A | 11/2023 |
| GB | 2618948 | A | 11/2023 |
| GB | 2619446 | A | 12/2023 |
| IN | 237954 | B | 1/2010 |
| JP | S5433154 | A | 3/1979 |
| JP | 2006051187 | A | 2/2006 |
| JP | 2006524062 | A | 10/2006 |
| JP | 2007525298 | A | 9/2007 |
| JP | 2007536049 | A | 12/2007 |
| JP | 2008018260 | A | 1/2008 |
| JP | 2008506488 | A | 3/2008 |
| JP | 2009061286 | A | 3/2009 |
| JP | 2009520542 | A | 5/2009 |
| JP | 2009523046 | A | 6/2009 |
| JP | 2009523224 | A | 6/2009 |
| JP | 2009528875 | A | 8/2009 |
| JP | 2009541020 | A | 11/2009 |
| JP | 4482034 | B2 | 3/2010 |
| JP | 4598060 | B2 | 10/2010 |
| JP | 2011125859 | A | 6/2011 |
| JP | 4944285 | B2 | 3/2012 |
| JP | 4961507 | B2 | 3/2012 |
| JP | 5068893 | B2 | 8/2012 |
| JP | 5087810 | B2 | 9/2012 |
| JP | 5137986 | B2 | 11/2012 |
| JP | 5227451 | B2 | 3/2013 |
| JP | 2013050113 | A | 3/2013 |
| JP | 5249981 | B2 | 4/2013 |
| JP | 2013075169 | A | 4/2013 |
| JP | 2013106958 | A | 6/2013 |
| JP | 2013141610 | A | 7/2013 |
| JP | 5346325 | B2 | 8/2013 |
| JP | 5368606 | B2 | 9/2013 |
| JP | 5456859 | B2 | 1/2014 |
| JP | 5466039 | B2 | 1/2014 |
| JP | 2014000405 | A | 1/2014 |
| JP | 5506855 | B2 | 3/2014 |
| JP | 2014040771 | A | 3/2014 |
| JP | 5511852 | B2 | 4/2014 |
| JP | 5519335 | B2 | 4/2014 |
| JP | 5546607 | B2 | 5/2014 |
| JP | 5562389 | B2 | 6/2014 |
| JP | 5589039 | B2 | 8/2014 |
| JP | 5635042 | B2 | 10/2014 |
| JP | 5635043 | B2 | 10/2014 |
| JP | 5635147 | B2 | 10/2014 |
| JP | 5680560 | B2 | 1/2015 |
| JP | 5686907 | B2 | 1/2015 |
| JP | 5721283 | B2 | 4/2015 |
| JP | 5771260 | B2 | 7/2015 |
| JP | 5773507 | B2 | 7/2015 |
| JP | 5786908 | B2 | 8/2015 |
| JP | 5849325 | B2 | 12/2015 |
| JP | 5853340 | B2 | 12/2015 |
| JP | 5916167 | B2 | 4/2016 |
| JP | 5923834 | B2 | 4/2016 |
| JP | 5923835 | B2 | 4/2016 |
| JP | 2016148338 | A | 8/2016 |
| JP | 6111777 | B2 | 3/2017 |
| JP | 6143031 | B2 | 5/2017 |
| JP | 2017127641 | A | 7/2017 |
| JP | 6253207 | B2 | 12/2017 |
| JP | 6336514 | B2 | 5/2018 |
| JP | 2018069065 | A | 5/2018 |
| JP | 6375320 | B2 | 7/2018 |
| JP | 2018110855 | A | 7/2018 |
| JP | 6469891 | B2 | 1/2019 |
| JP | 2019072485 | A | 5/2019 |
| JP | 2019072488 | A | 5/2019 |
| JP | 2019075982 | A | 5/2019 |
| JP | 6578045 | B2 | 8/2019 |
| JP | 6615245 | B2 | 11/2019 |
| JP | 6639569 | B2 | 1/2020 |
| JP | 6644112 | B2 | 1/2020 |
| JP | 6689318 | B2 | 4/2020 |
| JP | 2020530387 | A | 10/2020 |
| JP | 6802823 | B2 | 12/2020 |
| JP | 2021504052 | A | 2/2021 |
| JP | 6869036 | B2 | 4/2021 |
| JP | 2021514766 | A | 6/2021 |
| JP | 6945798 | B2 | 9/2021 |
| JP | 6999506 | B2 | 12/2021 |
| JP | 7077410 | B2 | 5/2022 |
| JP | 7113734 | B2 | 7/2022 |
| JP | 7125497 | B2 | 8/2022 |
| KR | 20090034399 | A | 4/2009 |
| KR | 20110122699 | A | 11/2011 |
| KR | 20120027357 | A | 3/2012 |
| KR | 101501673 | B1 | 3/2015 |
| KR | 20150032595 | A | 3/2015 |
| KR | 20150036773 | A | 4/2015 |
| KR | 20150036774 | A | 4/2015 |
| KR | 101836299 | B1 | 3/2018 |
| KR | 102153115 | B1 | 9/2020 |
| PT | 2271842 | E | 7/2012 |
| RU | 2578998 | C2 | 3/2016 |
| RU | 2620750 | C1 | 5/2017 |
| RU | 2631939 | C2 | 9/2017 |
| SG | 10201810752 | | 6/2020 |
| TH | 69500 | B | 4/2019 |
| TH | 79493 | B | 10/2020 |
| TW | 200826892 | A | 7/2008 |
| TW | 201640388 | A | 11/2016 |
| TW | 201909818 | A | 3/2019 |
| TW | 201929389 | A | 7/2019 |
| WO | 9400046 | A1 | 1/1994 |
| WO | 0050460 | A1 | 8/2000 |
| WO | 0050461 | A1 | 8/2000 |
| WO | 0050077 | A9 | 8/2001 |
| WO | 02067750 | A1 | 9/2002 |
| WO | 02067755 | A1 | 9/2002 |
| WO | 02067756 | A1 | 9/2002 |
| WO | 2005029680 | A1 | 3/2005 |
| WO | 2008009886 | A1 | 1/2008 |
| WO | 2008009891 | A1 | 1/2008 |
| WO | 2011056183 | A1 | 5/2011 |
| WO | 2011131965 | A1 | 10/2011 |
| WO | 2011139804 | A2 | 11/2011 |
| WO | 2013014093 | A1 | 1/2013 |
| WO | 2013014094 | A1 | 1/2013 |
| WO | 2013026272 | A1 | 2/2013 |
| WO | 2013082309 | A1 | 6/2013 |
| WO | 2013148348 | A1 | 10/2013 |
| WO | 2013190311 | A1 | 12/2013 |
| WO | 2014170638 | A1 | 10/2014 |
| WO | 2016078346 | A1 | 5/2016 |
| WO | 2017001831 | A1 | 1/2017 |
| WO | 2017001838 | A1 | 1/2017 |
| WO | 2017001839 | A1 | 1/2017 |

(56) References Cited

FOREIGN PATENT DOCUMENTS

| | | | |
|---|---|---|---|
| WO | 2017129931 | A1 | 8/2017 |
| WO | 2017163066 | A1 | 9/2017 |
| WO | 2017163068 | A1 | 9/2017 |
| WO | 2018051113 | A1 | 3/2018 |
| WO | 2019042763 | A1 | 3/2019 |
| WO | 2019120180 | A1 | 6/2019 |
| WO | 2019141971 | A1 | 7/2019 |
| WO | 2020025956 | A1 | 2/2020 |
| WO | 2020055519 | A1 | 3/2020 |
| WO | 2020089580 | A1 | 5/2020 |
| WO | 2020152433 | A1 | 7/2020 |
| WO | 2020201686 | A1 | 10/2020 |
| WO | 2020229790 | A1 | 11/2020 |
| WO | 2021009478 | A1 | 1/2021 |
| WO | 2021123719 | A1 | 6/2021 |
| WO | 2021195773 | A1 | 10/2021 |
| WO | 2021234339 | A1 | 11/2021 |
| WO | 2022003310 | A1 | 1/2022 |
| WO | 2022069873 | A1 | 4/2022 |
| WO | 2022069881 | A1 | 4/2022 |
| WO | 2022089132 | A1 | 5/2022 |
| WO | 2022090683 | A1 | 5/2022 |
| WO | 2022123198 | A1 | 6/2022 |
| WO | 2022129826 | A1 | 6/2022 |
| WO | 2022129827 | A1 | 6/2022 |
| WO | 2022129828 | A1 | 6/2022 |
| WO | 2022129829 | A1 | 6/2022 |
| WO | 2022129830 | A1 | 6/2022 |
| WO | 2022129831 | A1 | 6/2022 |
| WO | 2022129832 | A1 | 6/2022 |
| WO | 2022129833 | A1 | 6/2022 |
| WO | 2022129834 | A1 | 6/2022 |
| WO | 2022129835 | A1 | 6/2022 |
| WO | 2022129836 | A1 | 6/2022 |
| WO | 2022129837 | A1 | 6/2022 |
| WO | 2022129846 | A1 | 6/2022 |
| WO | 2022129855 | A1 | 6/2022 |
| WO | 2022136821 | A1 | 6/2022 |
| WO | 2022136825 | A1 | 6/2022 |
| WO | 2022136826 | A1 | 6/2022 |
| WO | 2022136827 | A1 | 6/2022 |
| WO | 2022136829 | A1 | 6/2022 |
| WO | 2022136830 | A1 | 6/2022 |
| WO | 2022136833 | A1 | 6/2022 |
| WO | 2022136834 | A1 | 6/2022 |
| WO | 2022136837 | A1 | 6/2022 |
| WO | 2022136866 | A2 | 6/2022 |
| WO | 2022146119 | A1 | 7/2022 |
| WO | 2022153029 | A1 | 7/2022 |
| WO | 2022153030 | A1 | 7/2022 |
| WO | 2022156300 | A1 | 7/2022 |
| WO | 2022162336 | A1 | 8/2022 |
| WO | 2022162338 | A1 | 8/2022 |
| WO | 2022162339 | A1 | 8/2022 |
| WO | 2022162340 | A1 | 8/2022 |
| WO | 2022180384 | A1 | 9/2022 |
| WO | 2022180387 | A1 | 9/2022 |
| WO | 2022180389 | A1 | 9/2022 |
| WO | 2022214782 | A1 | 10/2022 |
| WO | 2022214783 | A1 | 10/2022 |
| WO | 2022214791 | A1 | 10/2022 |
| WO | 2022214792 | A1 | 10/2022 |
| WO | 2022229597 | A1 | 11/2022 |
| WO | 2022229598 | A1 | 11/2022 |
| WO | 2022229599 | A1 | 11/2022 |
| WO | 2022229600 | A1 | 11/2022 |
| WO | 2022229613 | A1 | 11/2022 |
| WO | 2022234251 | A1 | 11/2022 |
| WO | 2022234253 | A1 | 11/2022 |
| WO | 2022234254 | A1 | 11/2022 |
| WO | 2022234255 | A1 | 11/2022 |
| WO | 2022238685 | A1 | 11/2022 |
| WO | 2022238686 | A1 | 11/2022 |
| WO | 2022248825 | A1 | 12/2022 |
| WO | 2022248826 | A1 | 12/2022 |
| WO | 2022248827 | A1 | 12/2022 |
| WO | 2022248828 | A1 | 12/2022 |
| WO | 2022248829 | A1 | 12/2022 |
| WO | 2022248830 | A1 | 12/2022 |
| WO | 2022248831 | A1 | 12/2022 |
| WO | 2022248832 | A1 | 12/2022 |
| WO | 2022248833 | A1 | 12/2022 |
| WO | 2022248834 | A1 | 12/2022 |
| WO | 2022254186 | A1 | 12/2022 |
| WO | 2022254187 | A1 | 12/2022 |
| WO | 2022254188 | A1 | 12/2022 |
| WO | 2022254189 | A1 | 12/2022 |
| WO | 2022269223 | A1 | 12/2022 |
| WO | 2022269224 | A1 | 12/2022 |
| WO | 2022269225 | A1 | 12/2022 |
| WO | 2022269226 | A1 | 12/2022 |
| WO | 2022269227 | A1 | 12/2022 |
| WO | 2022269228 | A1 | 12/2022 |
| WO | 2022269230 | A1 | 12/2022 |
| WO | 2022269232 | A1 | 12/2022 |
| WO | 2022269234 | A1 | 12/2022 |
| WO | 2023285448 | A1 | 1/2023 |
| WO | 2023285806 | A1 | 1/2023 |
| WO | 2023285808 | A1 | 1/2023 |
| WO | 2023285809 | A1 | 1/2023 |
| WO | 2023285810 | A1 | 1/2023 |
| WO | 2023285811 | A1 | 1/2023 |
| WO | 2023012445 | A1 | 2/2023 |
| WO | 2023012447 | A1 | 2/2023 |
| WO | 2023012457 | A1 | 2/2023 |
| WO | 2023012458 | A1 | 2/2023 |
| WO | 2023025057 | A1 | 3/2023 |
| WO | 2023031588 | A1 | 3/2023 |
| WO | 2023037104 | A1 | 3/2023 |
| WO | 2023037106 | A1 | 3/2023 |
| WO | 2023047105 | A1 | 3/2023 |
| WO | 2023073340 | A1 | 5/2023 |
| WO | 2023075998 | A1 | 5/2023 |
| WO | 2023079270 | A1 | 5/2023 |
| WO | 2023079272 | A1 | 5/2023 |
| WO | 2023084183 | A1 | 5/2023 |
| WO | 2023084197 | A1 | 5/2023 |
| WO | 2023089296 | A1 | 5/2023 |
| WO | 2023099862 | A1 | 6/2023 |
| WO | 2023105182 | A1 | 6/2023 |
| WO | 2023105192 | A1 | 6/2023 |
| WO | 2023111500 | A1 | 6/2023 |
| WO | 2023111501 | A1 | 6/2023 |
| WO | 2023111502 | A1 | 6/2023 |
| WO | 2023111503 | A1 | 6/2023 |
| WO | 2023111504 | A1 | 6/2023 |
| WO | 2023111507 | A1 | 6/2023 |
| WO | 2023111532 | A1 | 6/2023 |
| WO | 2023111556 | A1 | 6/2023 |
| WO | 2023118806 | A1 | 6/2023 |
| WO | 2023118807 | A1 | 6/2023 |
| WO | 2023118808 | A1 | 6/2023 |
| WO | 2023118809 | A1 | 6/2023 |
| WO | 2023131770 | A1 | 7/2023 |
| WO | 2023131773 | A1 | 7/2023 |
| WO | 2023166300 | A1 | 9/2023 |

OTHER PUBLICATIONS

U.S. Appl. No. 18/416,781 entitled "Hair Care Accessories", filed on Jan. 18, 2024, 53 pages.

* cited by examiner

IDENTIFICATION OF HAIR CARE APPLIANCE ATTACHMENTS

CROSS REFERENCE TO RELATED APPLICATIONS

The present application claims priority to U.S. Provisional Patent Application No. 63/480,680 entitled "Hair Care Appliance With Powered Attachment" filed on Jan. 19, 2023, which is hereby incorporated by reference in its entirety.

FIELD

The present disclosure relates generally to hair care appliances and accessories for use with hair care appliances.

BACKGROUND

Hair care appliances are devices used for drying and styling of hair. Hair care appliances can include a variety of components operable to provide a fluid flow via a fluid flow path extending through the device. The fluid flow path receives ambient air and directs the ambient air through the hair care appliance via a motor and fan assembly. The fluid flow path is directed across a heating assembly to generate heated air at an outlet of the hair care appliance. Air is expelled from the hair care appliance via the fluid flow path to enable a user to dry or style hair. One or more attachments are often used with the hair care appliance depending on the user's hair styling or treatment needs.

Different attachments achieve optimal results for hair with different settings of the hair care appliance. However, it is difficult for even sophisticated, experienced users of hair care appliances to always choose the most effective settings for a given attachment attached to a hair care appliance. Consulting a manual or other documentation before choosing settings and using the hair care appliance with attachment attached thereto takes time and, consequently, degrades user experience. A user may forget to select a particular setting or accidentally select an unintended setting, thereby not allowing for optimal performance of the hair care appliance with the attachment attached thereto. Additionally, an amount of time a particular attachment should be used for optimal results may not be known by a user, so hair may not be optimally dried or styled and/or a user may become frustrated at needing to guess when to stop use of the hair care appliance with attachment attached thereto.

SUMMARY

In general, attachments for hair care appliances and methods of using attachments for hair care appliances are provided.

In one aspect, a hair care assembly is provided that in one embodiment includes a hair care appliance and an accessory. The hair care appliance includes a motor, a heater, a fan, and a processor. The motor is configured to drive the fan, the fan is configured to draw air in through an air inlet and to expel air from an air outlet, the heater is configured to heat air flow from the fan, and the processor is configured to control the motor and the heater. The accessory is configured to removably mate to the hair care appliance so that the accessory is communicable with the air outlet and is in electrical communication with the hair care appliance. With the accessory removably mated to the hair care appliance, the processor is configured to receive a return signal from the accessory and is configured to modify at least one operating parameter of the hair care appliance based on the received return signal.

The hair care assembly can have any number of variations. For example, the hair care appliance can include a mating assembly, the accessory can include a coupling configured to removably mate to the hair care appliance so that the accessory is removably mated to the hair care appliance, and the mating of the coupling and the mating assembly can be configured to mechanically mate and electrically mate the accessory to the hair care appliance.

For another example, the removable mating of the accessory to the hair care appliance can be configured to complete an electrical path from the hair care appliance to the accessory and returning to the hair care accessory. Further, the electrical path can include a resistor disposed in the accessory, and a resistance value of the resistor can define how the processor modifies the at least one operating parameter of the hair care appliance.

For yet another example, the processor can be configured to identify the accessory based on the return signal, and the modification of the at least one operating parameter can be based on the identification of the accessory. Further, the hair care assembly can also include an additional accessory configured to removably mate to the hair care appliance, only one of the accessory and the additional accessory can be mateable at a time to the hair care appliance, and, with the additional accessory removably mated to the hair care appliance, the processor can be configured to receive a signal from the additional accessory, can be configured to identify the accessory based on the signal from the additional accessory, and can be configured to modify at least one operating parameter of the hair care appliance based on the identification of the additional accessory.

For still another example, the hair care appliance can include first and second electrical connectors, the accessory can include third and fourth electrical connectors, the removable mating of the accessory to the hair care appliance can be configured to electrically mate the first and third electrical connectors and electrically mate the second and fourth electrical connectors, and the hair care appliance can be configured to transmit a source signal to the accessory via the first electrical connector mated to the third electrical connector such that the source signal passes through the third electrical connector and thereafter the fourth electrical connector before returning to the hair care appliance via the second electrical connector. In some embodiments, a resistor can be disposed between the third and fourth electrical connectors such that the source signal passes through the third electrical connector and thereafter the resistor and thereafter the fourth electrical connector; and/or the first and second electrical connectors can not be in electrical communication with each other until the accessory is removably mated to the hair care appliance. Further, the hair care assembly can also include an additional accessory configured to removably mate to the hair care appliance, only one of the accessory and the additional accessory can be mateable at a time to the hair care appliance, the additional accessory can include fifth and sixth electrical connectors with a second resistor disposed between the fifth and sixth electrical connectors, the second resistor can have a resistance value that is different than a resistance value of the resistor of the accessory, the removable mating of the additional accessory to the hair care appliance can be configured to electrically mate the first and fifth electrical connectors and electrically mate the second and sixth electrical connectors, the hair care appliance can be configured to transmit a source signal to the additional accessory via the first electrical connector mated to the fifth electrical connector such that the source signal passes through the fifth electrical connector and thereafter the second resistor and thereafter the sixth electrical connector before returning to the hair care appliance via the second electrical connector such that the processor is configured to modify at least one operating parameter of the hair care appliance based on the signal returned via the second and sixth electrical connectors. In some embodiments, the first and second electrical connectors can not be in electrical communication with each other until the accessory is removably mated to the hair care appliance; and/or the hair care appliance can include a fifth electrical connector, the hair care assembly can also include an additional accessory configured to removably mate to the hair care appliance, only one of the accessory and the additional accessory can be mateable at a time to the hair care appliance, the additional accessory can include sixth and seventh electrical connectors, the removable mating of the additional accessory to the hair care appliance can be configured to electrically mate the first and sixth electrical connectors and electrically mate the fifth and seventh electrical connectors, and, with the additional accessory removably mated to the hair care appliance, the processor can be configured to receive a signal from the additional accessory and is configured to modify at least one operating parameter of the hair care appliance based on the signal received from the additional accessory.

For another example, the at least one operating parameter can include at least one of a temperature of the heater and a speed of the fan.

For still another example, the accessory can include at least one sensor, and the signal can include data from the at least one sensor on the accessory body, and the processor is configured to modify at least one operating parameter of the hair care appliance based on the received data.

For another example, the accessory can be one of a brush attachment, a curling attachment, and a concentrator attachment. Further, the hair care assembly can also include an additional accessory configured to removably mate to the hair care appliance, only one of the accessory and the additional accessory can be mateable at a time to the hair care appliance, and, with the additional accessory removably mated to the hair care appliance, the processor can be configured to receive a signal from the additional accessory and can be configured to modify at least one operating parameter of the hair care appliance based on the received signal. Further, the additional accessory can be a different one of the brush attachment, the curling attachment, and the concentrator attachment.

In another aspect, a hair care system is provided that in one embodiment includes a hair care appliance including a processor and a memory storing instructions that, when executed by the processor, cause the processor to perform operations that include, in response to releasable coupling of an accessory to the hair care appliance such that the accessory and the hair care appliance are mechanically and electrically coupled together, automatically identifying the accessory, and automatically setting at least one operational parameter of the hair care appliance based on the identification of the accessory.

The hair care system can vary in any number of ways. For example, the operations can also include, in response to the releasable coupling of the accessory to the hair care appliance such that the accessory and the hair care appliance are mechanically and electrically coupled together, and before automatically identifying the accessory: causing a source signal to be transmitted from the hair care appliance to the accessory, and the identification of the accessory can be based on a signal returned from the accessory to the hair care appliance. Further, the hair care appliance can be configured to releasably couple to an additional accessory of a type different than the accessory; the hair care appliance can be configured to releasably couple to only one of the accessory and the additional accessory at a time; the operations can also include, in response to releasable coupling of the additional accessory to the hair care appliance such that the additional accessory and the hair care appliance are mechanically and electrically coupled together, automatically identifying the additional accessory, and automatically setting the at least one operational parameter of the hair care appliance based on the identification of the additional accessory; and the identification of the additional accessory can be based on a signal returned from the additional accessory to the hair care appliance.

For another example, the accessory can be one of a brush attachment, a curling attachment, and a concentrator attachment.

For yet another example, the hair care system can also include the accessory, and the accessory can be one of a brush attachment, a curling attachment, and a concentrator attachment.

In another aspect, a computer-implemented method is provided that in one embodiment includes, in response to releasable coupling of an accessory to a hair care appliance such that the accessory and the hair care appliance are mechanically and electrically coupled together, automatically identifying the accessory. The method also includes automatically setting at least one operational parameter of the hair care appliance based on the identification of the accessory. The accessory is one of a brush attachment, a curling attachment, and a concentrator attachment.

The method can have any number of variations. For example, the method can also include, in response to the releasable coupling of the accessory to the hair care appliance such that the accessory and the hair care appliance are mechanically and electrically coupled together, and before automatically identifying the accessory: causing a source signal to be transmitted from the hair care appliance to the accessory.

DESCRIPTION OF DRAWINGS

These and other features will be more readily understood from the following detailed description taken in conjunction with the accompanying drawings, in which.

Figure 2:
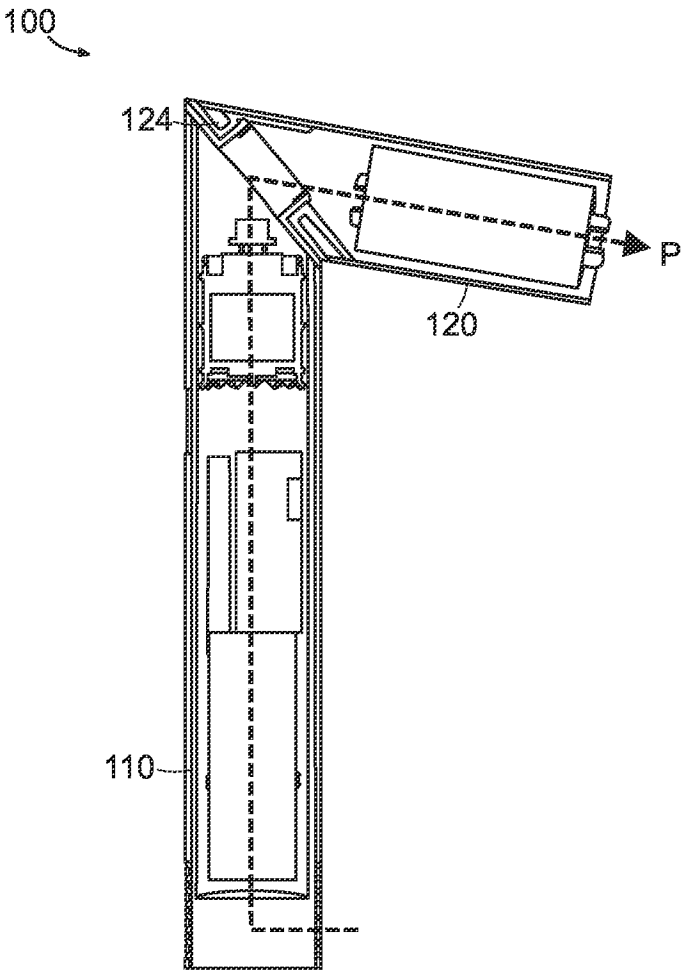
FIG. 2 is a side cross-sectional view of the hair care appliance of FIG. 1 shown in an angled or bent configuration.

It is noted that the drawings are not necessarily to scale. The drawings are intended to depict only typical aspects of the subject matter disclosed herein, and therefore should not be considered as limiting the scope of the disclosure.

DETAILED DESCRIPTION

Certain exemplary embodiments will now be described to provide an overall understanding of the principles of the structure, function, manufacture, and use of the devices and methods disclosed herein. One or more examples of these embodiments are illustrated in the accompanying drawings. Those skilled in the art will understand that the devices and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present invention.

Various exemplary hair care appliances and accessories for use with a hair care appliance are provided herein. In general, a hair care appliance in an exemplary embodiment is in the form of a hair dryer that has an air inlet and at least one air outlet, and various internal components that facilitate use and operation of the hair care appliance, such as a fan, motor, and heater. Various accessories (also referred to herein as "attachments") are also provided for use with a hair care appliance, such as a hair dryer or with any other hair care appliance known in the art. The configuration of the appliance is varied based on the type of accessory mated to the hair care appliance.

The hair care appliance and attachments described herein are configured to couple so that the hair care appliance and an attachment coupled to the hair care appliance are in electrical communication. Power can be conveyed between the hair care appliance and an attachment coupled to the hair care appliance. In some embodiments, data signals can be conveyed between the hair care appliance and an attachment coupled to the hair care appliance. Conventional hair care appliances and their attachments may not include the ability to transmit power to an attachment coupled to the hair care appliance or to exchange data signals between the hair care appliance and the attachment. As a result, users may perform certain styling methods poorly and the resulting hair styling may be undesirable or unintended, causing a negative user experience. In contrast, the hair care appliances and attachments described herein can provide a more robust styling experience by conveying power and/or data signals between the hair care appliance and the attachment coupled thereto, such as by virtue of sensors, user interfaces, and programmable styling routines as described herein. The hair care appliances and attachments described herein can enhance the overall styling experience, regardless of user skill, and provide a modular styling device that can adapt to a variety of styling needs via a broad selection of attachments configured for use with the hair care appliance.

With an attachment coupled to the hair care appliance, a user can receive indications of feedback from a user interface of the attachment indicating at least one setting (e.g., timing, temperature, etc.) required to achieve optimal styling results. In some embodiments, powered sensors provided in the attachments can further enable automated operation of the hair care appliance to ensure the user is employing the device in a manner that will generate the best results possible for a desired styling method.

Figure 1:
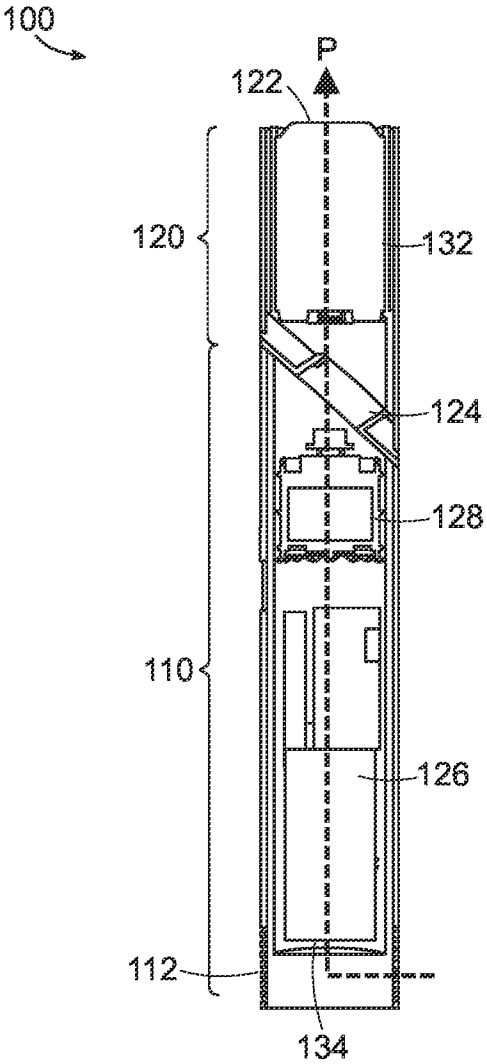
FIG. 1 is a side cross-sectional view of one exemplary embodiment of a hair care appliance shown in a straight configuration.

FIGS. 1 and 2 illustrate one exemplary embodiment of a hair care appliance 100. The illustrated hair care appliance 100 has straight and bent configurations, as respectively shown, however the hair care appliance 100 can have various other configurations. As in this illustrated embodiment, the hair care appliance 100 can generally include a handle 110 movably coupled to a body 120 by a rotational hinge joint 124. In the straight configuration, shown in FIG. 1, the appliance 100 has a generally elongate cylindrical shape. The handle 110 has an inlet 112 at a first end of the appliance 100, and the body 120 has an outlet 122 at a second end of the appliance 100. A fluid flow path P (shown as a dashed line) is formed between the inlet 112 and the outlet 122. The rotational hinge joint 124 formed between the handle 110 and the body 120 is configured to articulate via user operation to alter the configuration of the hair care appliance 100 and the fluid flow path P from the straight configuration to the bent configuration (also referred to herein an as "angled configuration"). As shown in FIG. 2, in the angled configuration, the handle 110 and the body 120 are angled relative to one another as a result of articulation of the rotational hinge joint 124. As a result, as shown in FIG. 2, the fluid flow path P shown by a dashed line is angled between the handle 110 and the body 120. In FIG. 1, the fluid flow path P is substantially straight from the inlet 112 to the outlet 122.

A person skilled in the art will appreciate that the hair care appliance 100 can be operated while the rotational hinge joint 124 is unlatched, and/or while the rotational hinge joint 124 is rotated to any position that is between the position of the rotational hinge joint 124 in the straight configuration and the angled configuration. In other aspects, the hair care appliance 100 and the rotational hinge joint 124 can be configured to prevent over-rotation of the rotational hinge joint 124 beyond its position in the angled configuration. The hair care appliance 100 can be configured in a fully straight configuration, as shown in FIG. 1, in which the rotational hinge joint locks the body 120 so as to be substantially longitudinally aligned with the handle 110. The hair care appliance 100 can be configured in a fully bent configuration, as shown in FIG. 2, in which the rotational hinge joint 124 locks the body 120 at an angle relative to the handle 110. The hair care appliance 100 can also be configured in a rotated configuration in which the rotational hinge joint 124 positions the body 120 relative to the handle 110 in a range of angled positions that are in between those of the straight configuration and the bent configuration. A fully angled configuration of the hair care appliance 100 is illustrated in FIG. 2. At any angled configuration, the fluid flow path P will be angled between the handle 110 and the body 120 and thus from the inlet 112 to the outlet 122.

The hair care appliance 100 includes various internal electrical components 126 configured for operating the appliance 100. In general, as in this illustrated embodiment, the handle 110 can include the electrical components 126 that are configured to control operation of a fan assembly 128 disposed within the handle 110 and a heater assembly 132 disposed in the body 120. In an exemplary embodiment, as shown, the fan assembly 128 is placed downstream of the rotational hinge joint 124 and in proximity of the heater assembly 132, which is disposed upstream of the rotational hinge joint 124. This can help improve fluid flow within the hair care appliance 100. The fan assembly 128 is configured to generate a fluid flow along the fluid flow path P such that air is drawn into the inlet 112, passes through the handle 110, and into the body 120 to be exhausted via the outlet 122. As the air passes through the body 120, the air is heated via the heater assembly 132.

Figure 4:
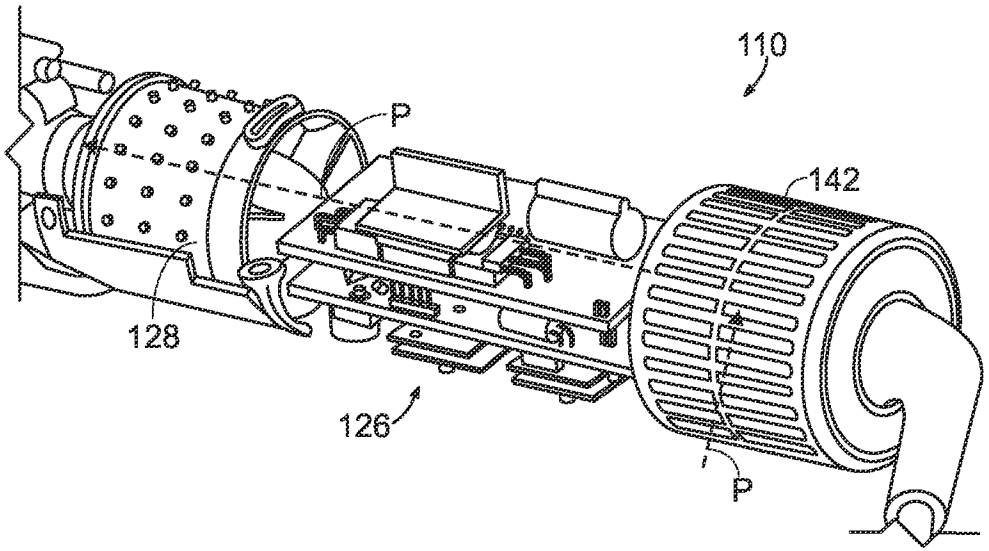
FIG. 4 is a perspective view of the handle of FIG. 1 shown with the inlet housing removed.
Figure 3:
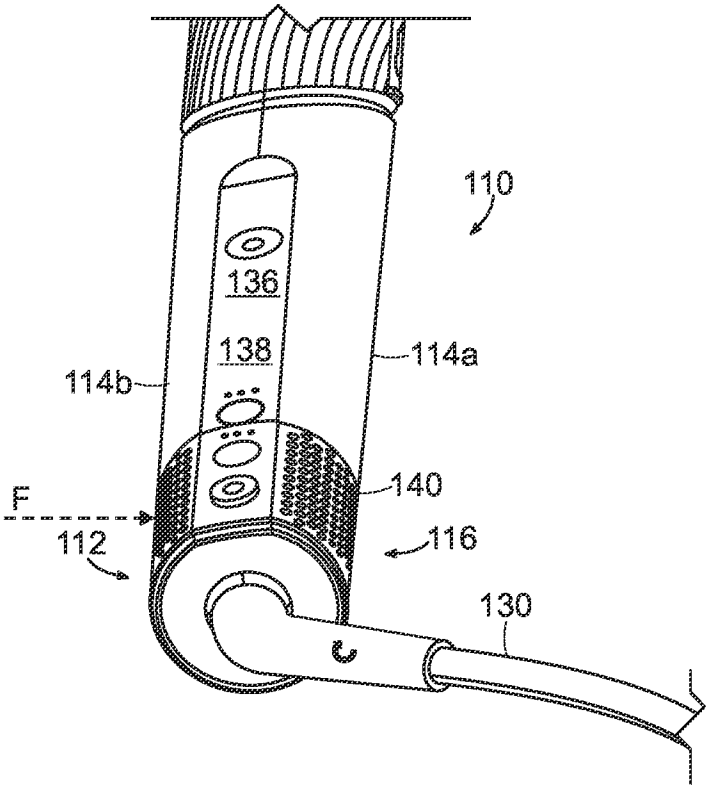
FIG. 3 is a perspective end view of a handle of the hair care appliance of FIG. 1.

The electrical components 126 are configured to couple to a power supply. FIG. 3 illustrates a power supply cord 130 extending from a proximal base of the handle 110. The power supply cord 130 has a terminal end (not shown) configured to couple to a power source, e.g., the terminal end can be configured to plug into an electrical outlet. The power supply cord 130 includes internal electrical wiring configured to deliver power to the electrical components 126 in the handle 110. The power supply cord 130 may be connected to an electronics housing containing the electrical components 126, which as in this illustrated embodiment can include at least one controller or printed circuit board (PCB) as shown in FIG. 4.

As further shown in FIG. 3, the proximal base of the handle 110 includes a filter assembly 116 configured to filter air drawn in through the inlet 112. In the illustrated embodiment, the filter assembly 116 extends around a proximal end portion of the handle 110, but is not formed in the end wall of the handle 110. Thus, fluid F is configured to drawn in circumferentially around the sidewalls of the handle 110. The illustrated filter assembly 116 includes an inlet housing 140 that is generally C-shaped and that is flexible for allowing the inlet housing 140 to be removed for cleaning. A user interface 138 intersects the inlet housing 140 in this illustrated embodiment. The inlet housing 140 has a plurality of holes through which the fluid F is configured to flow into the fluid flow path P. The holes can have any configuration and can be arranged in any pattern. The inlet housing 140 is configured to cover a filter 142 positioned behind the inlet housing 140, as shown in FIG. 4 in which the inlet housing 140 is removed. The filter 142 can be a porous element, as shown, configured to block debris and hair that may have entered the inlet housing 140, thus preventing debris from entering the fluid flow path P. As further shown in FIG. 4, the electrical components 126 are positioned just downstream of the filter 142, but upstream of the fan assembly 128, thus the fluid flow path P flows over and around the electrical components 126 as the fluid F is drawn toward and into the fan assembly 128 in operation. This can aid in cooling the electrical components 126.

Figure 5:
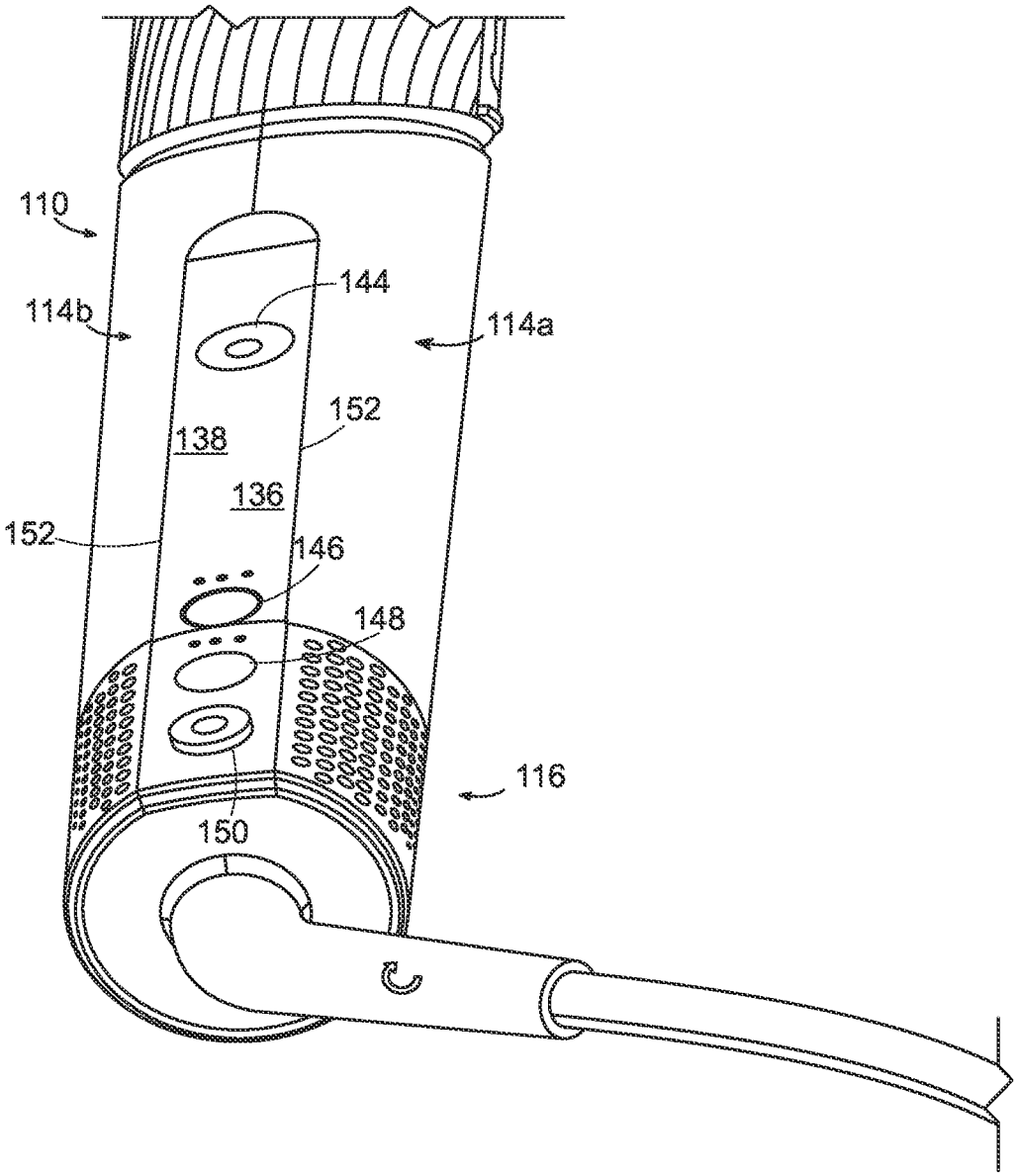
FIG. 5 is a perspective end view of a user interface of the hair care appliance of FIG. 1.

The handle 110 also includes the user interface 138 configured to enable the user to provide inputs for operating the appliance 100, as shown in FIG. 5. In particular, as in this illustrated embodiment, the user interface 138 can include one or more actuators (e.g., buttons, switches, etc.) for powering the hair care appliance 100 on and off, adjusting a temperature setting of the heater assembly 132 (and thus adjusting a temperature of the fluid F heated by the heater assembly 132), and adjusting a fan speed of the fan assembly 128 (and thus adjusting a velocity of the fluid F expelled via the outlet 122). The user interface 138 also includes one or more actuators for powering or otherwise controlling an accessory attached to the hair care appliance 100, as will be discussed in more detail below. The user interface 138 also includes an actuator for disengaging the heating assembly 132 thus providing a cool, non-heated fluid from the outlet 122. In some embodiments, the user interface 138 can include one or more light emitting diodes (LEDs), and/or other type of light, configured to provide a visual indication of an operating mode of the hair care appliance 100. In some embodiments, the user interface 138 can include one or more speakers configured to provide an audible indication of an operating mode of the hair care appliance 100. In some embodiments, the user interface 138 can include one or more haptic feedback mechanisms configured to provide a tactile indication, such as a vibration, of an operating mode of the hair care appliance 100.

While the user interface 138 can be positioned at various locations, in an exemplary embodiment, the user interface 138 extends longitudinally along at least a portion of the handle 110. As shown in FIG. 5, the user interface 138 in this illustrated embodiment extends along the base of the handle 110, intersects the filter assembly 116 as shown, and extends toward the rotational hinge joint 124, terminating a small distance from the rotational hinge joint 124. The user interface 138 is provided on a scalloped portion 136 of the handle 110 in this illustrated embodiment. The scalloped portion 136 includes raised edges along opposed lateral sides of the user interface 138 configured to facilitate gripping of the handle 110 by a user. The user interface 138 extends between a first handle housing 114*a* of the handle 110 and a second handle housing 114*b* of the handle 110 in this illustrated embodiment. In another embodiment, the user interface 138 can intersect the filter 142.

The wiring coupling the user interface 138 to the electrical components 126 is routed to the sides of the user interface 138, and not directly under the user interface 138, to ensure that the fluid flow path P is not restricted or has limited fluid flow.

As indicated above, the user interface 138 can include one or more actuators configured to control operation of the hair care appliance 100 based on user inputs. For example, the user interface 138 can include a blow-out feature 144, which is shown as a button in this illustrated embodiment. Actuation of the blow-out feature 144 is configured to cause the heater assembly 132 to shut off so that only non-heated air is exhausted through the outlet 122. In some embodiments, the blow-out feature 144 can be located remotely from the user interface 138 or within the user interface 138 but remotely from other features of the user interface 138.

The user interface 138 can also include a fan setting feature 146, which is shown as a button in this illustrated embodiment. Actuation of the fan setting feature 146 is configured to control a speed of the fan assembly 128. The fan setting feature 146 is configured to be repeatedly selectable to generate high, medium, and low velocity fluid flow by the fan assembly 128.

The user interface 138 also includes a temperature setting feature 148, which is shown as a button in this illustrated embodiment. Actuation of the temperature setting feature 148 is configured to control a temperature of the heater assembly 132 and thus the fluid flow exiting the outlet 122 of the hair care appliance 100. The temperature setting feature 148 is configured to be repeatedly selectable to heat the fluid flow to very high, high, medium, or low temperatures. In some embodiments, the high temperature setting can cause the heater assembly 132 to heat the fluid flow to 100 degrees C.

As further shown in FIG. 5, the user interface 138 includes a power feature 150, which is shown as a button in this illustrated embodiment. Actuation of the power feature 150 is configured to control provision of power from the power supply to the electrical components 126 of the hair care appliance 100, and/or to electrical components of an accessory releasably coupled to the hair care appliance 100 as discussed further below. The user interface 138 also includes one or more tactile features 152, as indicated above. The tactile features 152 can, as in this illustrated embodiment, be raised edges or gripping features configured to improve the user's grip and manual dexterity when holding or operating the hair care appliance 100.

In some embodiments, the actuators (e.g., the features 144, 146, 148, 150) of the user interface 138 can be configured to avoid accidental engagement by the user. For example, one or more of the features 144, 146, 148, 150 of the user interface 138 can be recessed and require explicit engagement to trigger a particular user engagement feature. The low-profile or recessed design of the actuators of the user interface 138 is configured to enable a user to operate the hair care appliance 100 without mistakenly contacting an unintended actuator. In some embodiments, any of the actuators of the user interface 138 described herein can be configured with lighting or illuminated elements that can illuminate an actuator or surface of the user interface 138, such as an inner or under surface of the user interface 138. The arrangement and styling of the user interface features described herein can be provided in a variety of non-limiting configurations on the handle 110 of the hair care appliance 100 described herein.

The hair care appliances described herein, such as the hair care appliance 100 of FIGS. 1-5, includes a variety of features configured to improve the ease of styling hair, heating hair, and the longevity of hair styles applied using the appliance. For example, in one embodiment, the hair care appliance includes an attachment mating assembly configured to couple the appliance to a selected one of various attachments, also referred to as accessories, which can be powered attachments in some embodiments. The use of powered attachments can advantageously enhance hair styling by positioning heating elements and/or sensors in the attachment and thus closer to the hair being styled than if the heating elements and/or sensors were in the hair care appliance. Powered attachments can also include user interface elements configured to provide a user with visual, audio, and/or haptic feedback about the styling process and/or operation of the hair care appliance to which the powered attachment is releasably coupled. A user's styling experience can be enhanced using powered attachments that can be easily coupled to the hair care appliance via the attachment mating assembly configured to couple with an attachment mating mechanism of a selected powered attachment. Providing power and/or communications circuitry between the hair care appliance and a powered attachment via the attachment mating mechanism can expand the operation and function of the hair care appliance.

Figure 6:
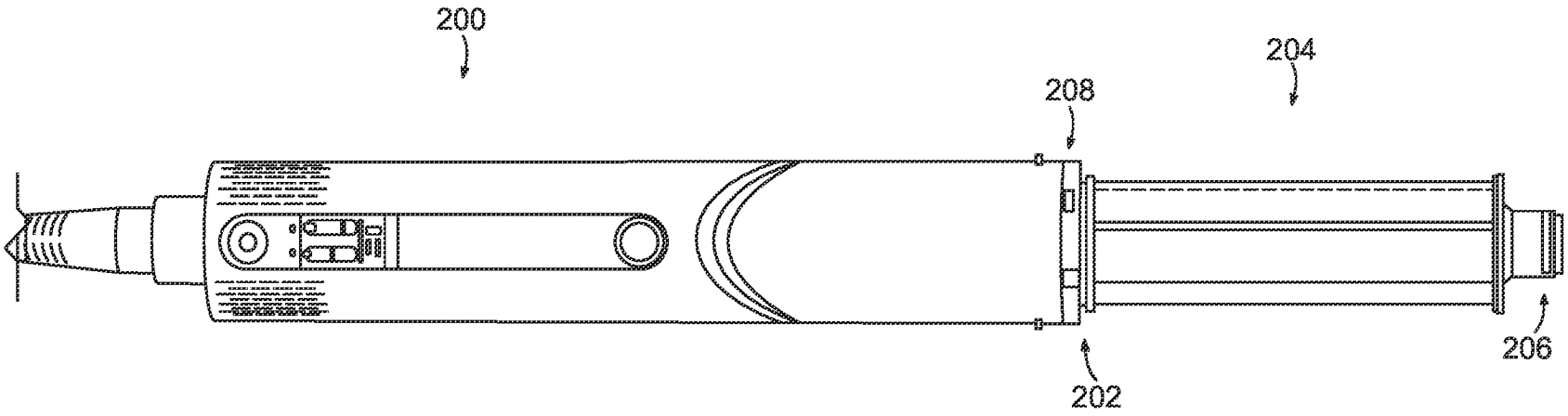
FIG. 6 is a side view of an exemplary embodiment of a hair care appliance and a powered attachment as described herein.

FIG. 6 illustrates one exemplary embodiment of a hair care appliance 200 having an attachment mating assembly 202 configured to couple an attachment 204 to the hair care appliance 200. In this embodiment, the attachment 204 is a curling attachment configured to curl hair. The curling attachment 204 in this illustrated embodiment has a generally elongate cylindrical configuration with a plurality of heating plates thereon, as discussed further below. The illustrated curling attachment 204 further includes a user interface 206 at a distal end of the attachment 204. In some embodiments, as in this illustrated embodiment, the hair care appliance 200 can also include a user interface 208 at a distal end of the hair care appliance 200. In some embodiments, one or both of the user interfaces 206, 208 can include at least one LED and/or other type of light, at least one speaker, and/or at least one haptic feedback mechanisms. Although FIG. 6 shows a curling attachment 204, a variety of non-limiting attachments can be envisioned that can be configured to couple to the hair care appliance 200 via the attachment mating assembly 202 described herein. Other examples of attachments are discussed herein.

Figure 7:
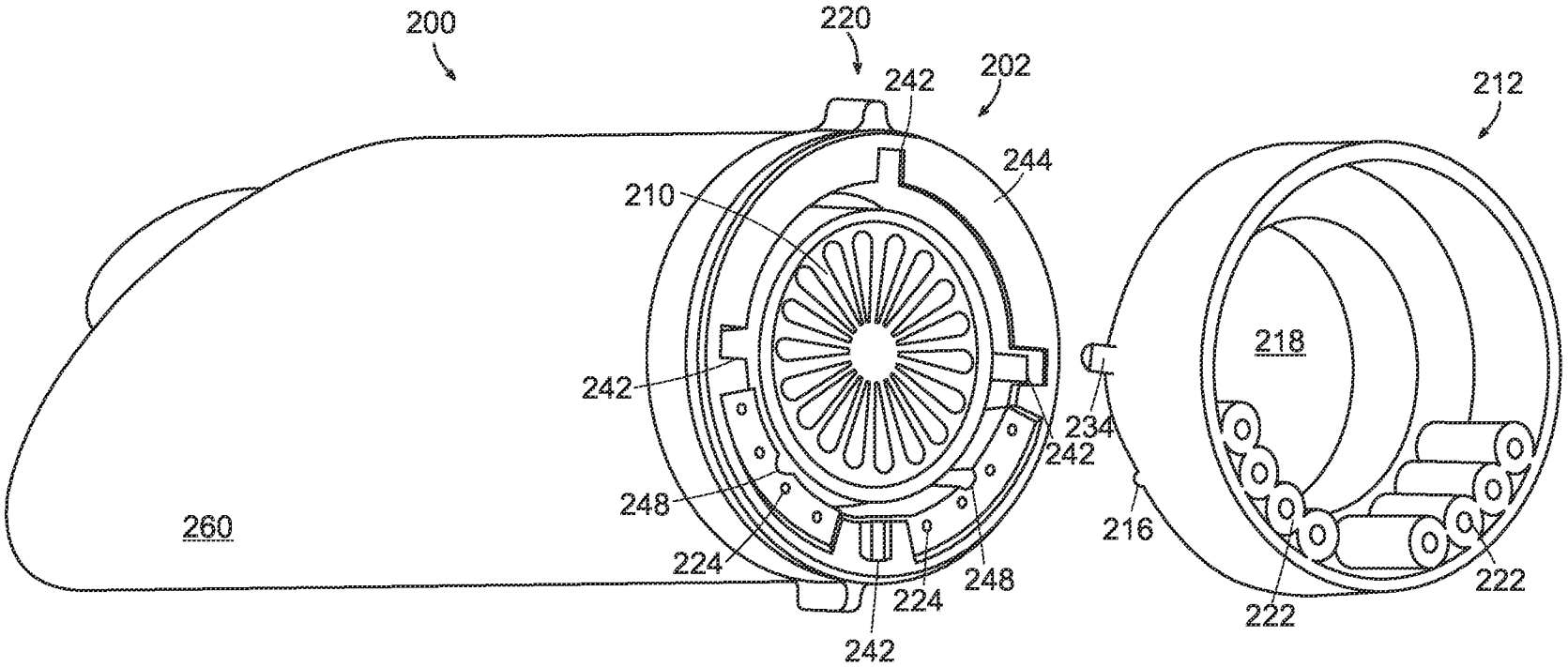
FIG. 7 is an perspective view of an exemplary embodiment of an attachment mating assembly of the hair care appliance of FIG. 6 and an attachment coupling configured for use with the powered attachment of FIG. 6.

The attachment mating assembly 202 is provided at the distal end of the hair care appliance 200 and surrounds an outlet 210 of the hair care appliance 200. As shown in FIG. 7, the attachment mating assembly 202 is in the form of a ring-shaped body having mating features thereon. An attachment coupling 212 provided on an attachment (such as the curling attachment 204 or another attachment) can be coupled to the attachment mating assembly 202. In the illustrated embodiment of FIG. 7, the attachment coupling 212 is likewise in the form of a ring-shaped body having mating features 234 thereon configured to mate with the corresponding mating features on the attachment mating assembly 202. The attachment coupling 212 includes an opening 218 through which, with the attachment that includes the attachment coupling 212 coupled to the hair care appliance 200, air flow exiting the outlet 210 of the hair care appliance 200 enters the attachment.

Figure 8B:
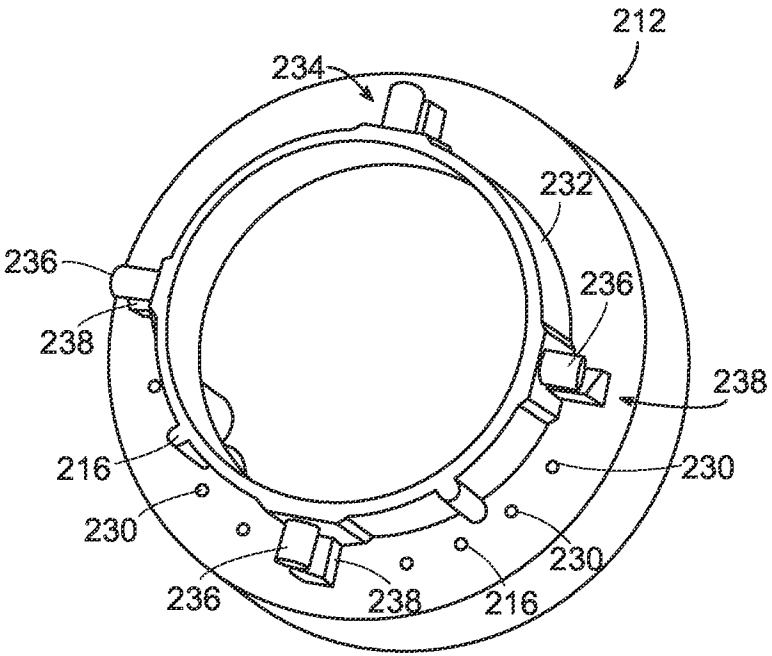
FIG. 8B is a perspective view of a second side of the attachment coupling of FIG. 7.
Figure 9:
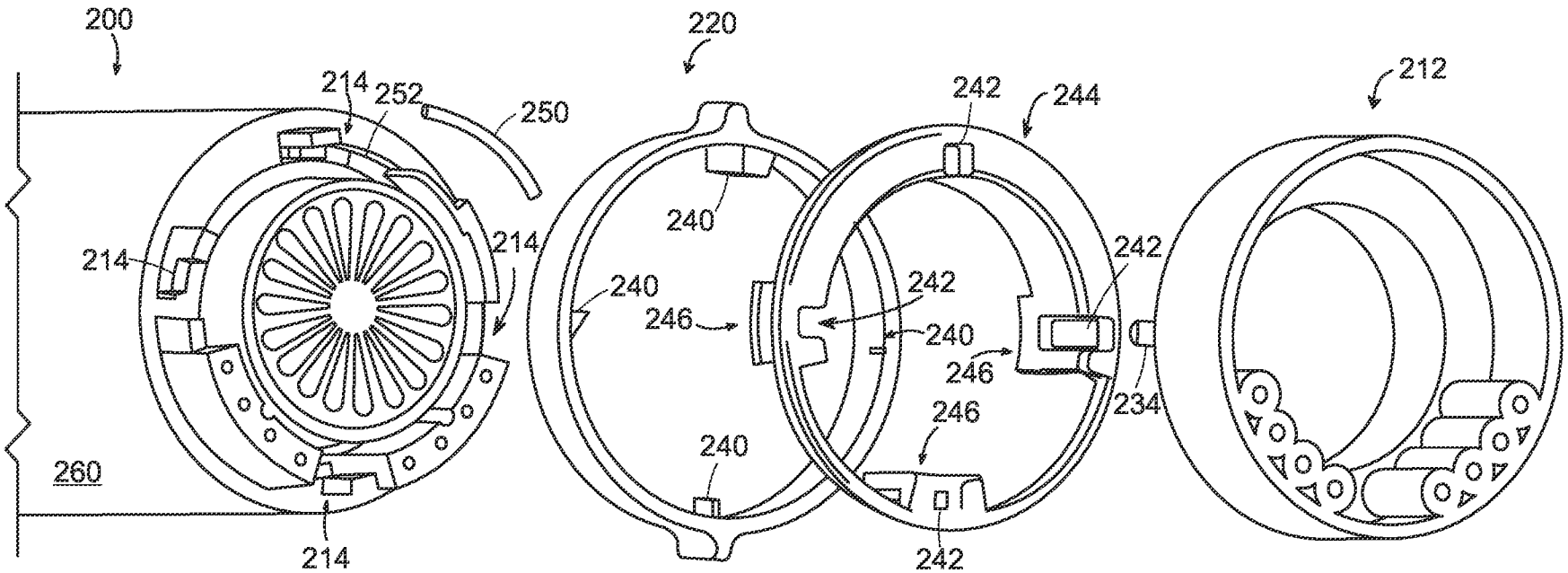
FIG. 9 is an exploded view of the attachment mating assembly and the attachment coupling of FIG. 7.

While various mating features can be utilized to mate the attachment coupling 212 to the attachment mating assembly 202, in the illustrated embodiment the attachment coupling 212 includes a plurality of projections 236, 238 (see FIG. 8B) configured to extend into corresponding slots 214, 242 (see FIGS. 7 and 9) formed in the attachment mating assembly 202. The attachment that includes the attachment coupling 212 is thus configured to be coupled to the attachment mating assembly 202 by aligning the projections 236, 238 with the slots 214, 242 of the attachment mating assembly 202 and applying a linear force along a longitudinal axis of the attachment and the appliance 200. The attachment mating assembly 202 further includes a rotatable release mechanism 220, such as a rotatable ring as shown (see FIG. 9), configured to engage the projections 236, 238 within the slots 214, 242 to prevent removal thereof. The ring 220 is spring-biased to an engaged position. Thus, during insertion of the projections 236, 238 into the slots 214, 242, the projections 216 are configured to cause the ring 220 to rotate out of the way, e.g., to move out of the engaged position, thus allowing the projections 236, 238 to fully extend into the slots 214, 242. Once fully seated in the slots 214, 242, the spring-bias of the release mechanism 220 is configured to cause the rotatable ring to return to the initial, engaged position, thereby engaging the projections 236, 238 within the slots 214, 242 to retain the projections 236, 238 therein, thus retaining the attachment coupling 212 to the attachment mating assembly 202. The release mechanism 220 is configured to secure the attachment coupling 212 to the attachment mating assembly 202 so that the attachment that includes the attachment coupling 212 is securely fixed and immovable relative to the hair care appliance 200 until the release mechanism 220 is actuated, as discussed herein, to allow release of the attachment from the appliance 200. The release mechanism 220 is configured to be rotated by a user to disengage the release mechanism 220 from the attachment coupling 212 to allow removal of the attachment from the hair care appliance 200.

As further shown in FIG. 7, the attachment coupling 212 includes a plurality of electrical connectors 222, such as male pins as shown. The male pins are configured to be received within corresponding female sockets of electrical connectors 224 provided in the attachment mating assembly 202. A variety of non-limiting connector types can be used, such as keyed connectors, locking connectors, pogo pins, crown spring connectors, crimp connectors, or blade connectors. Additionally, the arrangement of the electrical connectors 222, 224 can vary. For example, in some embodiments, the attachment coupling 212 can include female connectors and the attachment mating assembly 202 can include male connectors, or vice versa. The location or arrangement of the electrical connectors 222, 224 on the attachment mating assembly 202 (and the corresponding location on the attachment coupling 212) can also vary. For example, as shown in FIG. 7, two sets of adjacent 4-pin connectors are shown in corresponding locations about circumferences of the attachment mating assembly 202 and the attachment coupling 212. In some embodiments, the sets of electrical connectors 222, 224 may be opposite one another or positioned separately from one another around the circumferences of the attachment mating assembly 202 and the attachment coupling 212. In some embodiments, a set of connectors can include 2, 3, 4, 5, 6, 7, 8, 9, 10, 11, or 12 connectors. The arrangement of the electrical connectors 222, 224 can be configured to provide the appliance 200 with a small diameter body or housing, ease of wire routing, and can reduce airflow obstruction through the appliance 200.

The electrical connectors 222 of the appliance 200 and the electrical connectors 224 of the attachment, with the attachment coupled to the appliance 200, are configured to be communicatively coupled via wiring to electrical components of the appliance 200, e.g., a PCB, a fan assembly, a motor, a user interface, a switch, or other components configured in the appliance 200. The electrical connectors 222, and the electrical connectors 224 when connected thereto, are further configured to communicatively coupled via wiring to electrical components of the attachment, e.g., a heating element, a heating assembly, a sensor, or a user interface configured in the attachment. The electrical connectors 222, 224, when connected, are configured to convey power signals and/or data signals between the appliance 200 and the attachment.

For example, in one embodiment, a first set of the electrical connectors 222, 224 are configured to convey power between the appliance 200 and the attachment coupled thereto, or vice versa. The first set can include first and second power pins, first and second neutral pins, and a local earth or ground pin. A second set of the electrical connectors 222, 224 is configured to convey data between the appliance 200 and the attachment coupled thereto, or vice versa. The second set can include first and second user interface control pins, first and second sensor data pins, and a spare pin.

Figure 8A:
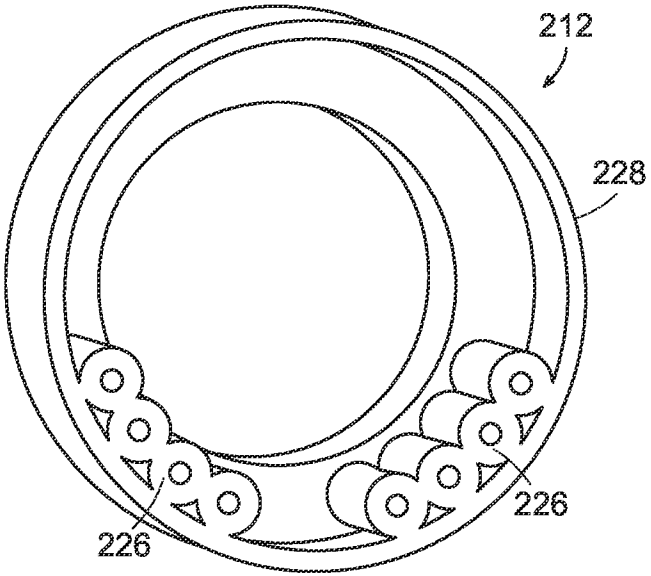
FIG. 8A is a perspective view of a first side of the attachment coupling of FIG. 7.

As indicated above, the attachment coupling 212 can be, as in this illustrated embodiment, include a ring-shaped structure having an opening 218 therein for air flow to pass from the outlet 210 of the appliance 200 into the attachment coupled with the appliance 200. The attachment coupling 212 includes a first, distal side, as shown in FIG. 8A, including housings 226 at which the electrical connectors 222 are configured to receive wires from the electrical components of the attachment that includes the attachment coupling 212. The first side also includes a collar 228 extending distally away from the first side. The collar 228 is configured to secure the attachment coupling 212 to the attachment. The opposite, second, proximal side of the attachment coupling 212, shown in FIG. 8B, includes a plurality of pins 230 that extend proximally from the housings 226 on the first side of the attachment coupling 212 and are configured to be received by receiving portions of the electrical connectors 222 configured in the attachment mating assembly 202 of the appliance 200. The second side also includes a second collar 232 extending proximally away from the second side. The second collar 232 includes engagement features 234 configured to align and secure the attachment coupling 212 within the attachment mating assembly 202. For example, as shown, the second collar 232 includes the protrusions 216 and the engagement features 234. The engagement features 234 include a pair of features configured to engage with the release mechanism 220 of the attachment mating assembly 202. A first element 236 of the pair of engagement features 234 can be, as shown, a protrusion extending radially away along their length from the second collar 232. The first element 236 is configured to be received through the slots 242 of attachment mating assembly's lock ring 244 (see FIGS. 7 and 9) and seated within the slots 214 (see FIG. 9) of the housing of the appliance 200. A second element 238 of the pair of engagement features 234 includes angle-faced protrusions co-located on the second collar 232 with the first engagement features 236 immediately adjacent to the second side. The angled faces of the second elements 238 are configured to be received through the slots 242 (see FIGS. 7 and 9) of the lock ring 244 and to engage corresponding angle-faced protrusions 240 on the release mechanism 220.

As indicated above, the attachment mating assembly 202 of the appliance 200 includes a lock ring 244 configured to secure the release mechanism 220 and the electrical connectors 222 in place at the distal end of the appliance 200. The lock ring 244 includes projecting tabs 246 extending proximally toward the appliance 200 that pass through the release mechanism 220 and engage with the slots 214 provided on the inner surface of appliance body or housing 260. The projecting tabs 246 are configured to secure the lock ring 244 to the appliance 200 and to maintain the release mechanism 220 in an operable position for rotation. The projecting tabs 246 also include the slots 242 into which engagement features 234 on the second collar 232 of the attachment coupling 212 are configured to be received as the attachment is mated with the appliance 200. An additional set of protrusions 216 (see FIG. 8B) on the second collar 232 that are co-located with the pins 230 of the attachment coupling 212 are configured to be received within respective slots 248 formed on the surface of the electrical connectors 224 to provide additional stability when the attachment is secured to the appliance 200.

The attachment mating assembly 202 also includes a compression spring 250 (see FIG. 9) or other force generating element provided in a channel 252 formed within the housing 260 of the appliance 200. The compression spring 250 is configured to be compressed within the channel 252 as a user rotates the release mechanism 220 to detach the attachment coupling 212 (and thus the attachment that includes the attachment coupling 212) from the appliance 200. The spring 250 is configured to engage the protrusion 240 of the release mechanism 220 at a first end of the spring 250 and a terminal end of the channel 252 at a second, opposite end of the spring 250. The compression spring 250 is configured to extend against the terminal end of the channel 252 and exert force against the release mechanism protrusion 240 responsive to a user releasing the release mechanism 220, thereby causing the release mechanism 220 to return or reset to a position ready for receiving an attachment, which can be either the same attachment as just released or a different attachment.

When an attachment is secured to the appliance 200, the second features 238 of the pair of engagement features on the second side of the attachment coupling 212 are configured to engage with the protrusions 240 on the release mechanism 220. For example, the angle-faced portions of the second features 238 are oriented in correspondence with the angled faces on the protrusions 240 of the release mechanism 220. The release mechanism 220 is configured to rotate slightly, by way of movement of the compression spring 250, to enable the corresponding angled faces of the second features 238 of the attachment coupling 212 to engage with the protrusions 240 of the release mechanism 220. The first features 236 of the pair of engagement features on the second side of the attachment coupling 212 are configured to engage with a non-angled face of the release mechanism protrusion 240 to prevent rotation of the attachment within the attachment mating assembly 202. In this way, the release mechanism 220 is configured to securely fix the attachment to the appliance 200 by linearly connecting the attachment coupling 212 to the attachment mating assembly 202.

Figure 10:
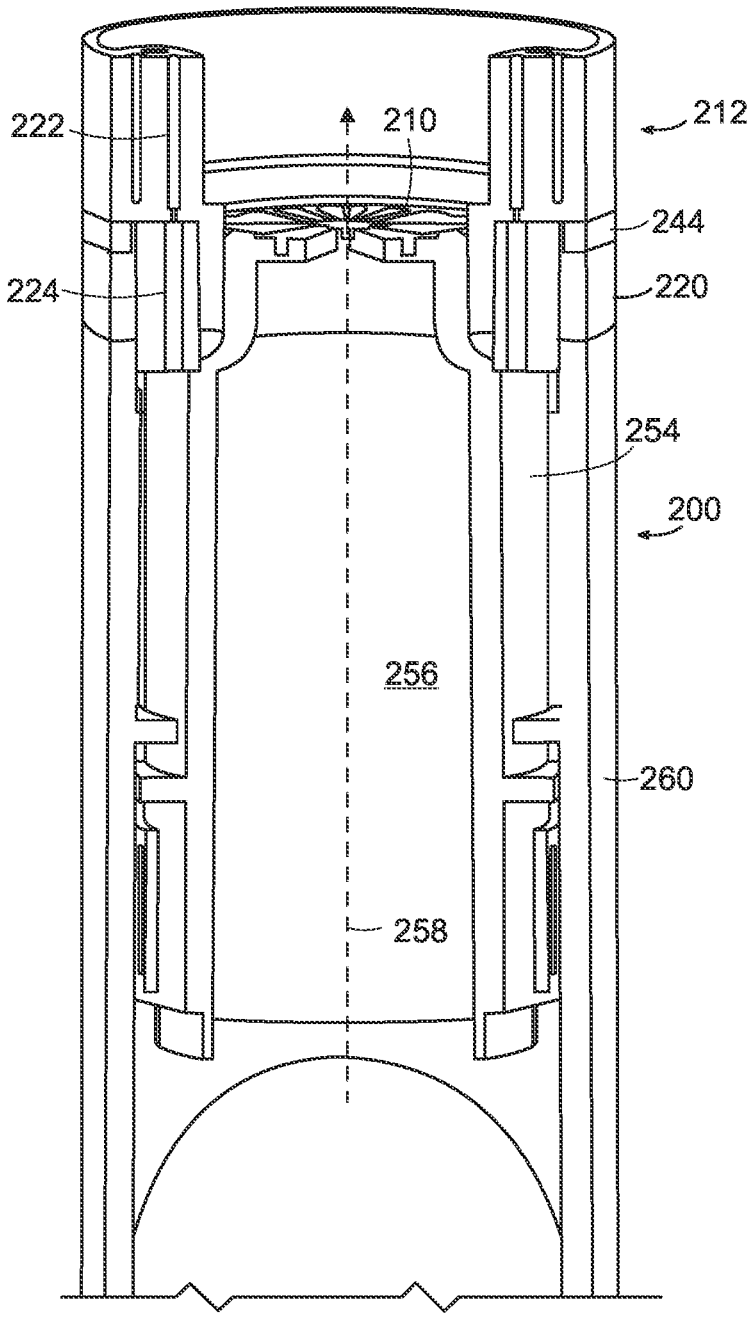
FIG. 10 is a cross-sectional view of the attachment mating assembly of FIG. 7 coupled with the attachment coupling of FIG. 7.

The attachment mating assembly 202 is configured to receive the attachment coupling 212 therein and brings the electrical connectors 224 of the attachment mating assembly 202 into contact with the corresponding electrical connectors 222 of the attachment coupling 212 as shown in the cross-sectional view of FIG. 10. As further shown in FIG. 10, the body 260 of the appliance 200 includes a frame 254 therein. The frame 254 includes a lumen 256 therein extending along a length of the frame 254. A fluid flow path 258 (shown as a dotted line) extends through the lumen 256 of the frame 254.

Figure 11:
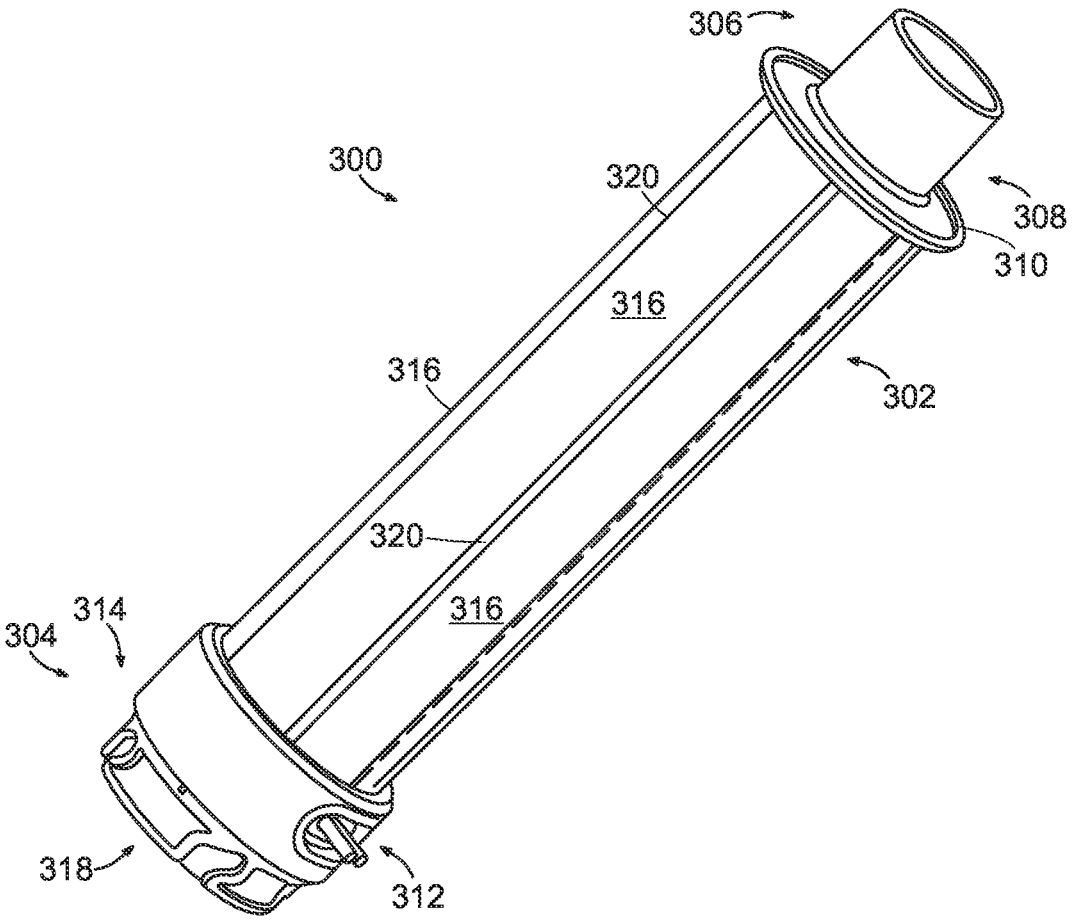
FIG. 11 is a perspective view of an exemplary embodiment of a curling attachment configured for use with the attachment coupling of FIG. 7.
Figure 12:
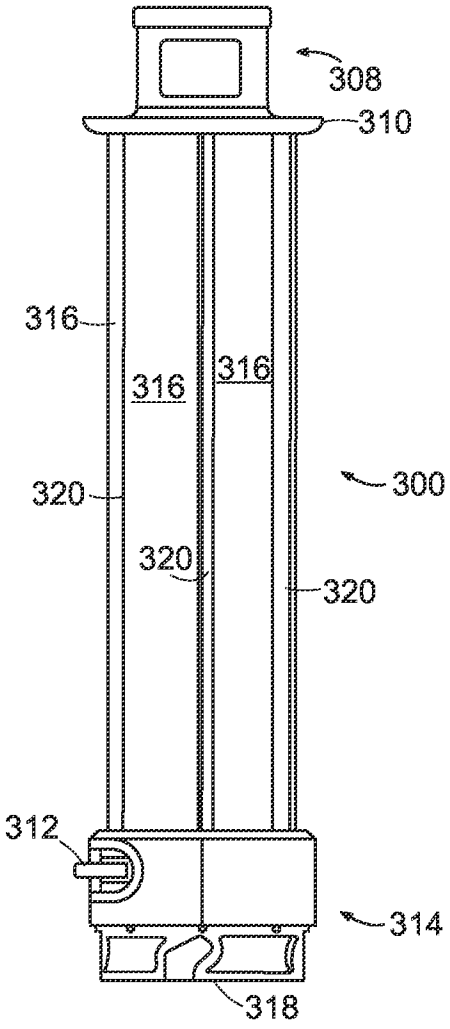
FIG. 12 is side view of the curling attachment of FIG. 11.

One exemplary embodiment of an attachment configured for use with a hair care appliance (e.g., the hair care appliance 100 of FIGS. 1-5, the hair care appliance 200 of FIGS. 6-10, or other hair care appliance) and an attachment mating assembly (e.g., the attachment mating assembly 202 of FIG. 7, or other attachment mating assembly) described herein includes a curling attachment. One exemplary embodiment of a curling attachment is shown in FIG. 6 and is configured and used similar to another exemplary embodiment of a curling attachment 300 is shown in FIG. 11. The curling attachment 300 includes an elongate body 302 extending between an attachment end 304 and a distal end 306. The attachment end 304 is configured to mate or couple with a hair care appliance (e.g., the hair care appliance 100 of FIGS. 1-5, the hair care appliance 200 of FIGS. 6-10, or other hair care appliance) via an attachment coupling 314 (e.g., the attachment coupling 212 of FIGS. 7-10, or other attachment coupling) as described herein. The distal end 306 includes an end cap 308 having a cylindrical or other-shape protrusion extending away from an end plate 310 of the end cap 308 as shown in FIG. 12. The end plate 310 has a diameter that is greater than a diameter of the body 302 to protect a user's fingers from the heated surfaces of the body 302 when grasping the curling attachment 300 at the distal end 306.

As also shown in FIGS. 12-15, the attachment 300 includes wiring 312 configured to mate electrical connectors of the attachment coupling 314 with electrical components of the curling attachment 300, such as LEDs (and/or other types of lights), sensors, haptic feedback mechanisms, etc. The LEDs (and/or other types of lights), sensors, haptic feedback mechanisms, etc. in the attachment 300 are configured to provide user feedback regarding operation of the attachment 300. In some embodiments, the user feedback can be visual, audible, and/or tactile feedback. For example, a haptic feedback mechanism can be configured to generate vibrations which can be sensed by a user with accessibility requirements. In some embodiments, a motor of the hair care appliance to which the attachment 300 is coupled can be configured to generate haptic feedback. In some embodiments, the wiring 312 may be completely enclosed within the curling attachment 300.

The curling attachment 300 includes a plurality of longitudinally arranged plates 316 that are configured to be heated and form a curl in hair when the heated plates 316 are contacted with hair. Air flow is configured to be received from the hair care appliance to which the curling attachment 300 is attached via an inlet 318 of the curling attachment 300 and pass through the body 302 of the curling attachment 300. Air flow is configured to exit the curling attachment 300 via outlets 320 arranged longitudinally along the body 302 in between adjacent plates 316. Air flow exiting tangentially to the surface of the curling attachment 300 is configured to induce a Coanda effect. The Coanda effect allows hair to wrap around the external surface of the curling attachment 300 without a user directly manipulating hair onto the heated curling attachment 300.

Figure 13:
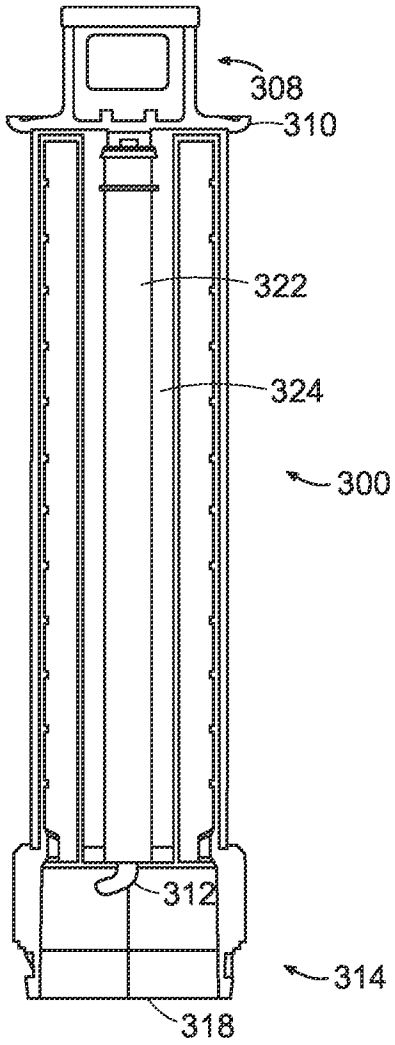
FIG. 13 is a cross-sectional view of the curling attachment of FIG. 11.
Figure 14:
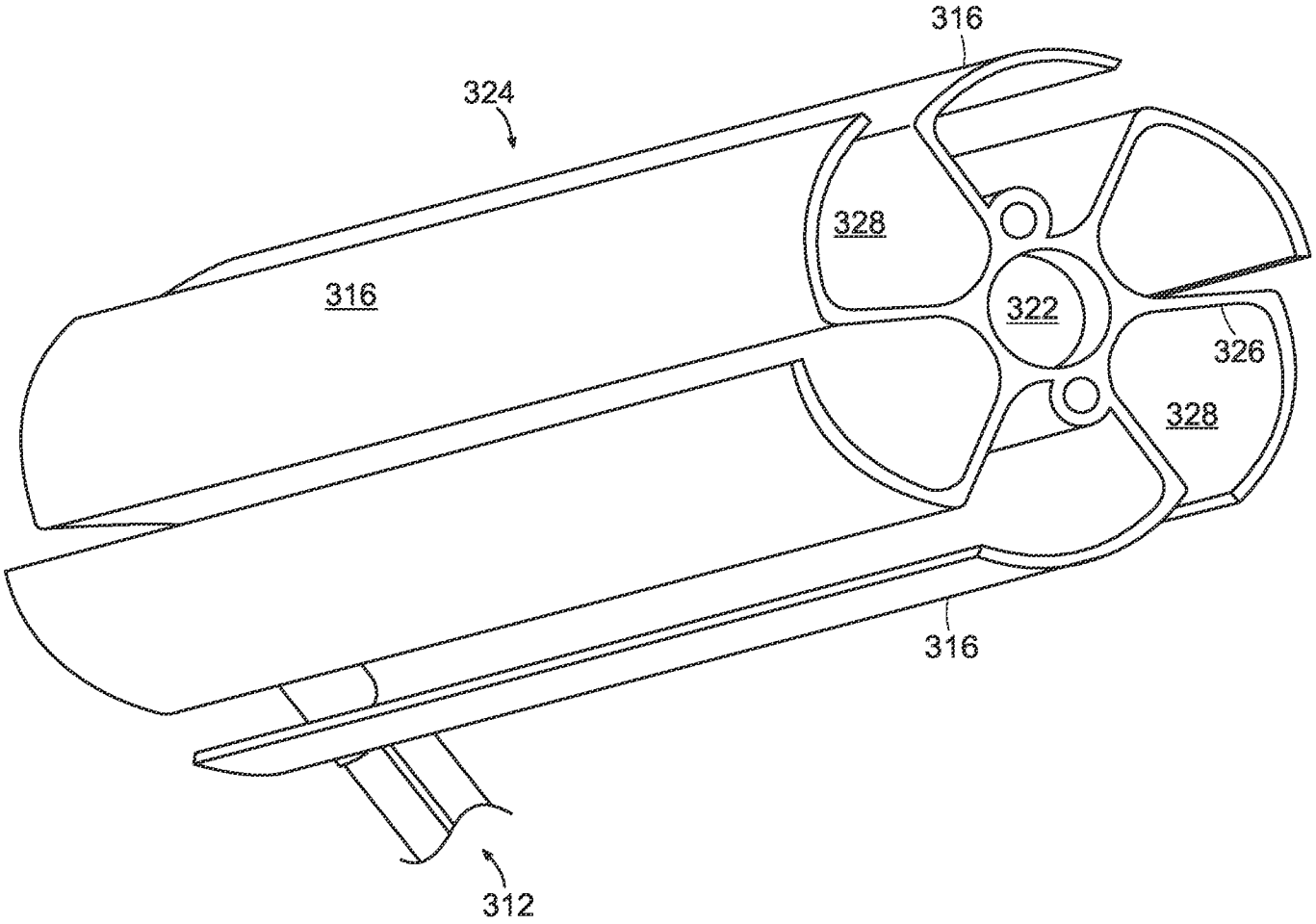
FIG. 14 is a perspective view of a heater frame of the curling attachment of FIG. 11.

The curling attachment 300 also includes a heater 322, as shown in FIGS. 13 and 14. The heater 322 in this illustrated embodiment is in the form of a cylindrical or rod-shaped heater, such as a cartridge heater, arranged within an inner lumen of a heater frame 324. The heater 322 extends along the lumen for the entire length of the body 302 or partially within the lumen at one or more portions of the body 302. The heater frame 324 includes a thermally conductive material, such as metal. In some embodiments the plates 316 can further include a coating on a surface of each plate 316 to aid heat retention and distribution. The end cap 308 is coupled to the heater frame 324. The combination of the airflow and the heater 322 configured within the curling attachment 200 allows a user to obtain the benefits of conductive thermal curling with auto-wrapping hair around a heated appliance.

As shown in FIG. 14, the heater frame 324 includes a plurality of arms 326 that extend radially from a central longitudinal axis of the heater frame 324. As in this illustrated embodiment, a plate 316 can be integrally formed with each arm 326 and can have a curved profile forming a circumference of the curling attachment 300. The number of arms 326 and plates 316 can vary and may not be limited to the number of arms 326 and plates 316 shown in FIG. 14. The heater frame 324 can be formed via extrusion for efficient manufacturing.

Figure 15:
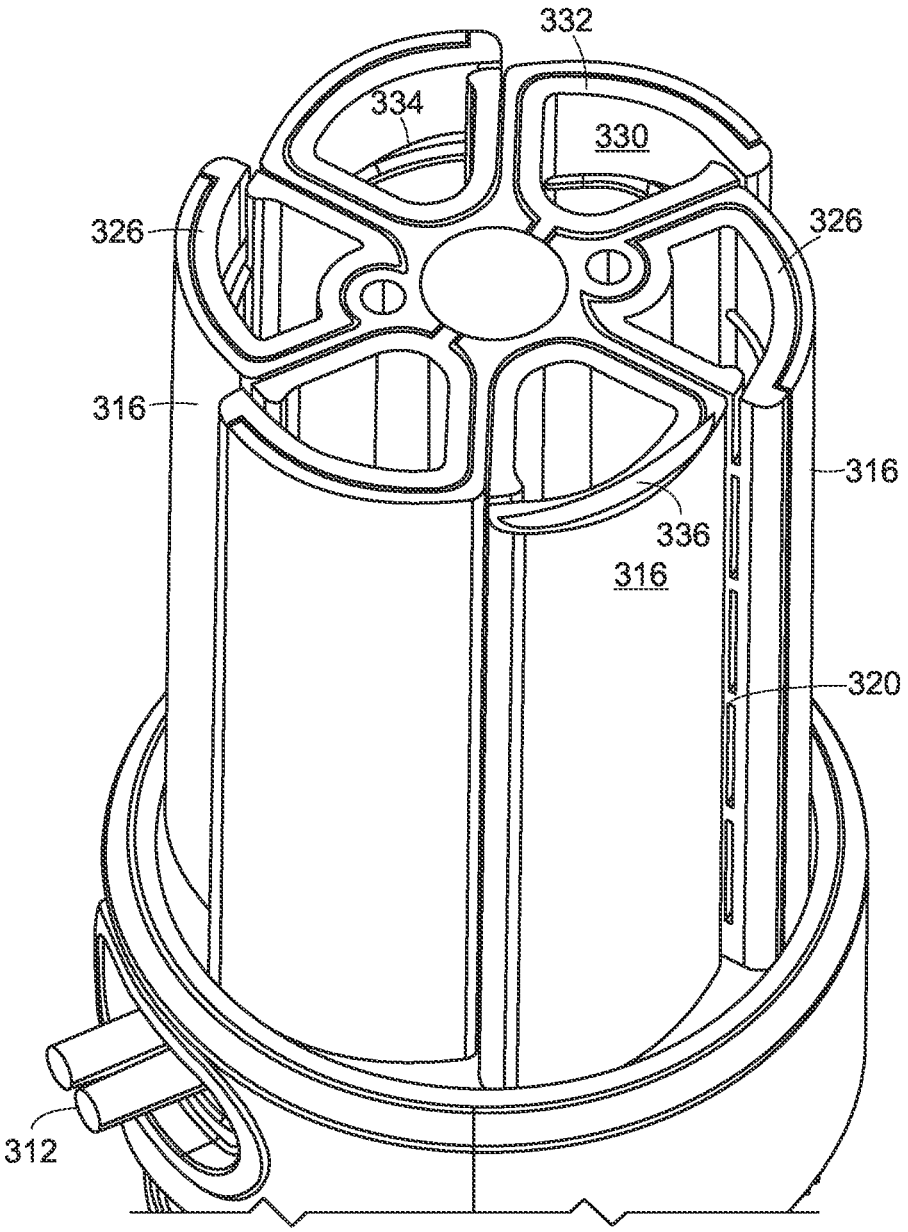
FIG. 15 is a perspective view of a cross-sectional portion of the curling attachment of FIG. 11.

The heater frame 324 also includes a plurality of flow path tunnels 328 formed between adjacent arms 326 of the heater frame 324 and bounded circumferentially by the plates 316. The flow path tunnels 328 extend longitudinally along the length of the body 302 and include a flow path lumen 330 therein. A conduit 332 is arranged within the flow path lumen 330 as shown in FIG. 15. The conduit 332 includes a heat resistant material. The conduit 332 is configured to guide air flow from the inlet 318 to the outlets 320 via vanes 334 formed on an inner surface of the conduit 332. The conduit 332 has longitudinal openings at which the outlets 320 of the curling attachment 300 are formed adjacent to longitudinal edges of respective plates 316 of the heater frame 324. For ease of manufacture, the conduit 332 can be inserted into the flow path tunnels 328 of the heater frame 324.

The curling attachment 300 also includes a moisture sensor 336 configured to detect an amount of moisture in hair of a user using the attachment 300. One moisture sensor 336 is shown in FIG. 15, but in some embodiments, the curling attachment 300 can include more than one moisture sensor 336. As shown in this illustrated embodiment of FIG. 15, the moisture sensor 336 can be positioned between the conduit 332 and the plate 316. In some embodiments, the moisture sensor 336 can extend the entire length of the body 302 or partially within the body 302. In some embodiments, the moisture sensor 336 can include a capacitive moisture sensor. The moisture sensor 336 is configured to be communicatively coupled, via the attachment coupling 314, to other electrical components of the hair care appliance to which the curling attachment 300 is attached. Sensed data obtained by the moisture sensor 336 is configured to be provided to a microprocessor or controller of the hair care appliance to which the curling attachment 300 is attached and is configured to be used by the microprocessor or controller of the hair care appliance to control operation of the hair care appliance. For example, in some embodiments, the hair care appliance can be configured to perform predetermined heating and/or drying (e.g., air flow) operations based on the amount of moisture determined from the sensor data obtained via the moisture sensor 336.

Figure 16:
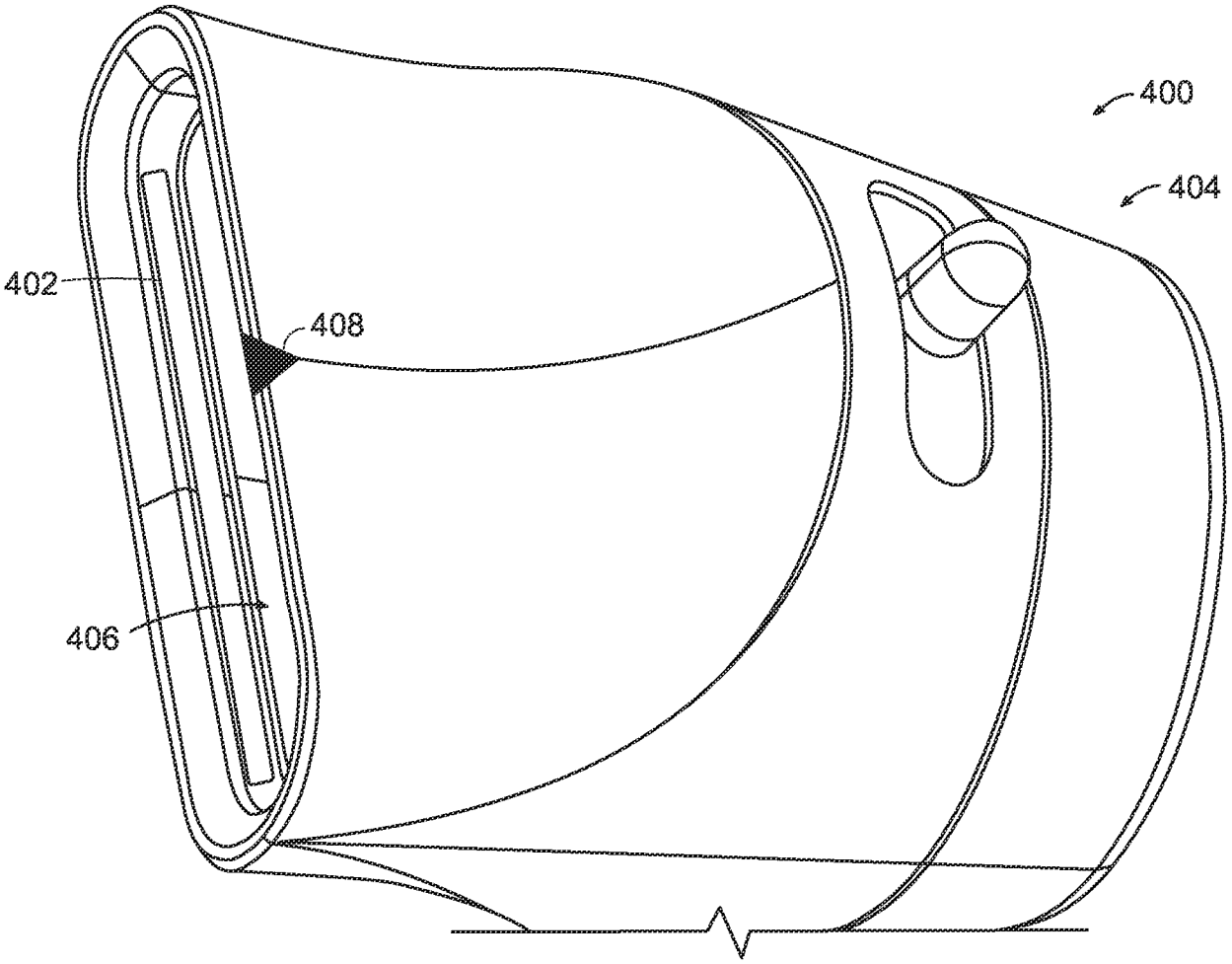
FIG. 16 is a perspective view of an exemplary embodiment of a concentrator attachment configured for use with the attachment coupling of FIG. 7.

Another exemplary embodiment of an attachment configured for use with a hair care appliance (e.g., the hair care appliance 100 of FIGS. 1-5, the hair care appliance 200 of FIGS. 6-10, or other hair care appliance) and an attachment mating assembly (e.g., the attachment mating assembly 202 of FIG. 7, or other attachment mating assembly) described herein includes a concentrator attachment. One exemplary embodiment of a concentrator attachment 400 is shown in FIG. 16 and includes a heating element 402. The heating element 402 is configured to be communicatively coupled to electrical components of the hair care appliance to which the concentrator attachment 400 is attached via electrical connectors of the concentrator attachment's attachment coupling 404 (e.g., the attachment coupling 212 of FIGS. 7-10, or other attachment coupling) described herein. In this way, the heating element 402 is configured to provide additional heat to air flow output at an outlet 406 of the concentrator attachment 400 and in close proximity to the hair for improved styling effects.

In some embodiments, an attachment can include an ionizer therein. The ionizer can be positioned in the attachment to maximize the amount of ions received by the hair. The ionizer is configured to be communicatively coupled to electrical components of the hair care appliance to which the attachment is attached via electrical connectors of the attachment's attachment coupling described herein. As shown in FIG. 16, the illustrated embodiment of the concentrator attachment 400 includes an ionizer 408 positioned within the outlet 406.

Figure 17:
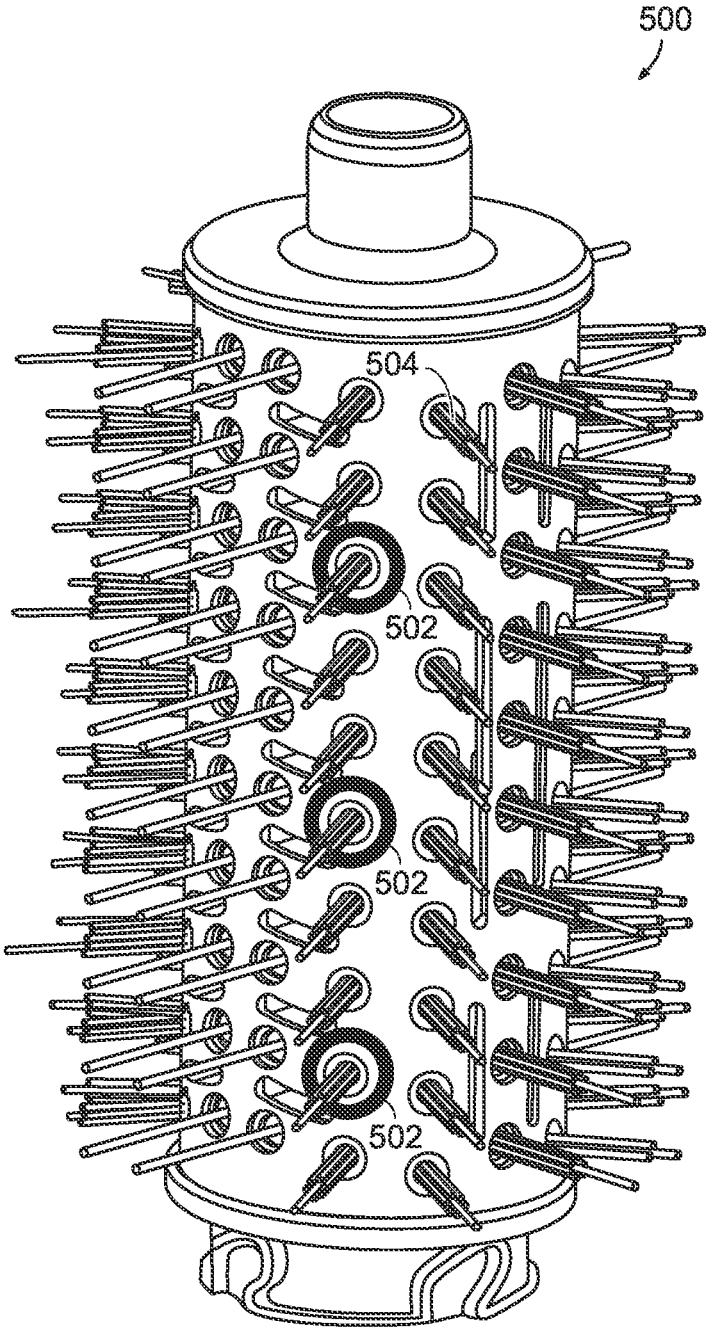
FIG. 17 is a perspective view of an exemplary embodiment of a brush attachment configured for use with the attachment coupling of FIG. 7.

In some embodiments, an attachment can include one or more torque sensors therein. The torque sensors can be configured with respect to bristles, such as bristles 504 of a brush attachment 500, as shown in FIG. 17. The brush attachment 500 is another exemplary embodiment of an attachment configured for use with a hair care appliance (e.g., the hair care appliance 100 of FIGS. 1-5, the hair care appliance 200 of FIGS. 6-10, or other hair care appliance) and an attachment mating assembly (e.g., the attachment mating assembly 202 of FIG. 7, or other attachment mating assembly) described herein. The torque sensors (e.g., torque sensors 502 of the brush attachment 500, or other torque sensors of another attachment) are configured to be coupled to electrical components of a hair care appliance to which an attachment including the torque sensors is attached via electrical connectors of the attachment's attachment coupling described herein. The torque sensors are configured to generate sensor data associated with an amount of torque applied to at least one bristle or group of bristles as a user uses the attachment, e.g., brushes hair using the brush attachment 500. The amount of torque is associated with a condition of the hair and an operating parameter of the hair care appliance can thus be determined. For example, the torque sensor data can be used to determine whether the user has dry or tangled hair based on elevated torque values indicating more force is required to brush the dry or tangled hair. Lower torque values are associated with wet, oily, or fine hair indicating less force is required to brush the hair. The hair care appliance to which the attachment is attached as described herein can be configured to adjust one or more of a heating temperature or an air flow setting based on the sensed torque data.

Styling hair can require specific skills and hair treatments to achieve a desired style. Some users may lack particular skill necessary to utilize a hair care appliance to achieve their desired style. Thus, it can be desirable for a hair care appliance and/or attachment to provide user feedback and/or automated styling assistance. For example, Coanda curling is a particular method of curling hair that can be difficult to master. A user is required to use a curling attachment, e.g., the curling attachment 204 of FIG. 6, the curling attachment 300 of FIG. 11, or other curling attachment, that automatically wraps hair around a curler by creating an airflow that pulls hair into place around the heated plates of the curling attachment. After the hair is wrapped around a body of a curling attachment, the user then heats the hair for a set period of time, before cooling the hair for a set period of time to implement the curl in the hair. A user may not know where to contact the hair on the attachment, have difficulty performing the styling for the required time periods or lose track of time, or have difficulty performing the styling while looking at their reflection in a mirror.

The hair care appliance and powered attachments described herein can remedy these problems by acquiring data about the user's hair and providing feedback to the user as they style their hair. The feedback can ensure best practices associated with a particular styling technique, are communicated to the user. The feedback can be provided via visual, audio, and/or haptic feedback mechanisms provided in the powered attachments described herein. The electrical coupling enabled between attachments and the hair care appliance herein can provide a robust array of feedback and operation modes to improve a user's experience and produce improved, long-lasting styling effects.

Figure 18:
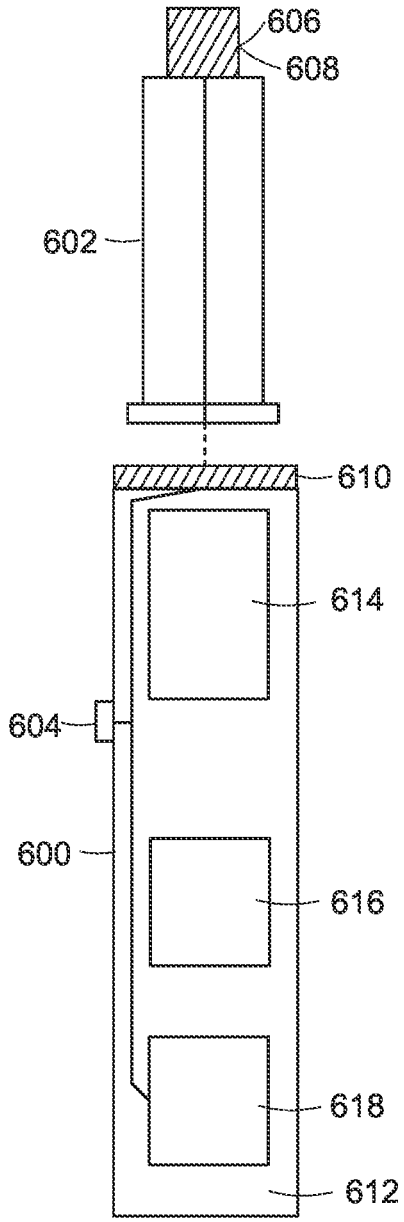
FIG. 18 is a diagram illustrating a power and data architecture of the hair care appliance of FIG. 6 used in a manual mode of operation.

For example, in one embodiment shown in FIG. 18, a user can operate a hair care appliance 600 (e.g., the hair care appliance 100 of FIGS. 1-5, the hair care appliance 200 of FIGS. 6-10, or other hair care appliance) and a powered curling attachment 602 (e.g., the curling attachment 204 of FIG. 6, the curling attachment 300 of FIG. 11, or other curling attachment) as described herein in a manual mode of operation. As shown in FIG. 18, a user can activate a manual actuator 604 (shown as a switch in this illustrated embodiment) of the hair care appliance 600, with the appliance 600 attached to the powered curling attachment 602, to initiate a timed program for curling hair. The switch 604 is configured to be communicatively coupled via electrical connectors of the curling attachment's attachment coupling to the curling attachment 602, which can include user interfaces such as an LED 606 and an audio output 608 as shown in this illustrated embodiment. The switch 604 is further configured to be communicatively coupled to electrical components of the hair care appliance 600, which can include user interfaces (e.g., an LED 610 and an audio output 612) as shown in this illustrated embodiment, heaters 614, a motor 616, a microprocessor and/or controller 618 coupled to a memory storing non-transitory computer-executable instructions associated with one or more operating parameters and/or modes of operation of the hair care appliance 600 (e.g., "software control").

Activating the manual switch 604 is configured turn on the hair care appliance 600, and a user can wrap their hair around the curling attachment 602 attached to the hair care appliance 600. A user can then manually actuate a timing actuator, e.g., press a timing starter of the hair appliance's user interface, to initiate a sequence of operational modes necessary to perform the curling. The software control is configured to generate control signals provided to various electrical components in the attachment 602 and the hair care appliance 600, such as the user interfaces 606, 608, 610, 612, heaters 614, or motor 616. The control signals are configured to initiate pre-determined timing cycles necessary to curl the hair. The control signals are further configured to cause one or more of the user interfaces 606, 608, 610, 612 to provide feedback to the user indicating a point at which the user should manually switch to the next stage of curling.

Figure 19:
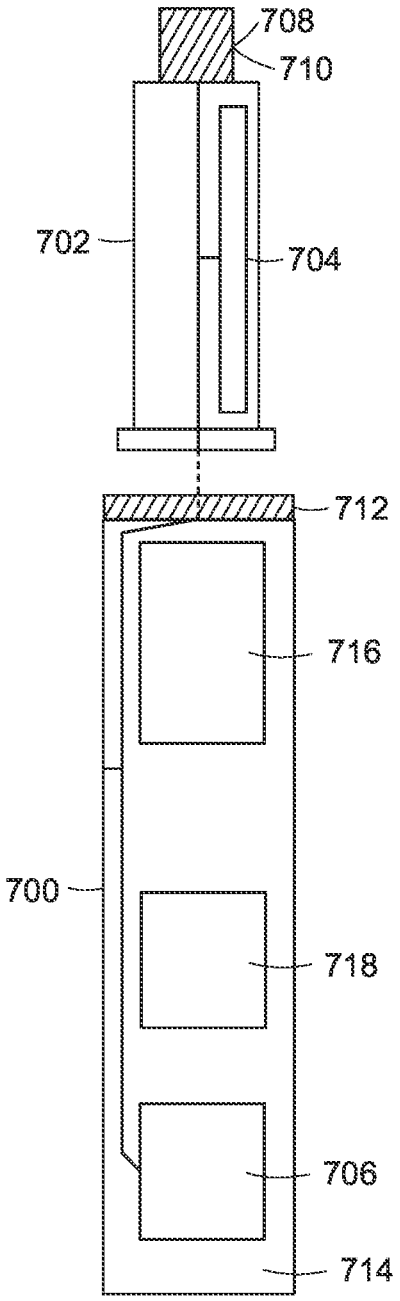
FIG. 19 is a diagram illustrating a power and data architecture of the hair care appliance of FIG. 6 used in a semi-automated mode of operation.

In some embodiments, a curling attachment is configured to provide sensor data from a moisture sensor of the curling attachment to control operation of the attachment and a hair care appliance to which the attachment is attached via software control of the hair care appliance. For example, as shown in FIG. 19, a user can turn on a hair care appliance 700 (e.g., the hair care appliance 100 of FIGS. 1-5, the hair care appliance 200 of FIGS. 6-10, or other hair care appliance) and wrap their hair around a curling attachment 702 attached to the hair care appliance 700. Moisture data determined from a moisture sensor 704 of the curling attachment 702 is configured to be used by software control 706 of the appliance 700 to determine requirements for styling the moist hair. Based on detecting the moist hair wrapped around the curling attachment 702, the software control 706 is configured to initiate a timing program cycling through pre-determined timing cycles. The software control 706 is configured to generate control signals provided to various electrical components in the attachment 702 and the hair care appliance 700, such as the user interfaces (e.g., an LED 708 of the attachment 702, an audio output 710 of the attachment 702, an LED 712 of the appliance 700, an audio output 714 of the appliance 700, etc.), sensors (e.g., moisture sensor 704, etc.), heaters 716, or motor 718. The control signals are configured to initiate pre-determined timing cycles necessary to curl the hair based on the moisture data obtained via the moisture sensor 704. The control signals are further configured to cause one or more of the hair care appliance's and/or attachment's user interfaces to provide feedback to the user indicating a point at which the user should manually switch to the next stage of curling.

Figure 20:
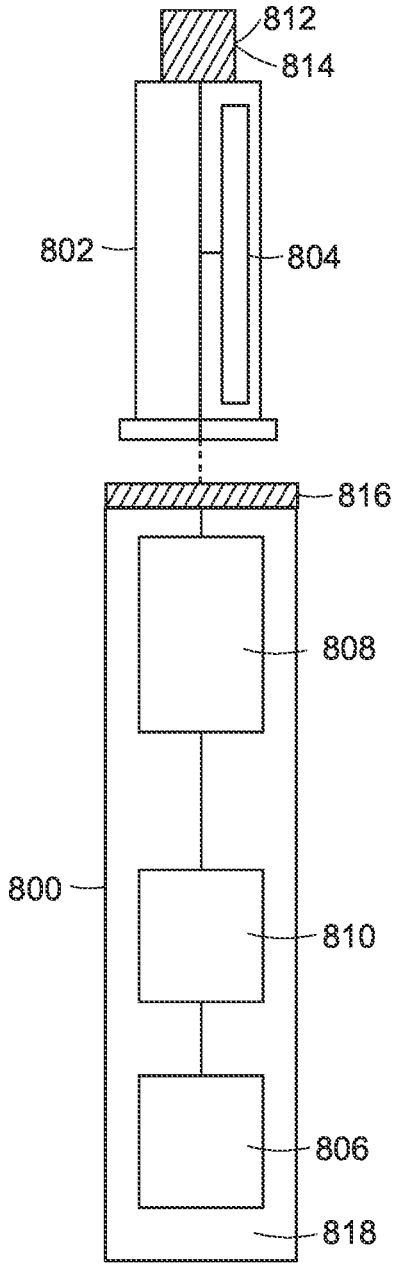
FIG. 20 is a diagram illustrating a power and data architecture of the hair care appliance of FIG. 6 used in a fully-automated mode of operation.

In some embodiments, a hair care appliance (e.g., the hair care appliance 100 of FIGS. 1-5, the hair care appliance 200 of FIGS. 6-10, or other hair care appliance) and powered attachments (e.g., the attachment 204 of FIG. 6, the attachment 300 of FIG. 11, the attachment 400 of FIG. 16, the attachment 500 of FIG. 17, the attachment 602 of FIG. 18, the attachment 702 of FIG. 19, or other attachment) attachable to the appliance are configured to provide fully automated monitoring and control of operational modes of the hair care appliance and/or attachments. For example, as shown in one embodiment in FIG. 20, a user can turn on a hair care appliance 800 (e.g., the hair care appliance 100 of FIGS. 1-5, the hair care appliance 200 of FIGS. 6-10, or other hair care appliance) and wrap their hair around a curling attachment 802 releasably attached to the appliance 800. Moisture data determined from a moisture sensor 804 of the curling attachment 802 is configured to be used (e.g., by software control 806 of the appliance 800) to determine requirements for styling the moist hair. Based on detecting the moist hair wrapped around the curling attachment 802, the software control 806 is configured to initiate a gradually progressive heating program. When the moisture data indicates a predetermined level of moisture, the software control 806 is configured to generate control signals to cause a heater 808 and a motor 810 of the hair care appliance 800 to generate a short blast of hotter air for a predetermined period. Continuing to sense the moist hair, the software control 806 is configured to cause the heater 808 and the motor 810 to generate cool air for a subsequent predetermined period of time. Responsive to sensing the appropriate moisture level and completion of previous predetermined periods of treatment, the software control 806 is configured to cause the hair care appliance 800 to shut off. FIG. 20 also shows an LED 812 of the attachment 802, an audio output 814 of the attachment 802, an LED 816 of the appliance 800, and an audio output 818 of the appliance 800 configured to provide information to the user, as discussed herein.

Figure 21:
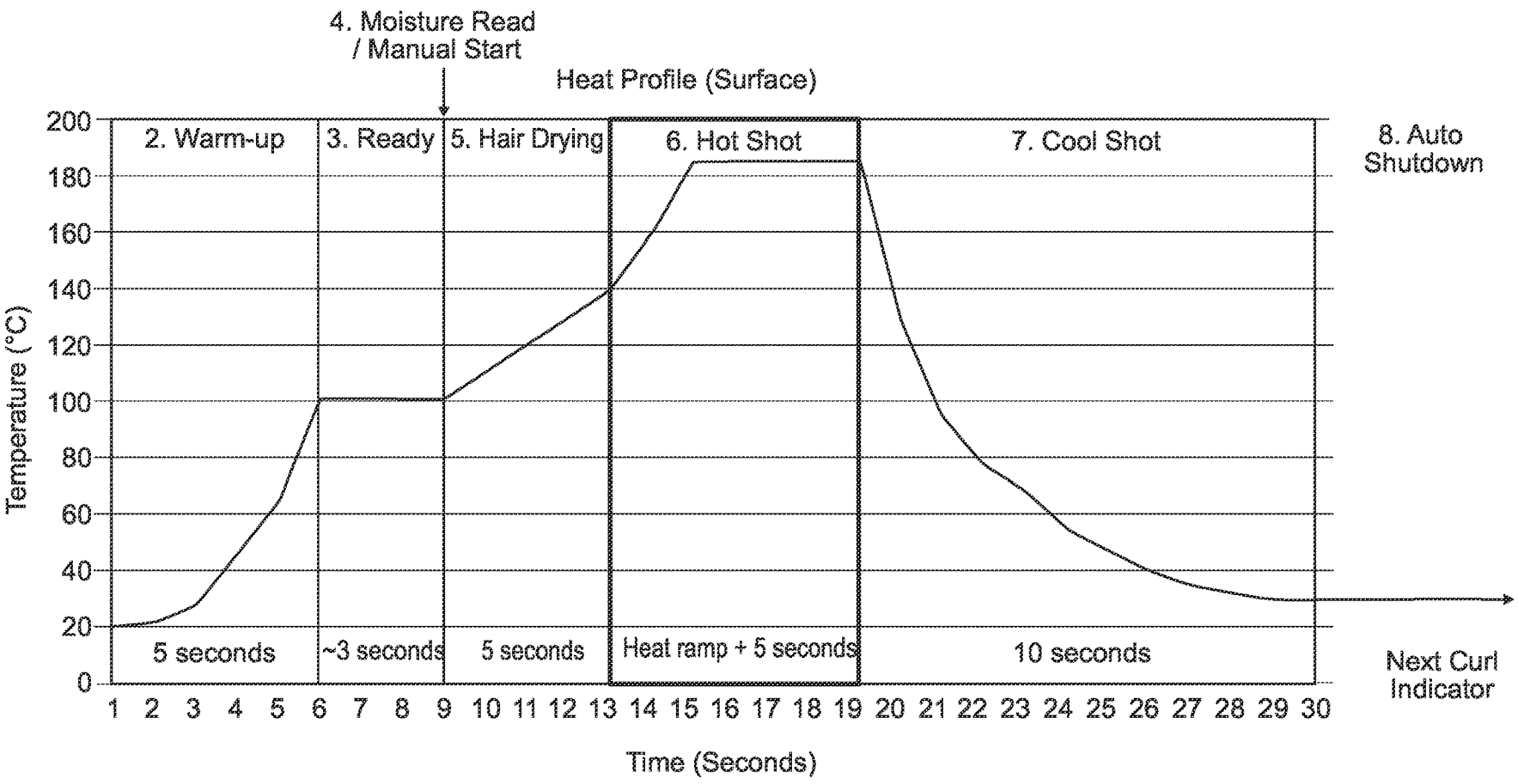
FIG. 21 is a plot illustrating an exemplary embodiment of a sequence of predetermined cycles of operation performed by the hair care appliance of FIG. 6.
Figure 22:
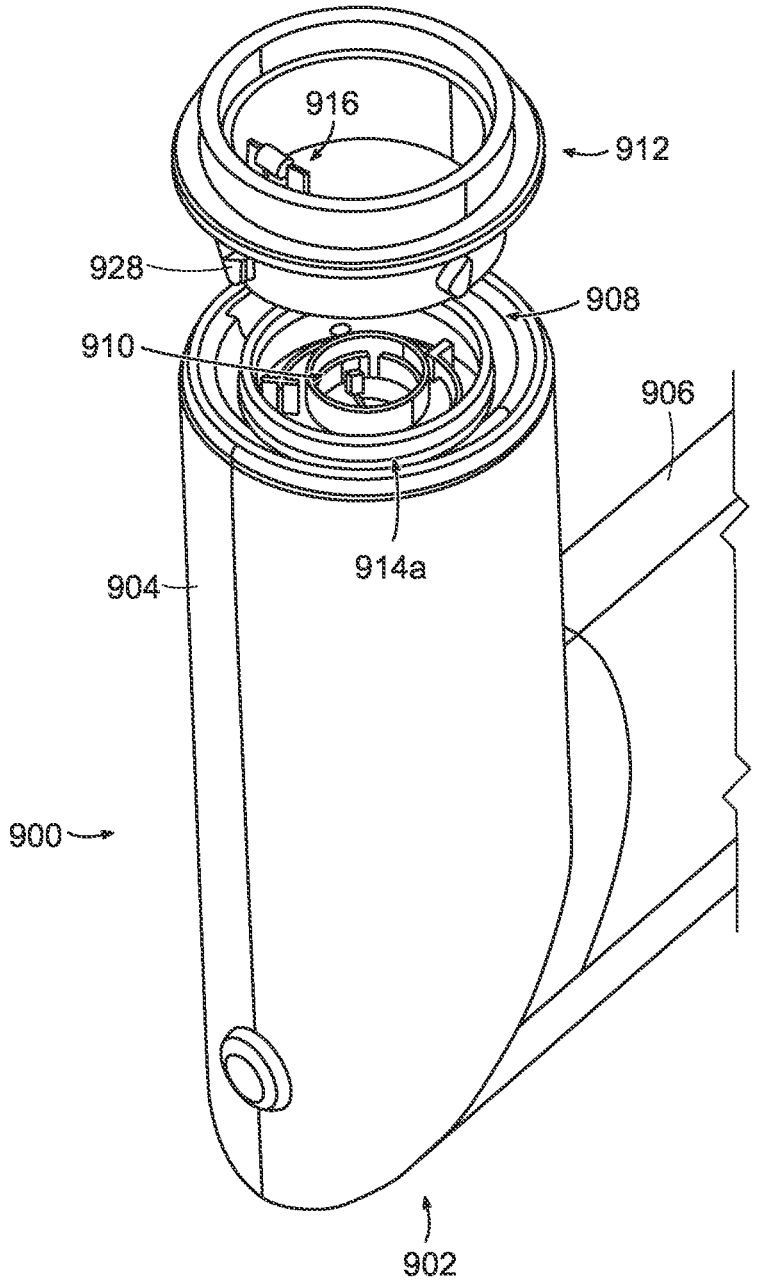
FIG. 22 is a perspective view of another exemplary embodiment of a distal portion of a hair care appliance and one exemplary embodiment of an attachment coupling configured to couple to the hair care appliance.
Figure 23:
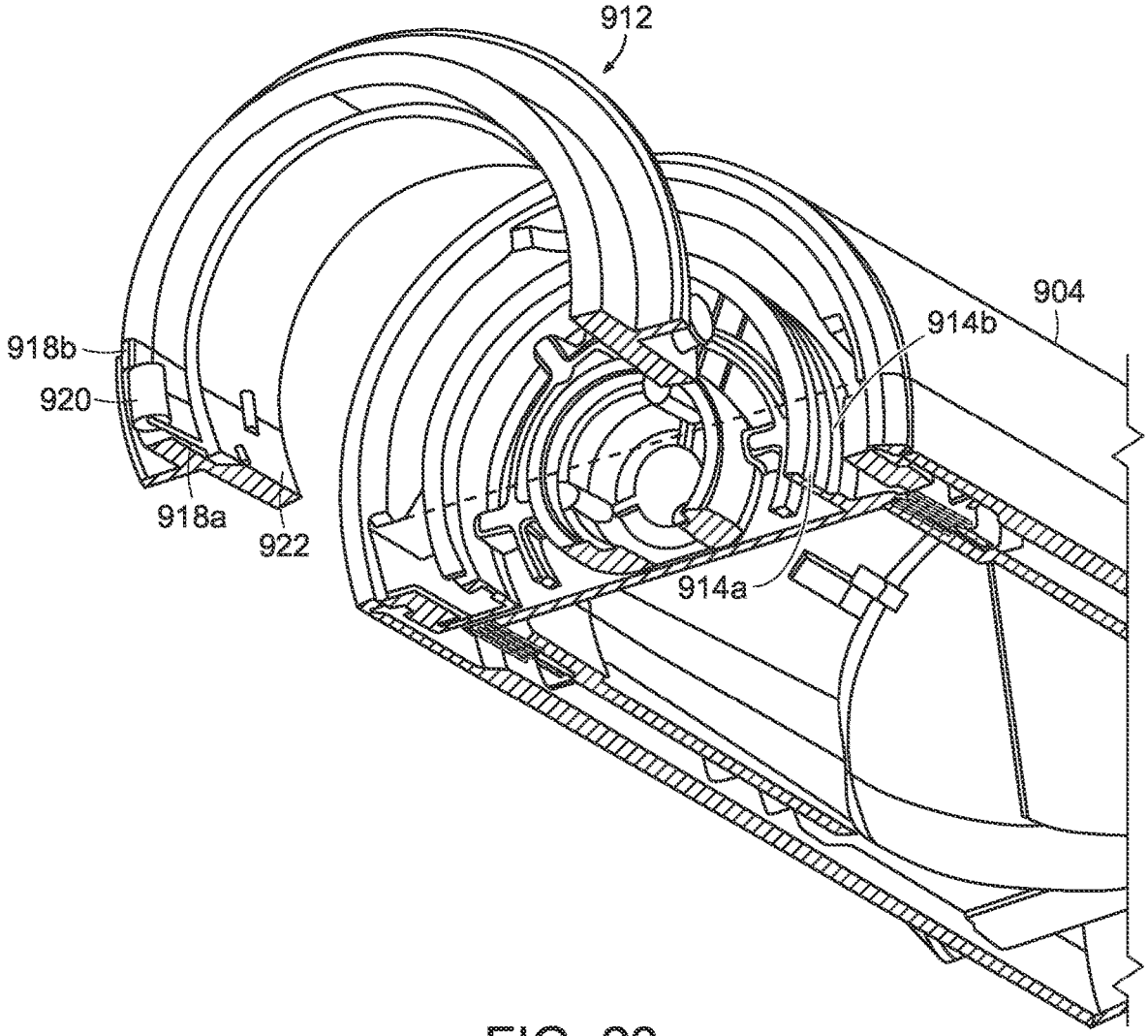
FIG. 23 is a cross-sectional perspective view of the hair care appliance and attachment coupling of FIG. 22.
Figure 24:
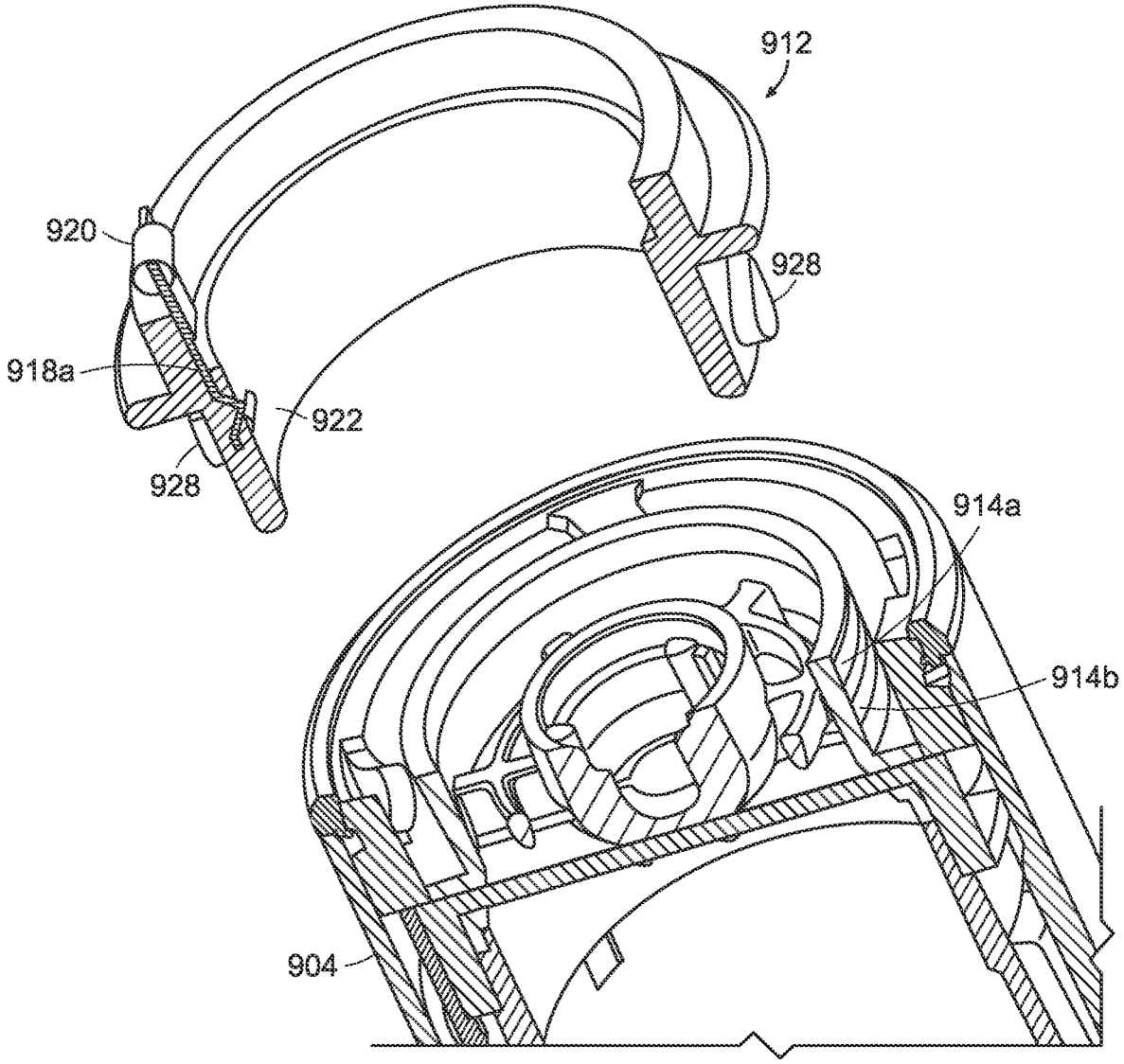
FIG. 24 is another cross-sectional perspective view of the hair care appliance and attachment coupling of FIG. 22.

In some embodiments, a hair care appliance (e.g., the hair care appliance 100 of FIGS. 1-5, the hair care appliance 200 of FIGS. 6-10, or other hair care appliance) and powered attachments (e.g., the attachment 204 of FIG. 6, the attachment 300 of FIG. 11, the attachment 400 of FIG. 16, the attachment 500 of FIG. 17, the attachment 602 of FIG. 18, the attachment 702 of FIG. 19, or other attachment) described herein is configured to perform pre-determined timing cycles associated a variety of styling methods and/or attachment usage. For example, as shown in FIG. 21, one embodiment of a plot of temperature settings and corresponding timing is provided that can be executed by software control configured in a hair care appliance (e.g., the hair care appliance 100 of FIGS. 1-5, the hair care appliance 200 of FIGS. 6-10, or other hair care appliance) in regard to curling hair via a curling attachment (e.g., the curling attachment 204 of FIG. 6, the curling attachment 300 of FIG. 11, the curling attachment 602 of FIG. 18, the curling attachment 702 of FIG. 19, or other curling attachment). An initial stage 1 can be assumed to correspond to the hair care appliance being shut off. Responsive to a user activating a switch of the hair care appliance, stage 2 "Warm-up" starts and last for about 5 seconds. During stage 2, the temperature of the heating element in the frame of the attachment, which is attached to the hair care appliance, initiates heating to cause heated plates of the attachment to heat to about 100° C. A first feedback indication associated with stage 2 can be provided to the user via a user interface of the attachment and/or the hair care appliance. In some embodiments, the first feedback indication includes a first color (e.g., of a light, etc.), a first sound, or the like.

Following stage 2, the hair care appliance enters stage 3 associated with a "Ready" stage in which the heated plates of the attachment are about 100° C. A second feedback indication can be provided to the user via a user interface of the attachment and/or the hair care appliance. In some embodiments, the second feedback indication can include a second color (e.g., of a light, etc.), a second sound, or the like that is different than the first feedback indication.

Responsive to manual activation or sensed moisture data obtained from hair wrapped around the attachment by a moisture sensor of the attachment at point 4, stage 5 commences for drying hair. During the "hair drying" stage 5, the heater of the attachment causes the heated plates of the attachment to heat to about 140° C. for a period of about 5 seconds to dry the moist hair. Also during this stage, the motor is activated to generate heated air flow via the heating element of the hair care appliance. The generated heated air flow is provided through the outlets of the attachment for drying the hair. A third feedback indication can be provided to the user via a user interface of the attachment and/or the hair care appliance. In some embodiments, the third feedback indication can include a third color (e.g., of a light, etc.), a third sound, or the like that is different than the first feedback indication and the second feedback indication.

Following stage 5, the hair care appliance enters stage 6, associated with provision of a "Hot Shot" volume of heated air for about 5-10 seconds. The heater of the attachment causes the heated plates to heat from about 140° ° C. to about 185° C., and the motor is activated to increase the velocity of the air heated via a heating element of the hair care appliance. A fourth feedback indication can be provided to the user via a user interface of the attachment and/or the hair care appliance. In some embodiments, the fourth feedback indication can include a fourth color (e.g., of a light, etc.), a fourth sound, or the like that is different than the first feedback indication, the second feedback indication, and the third feedback indication.

After completion of stage 6, a "Cool Shot" stage 7 is started. During stage 7, a volume of lower temperature air is provided for a period of about 10 seconds to set the curl. During this stage, the heater of the attachment is powered off so that the temperature of the heated plates drops from about 185° C. to about 30° C. In addition, the motor is activated to provide a volume of air at a reduced or ambient temperature via the heating element of the hair care appliance. A fifth feedback indication can be provided to the user via a user interface of the attachment and/or the hair care appliance. In some embodiments, the fifth feedback indication can include a fifth color (e.g., of a light, etc.), a fifth sound, or the like that is different than the first feedback indication, the second feedback indication, the third feedback indication, and the fourth feedback indication.

Following stage 7, the hair care appliance is configured to automatically shut down or otherwise enter a stand-by mode awaiting a next usage or input from a user as shown in stage 8 "Auto Shutdown". A sixth feedback indication can be provided to the user via a user interface of the attachment and/or the hair care appliance. In some embodiments, the sixth feedback indication can include a sixth color (e.g., of a light, etc.), a sixth sound, or the like that is different than the first feedback indication, the second feedback indication, the third feedback indication, the fourth feedback indication, and the fifth feedback indication. One of skill in the art will appreciate that the times and temperatures shown in FIG. 21 are exemplary and the software controls can be configured to implement a variety of temperature and air flow settings for any time periods in various sequences without limit. Thus, a variety of specific styling methods can be performed using the hair care appliance and the powered attachments described herein, which can improve the overall user experience of the appliance and create longer-lasting styling results.

In some embodiments, a hair care appliance (e.g., the hair care appliance 100 of FIGS. 1-5, the hair care appliance 200 of FIGS. 6-10, the hair care appliance 700 of FIG. 19, the hair care appliance 800 of FIG. 20, or other hair care appliance) is configured to identify an attachment (e.g., the attachment 204 of FIG. 6, the attachment 300 of FIG. 11, the attachment 400 of FIG. 16, the attachment 500 of FIG. 17, the attachment 602 of FIG. 18, the attachment 702 of FIG. 19, or other attachment) that is releasably coupled to the hair care appliance. The identification of the attachment is configured to allow the hair care appliance to automatically set at least one setting (e.g., timing, temperature, fan speed, etc.) of the hair care appliance for optimal results with the particular attachment that is currently coupled to the hair care appliance. In an exemplary embodiment, the identification occurs automatically in response to the attachment being coupled with the hair care appliance. The hair care appliance's settings can thus be automatically set in response to the attachment being attached to the hair care appliance such that when a user begins use of the attachment with hair, the hair care appliance will perform optimally in accordance with setting(s) customized for that particular attachment.

In general, a memory of the hair care appliance is configured to store a plurality of sets of predetermined settings therein. Each of the plurality of sets is associated with at least one attachment. Each attachment is configured to be associated with only one of the plurality of sets. In this way, when the hair care appliance identifies a particular attachment that has been releasably coupled to the hair care appliance, only one of the plurality of sets is associated with that particular attachment so as to identify only one set of predetermined settings. The hair care appliance, e.g., a processor or software control thereof, can then set control parameters in accordance with that one set of predetermined settings.

The particular predetermined settings for an attachment vary based on the hair care appliance's configuration, e.g., a capability of the hair care appliance's motor, a number of and a maximum heating capability of the hair care appliance's heating element(s), etc. Thus, different hair care appliances may have different predetermined settings for the same attachment. Similarly, a same type of attachment may have different predetermined settings stored on different hair care appliances depending on a configuration of the hair care appliances. In one example, a brush attachment may have predetermined settings in which air flow is less than for other types of attachments and in which a heat amount and/or maximum temperature is greater than for other types of attachments, such as a concentrator attachment and a curling attachment, in which heating is prioritizing over air flow. In another example, a curling attachment may have predetermined settings in which a heat amount and/or maximum temperature is greater than for other types of attachments, such as a concentrator attachment, in which air flow is prioritizing over heating.

In an exemplary embodiment, an attachment mating assembly of a hair care appliance includes an electrical connector, and an attachment coupling of an attachment includes an electrical connector configured to electrically mate with the electrical connector of the attachment mating assembly when the attachment coupling is coupled to the attachment mating assembly. The electrical mating of the electrical connectors is configured to allow the hair care appliance (e.g., a processor or software control thereof) to identify the attachment. The electrical connectors are configured to automatically electrically mate when the attachment coupling is coupled to the attachment mating assembly. The predetermined settings for the identified attachment can thus be set automatically.

FIGS. 22-25 illustrate one exemplary embodiment of a hair care appliance 900 configured to identify an attachment (e.g., the attachment 204 of FIG. 6, the attachment 300 of FIG. 11, the attachment 400 of FIG. 16, the attachment 500 of FIG. 17, the attachment 602 of FIG. 18, the attachment 702 of FIG. 19, or other attachment) that is releasably coupled to the hair care appliance 900. The hair care appliance 900 is generally configured similar to the hair care appliance 100 of FIG. 1 but can have a variety of configurations, as described herein. The hair care appliance 900 in this illustrated embodiment includes a rotational hinge joint 902 and is configured to move between a straight configuration and a bent configuration, similar to that discussed above. FIGS. 22-25 show the hair care appliance 900 in the bent configuration with a body 904 of the hair care appliance 900 angled relative to a handle 906 of the hair care appliance 900. The handle 906 is only partially shown in FIGS. 22-25, with a proximal portion of the handle 906 not being shown.

The hair care appliance 900 includes an attachment mating assembly 908 that is at a distal end of the hair care appliance 900 and that surrounds an outlet 910 of the hair care appliance 900. The attachment mating assembly 908 is configured to releasably couple to an attachment coupling 912 of an attachment. The attachment is not shown in FIGS. 22-25 but can be any of a variety of attachments, e.g., the curling attachment 204 of FIG. 6, the curling attachment 300 of FIG. 11, the concentrator attachment 400 of FIG. 16, the brush attachment 500 of FIG. 17, the curling attachment 602 of FIG. 18, the curling attachment 702 of FIG. 19, or other attachment).

The attachment mating assembly 908 is configured to mechanically couple to the attachment coupling 912 to mechanically and releasably mate the hair care appliance 900 to the attachment, similar to that discussed above and as discussed further below. The attachment mating assembly 908 is also configured to electrically couple to the attachment coupling 912 to electrically couple the hair care appliance 900 to the attachment such that power can be conveyed between the hair care appliance 900 and the attachment coupled to the hair care appliance 900. Power being conveyed between the hair care appliance 900 and the attachment coupled to the hair care appliance 900 is configured to allow the hair care appliance 900 to identify the attachment, as discussed further below.

The attachment mating assembly 908 includes a plurality of electrical connectors 914*a*, 914*b*. Each of the appliance's electrical connectors 914*a*, 914*b* is in the form of a conductive ring extending circumferentially around the outlet 910. The first electrical connector 914*a* is disposed distal to the second electrical connector 916*b*. Wiring (obscured in FIGS. 22-25) extends from the electrical connectors 914*a*, 914*b* to electrically couple the electrical connectors 914*a*, 914*b* with a processor (e.g., on a PCB, etc.) in the handle 906. Power is configured to be communicated from a power source to the electrical connectors 914*a*, 914*b* via the wiring. The hair care appliance 900, e.g., the processor thereof, is configured to identify the attachment based on an electrical signal communicated via the electrical connectors 914*a*, 914*b*, as discussed further below.

The attachment coupling 912 includes a conductive path 916 including a plurality of electrical connectors 918*a*, 918*b* with a resistor 920 disposed therebetween. The conductive path 916 has a U-shape with the electrical connectors 918*a*, 918*b* defining legs of the U-shape and the resistor 920 defining the connecting portion between the legs. The electrical connectors 918*a*, 918*b* each have a different length, e.g., the legs of conductive path's U-shape have different lengths, with the first electrical connector 918*a* being shorter than the second electrical connector 918*b*. The different lengths of the electrical connectors 918*a*, 918*b* allow the electrical connectors 918*a*, 918*b* to each engage only one of the appliance's electrical connectors 914*a*, 914*b*. The first electrical connector 918*a* is configured to engage the appliance's first, distal electrical connector 914*a*, and the second electrical connector 918*b* is configured to engage the appliance's second, proximal electrical connector 914*b*.

Each of the attachment's electrical connectors 918*a*, 918*b* is in the form of a conductive leaf spring including a protruding portion. The electrical connectors 918*a*, 918*b* being leaf springs is configured to help ensure that the attachment's electrical connectors 918*a*, 918*b* each electrically couple with the appliance's electrical connectors 914*a*, 914*b* when the attachment coupling 910 is coupled with the attachment mating assembly 908. The leaf springs, and thus the protruding portions, are biased inward so will move inward toward the attachment's electrical connectors 918*a*, 918*b*. The protruding portion of each electrical connector 918*a*, 918*b* is configured to engage the respective appliance electrical connectors 914*a*, 914*b*. The protruding portion of each electrical connector 918*a*, 918*b* is configured to protrude inwardly through a hole formed in an interior wall 922 of the attachment coupling 912. The interior wall 922 is non-conductive. Each of the attachment's electrical connectors 918*a*, 918*b* will thus only contact one of the appliance's electrical connectors 914*a*, 914*b*.

The leaf springs 918*a*, 918*b* each have a different length, e.g., the legs of conductive path's U-shape have different lengths, with the first leaf spring 918*a* being shorter than the second leaf spring 918*b*. The different lengths of the leaf springs 918*a*, 918*b* allow the leaf springs 918*a*, 918*b* to each engage only one of the appliance's electrical connectors 914*a*, 914*b*. The first leaf spring 918*a*, e.g., protruding portion thereof, is configured to engage the appliance's first, distal electrical connector 914*a*, and the second leaf spring 918*b* is configured to engage the appliance's second, proximal electrical connector 914*b*.

With no attachment coupled to the hair care appliance 900, an electrical signal provided to one of the appliance's electrical connectors 914*a*, 914*b* will not return via the other of the appliance's electrical connectors 914*a*, 914*b* because there is no electrical path in the hair care appliance 900 between the first and second electrical connectors 914*a*, 914*b*. The hair care appliance 900 is thus configured to know that no attachment is releasably coupled to the hair care appliance 900 because no return signal will be received with no attachment releasably coupled to the hair care appliance 900.

With an attachment coupled to the hair care appliance 900 by the attachment mating assembly 908 being coupled to the attachment's attachment coupling 912, an electrical signal provided to one of the appliance's electrical connectors 914*a*, 914*b* will return via the other of the appliance's electrical connectors 914*a*, 914*b* because there is an electrical path between the first and second electrical connectors 914*a*, 914*b* provided by the conductive path 916 of the attachment coupling 912. Accordingly, an electrical signal provided to the appliance's first electrical connector 914*a* via the wiring is configured to pass through the attachment's first electrical connector 918*a*, then pass through the resistor 920, then pass through the attachment's second electrical connector 918*b*, then pass through the appliance's second electrical connector 914*b*, and then return via the wiring for analysis, e.g., by the appliance's processor, to identify the attachment that is coupled to the hair care appliance 900. An electrical signal can instead be provided to the appliance's second electrical connector 914*b* and return through the appliance's first electrical connector 914*a*.

A value of the resistor 920 in the attachment's conductive path 916 is configured to facilitate the hair care appliance's identification of the attachment and its associated set of predetermined settings, as discussed above. The analysis of the returned electrical signal, e.g., by the appliance's processor, includes detecting a current of the returned electrical signal. Different accessories have resistors with different values in their respective conductive paths, e.g., 100Ω resistor 920 for a brush attachment, 10Ω resistor 920 for a curling attachment, 50Ω resistor for a concentrator attachment 920, etc. Thus, the particular current detected for the returned electrical signal is configured to identify the type of attachment that is currently coupled to the hair care appliance 900 since the current will be different for different attachments. The values 10Ω, 50Ω, and 100Ω are examples only, as other resistor values for the resistor 920 (as well as the known resistor discussed below) are possible.

Figure 26:
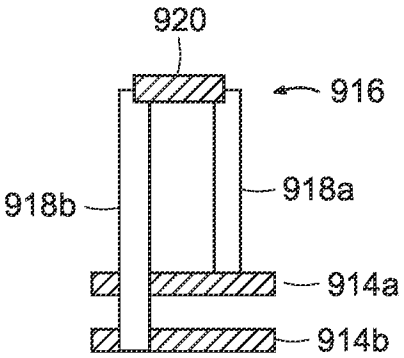
FIG. 26 is a schematic view of a conductive path of the attachment coupling of FIG. 22 engaged with electrical connectors of the hair care appliance of FIG. 22.
Figure 27:
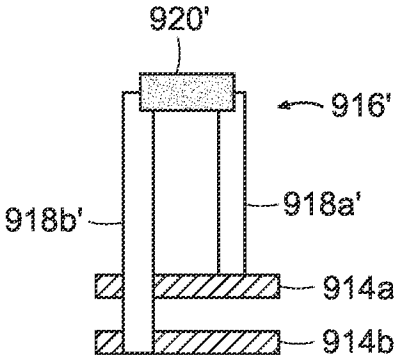
FIG. 27 is a schematic view of a conductive path of another exemplary embodiment of an attachment coupling engaged with electrical connectors of the hair care appliance of FIG. 22.
Figure 25:
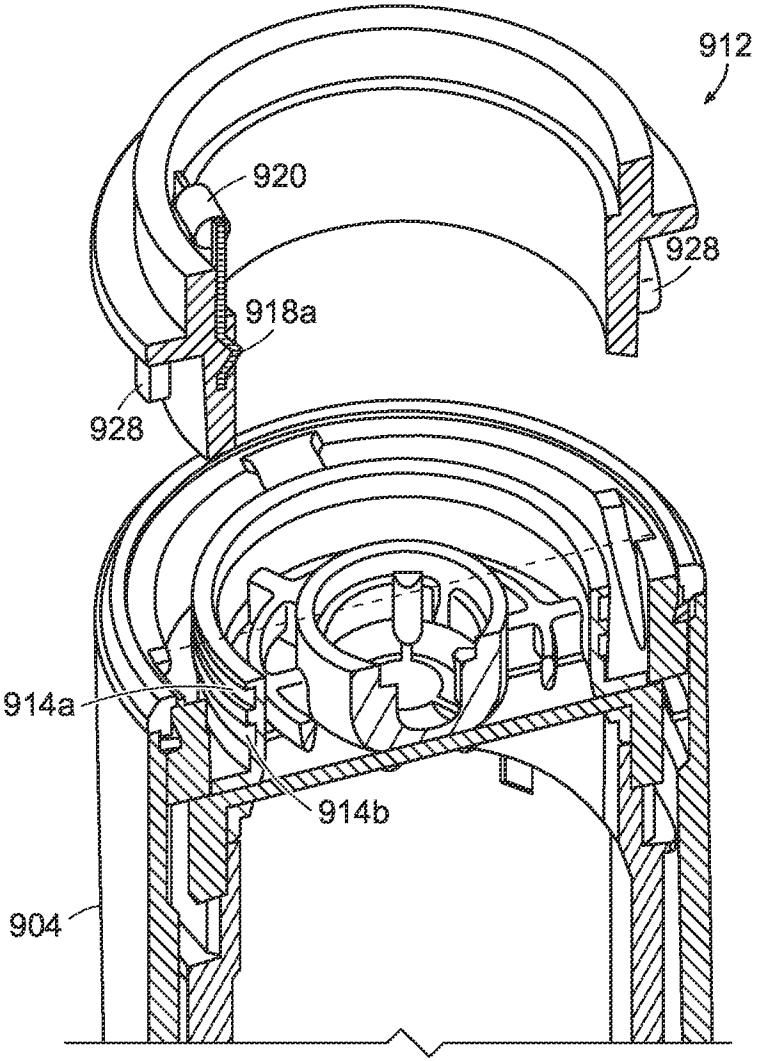
FIG. 25 is yet another cross-sectional perspective view of the hair care appliance and attachment coupling of FIG. 22.

FIG. 26 shows the appliance's first and second electrical connectors 914*a*, 914*b* electrically coupled with the attachment's first and second electrical connectors 918*a*, 918*b*, respectively. FIG. 27 shows the appliance's first and second electrical connectors 914*a*, 914*b* electrically coupled with first and second electrical connectors 918*a*', 918*b*', respectively, of another attachment having a conductive path 916' with a differently valued resistor 920' than the resistor 920 of the conductive path 916 of FIG. 26.

Figure 28:
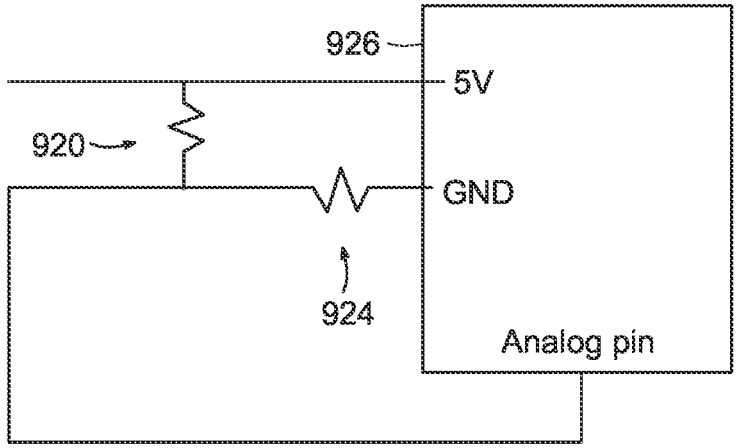
FIG. 28 is a circuit diagram representing a closed circuit formed with the attachment coupling of FIG. 22 coupled with the hair care appliance of FIG. 22.

FIG. 28 illustrates a circuit diagram representing a closed circuit formed with the attachment coupling 912 coupled with the attachment mating assembly 908. As shown, the closed circuit includes a 5 V power source ($V_{in}$) in electrical communication with the resistor 920 of the attachment's conductive path 916, and a resistor 924 of the hair care appliance 900 (e.g., a resistor of known value ($R_{known}$) along the wiring electrically coupled to the appliance's first and second electrical connectors 914*a*, 914*b*) attached to ground (GND) and an analog input pin of a PCB 926. The 5 V power source can be another voltage value. The electrical signal returning from the attachment's conductive path 916 is received at the PCB 926 via the analog pin to allow for the current of the return electrical signal to be detected, such as by converting raw data received at the analog pin to voltage ($V_{out}$) across the known resistor 924. Voltage equals current times resistance (V=IR). Resistance ($R_{attachment}$) of the attachment's resistor 920 can thus be calculated as follows:

$$R_{attachment} = \frac{V_{in} - V_{out}}{V_{out}} * R_{known}$$

As mentioned above, the attachment mating assembly 908 of the hair care appliance 900 is configured to mechanically couple to the attachment coupling 912 of the attachment. While various mating features can be utilized to mate the attachment coupling 912 to the attachment mating assembly 908, in the illustrated embodiment the attachment coupling 912 includes a plurality of projections 928 configured to extend into corresponding slots 930 formed in the attachment mating assembly 908, similar to protrusions and slots discussed above. In this illustrated embodiment, the attachment coupling 912 includes four projections arranged substantially equidistantly around a circumference of the attachment coupling 912, and each of the projections 928 has a teardrop shape. The slots 930 each have an irregular shape with a curved bottom surface configured to seat the wider, rounded portion of the teardrop shape therein in bayonet lock style. The attachment mating assembly can further include a rotatable release mechanism and a lock ring, similar to the release mechanism and lock ring discussed above, configured to facilitate secure coupling of the attachment to and easy release of the attachment from the hair care appliance 900.

The attachment coupling 912 is configured to couple to the attachment mating assembly 908 at any one of four predetermined orientations relative to the hair care appliance 900. A number of the protrusions 928 defines the number of predetermined orientations since each one of the protrusions 928 is seated in one of the slots 930 for proper coupling of the attachment and hair care appliance 900.

In some embodiments, the attachment coupling 912 is configured to couple to the attachment mating assembly 908 at a single predetermined orientation relative to the hair care appliance 900. Having only one orientation at which the attachment coupling 912, and thus the attachment, is configured to couple to the attachment mating assembly 908, and thus to the hair care appliance 900, may help ensure that the attachment's electrical connectors 918*a*, 918*b* will align with and electrically couple to the appliance's first and second electrical connectors 914*a*, 914*b*. The single predetermined orientation may be possible, for example, by one of the protrusions 928 having a different size and/or shape than a remainder of the protrusions 928, with one of the slots 930 also having a different size and/or shape than a remainder of the slots 930. A user may thus be visually signaled by the one different protrusion 928/slot 930 pair the one orientation at which the attachment should be coupled to the hair care appliance 900. In other embodiments, the attachment coupling 912 can include a single protrusion and the hair care appliance 900 can include a single slot 930 such that the attachment has only one orientation at which the attachment is configured to be coupled to the hair care appliance 900.

Figure 29:
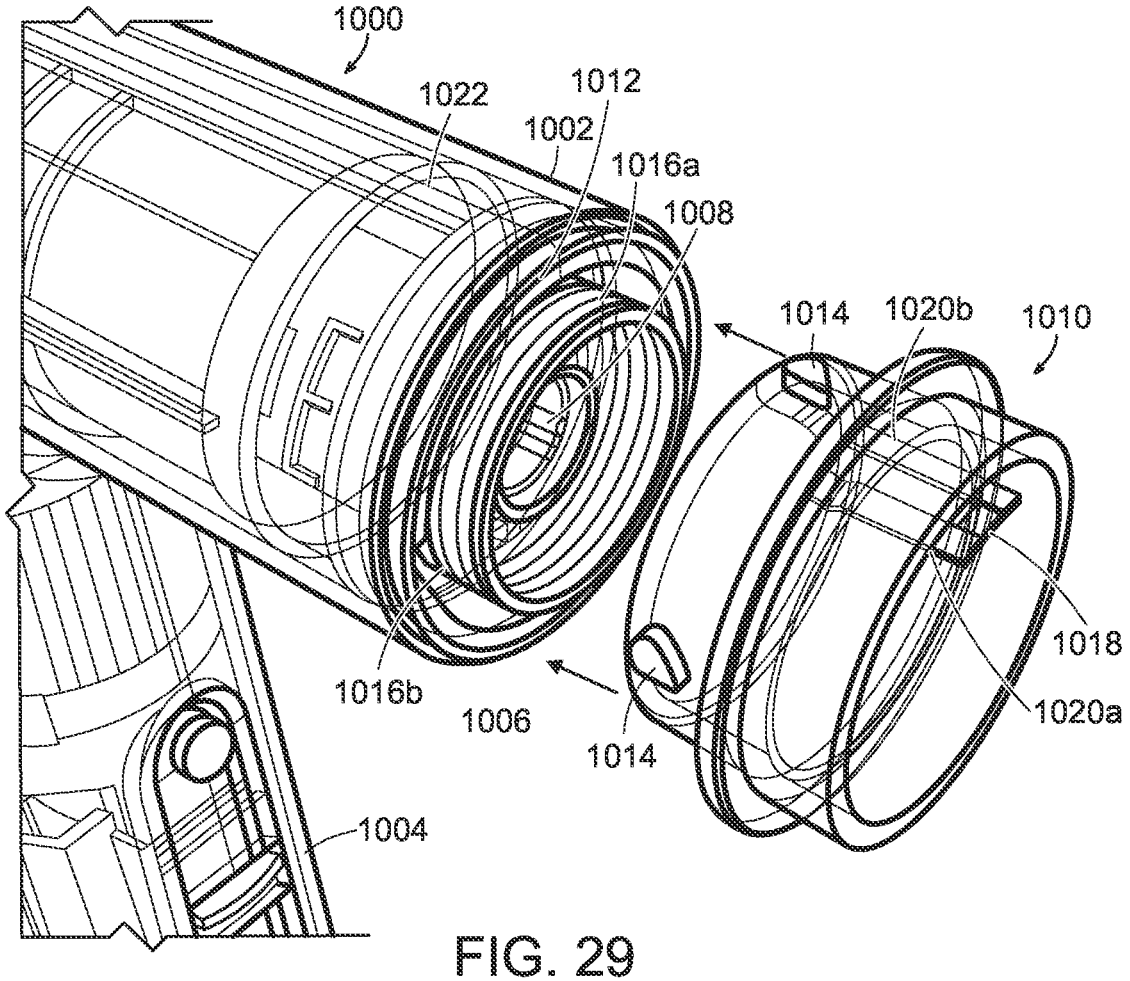
FIG. 29 is a perspective view of another exemplary embodiment of a partial distal portion of a hair care appliance and another exemplary embodiment of an attachment coupling configured to couple to the hair care appliance.
Figure 30:
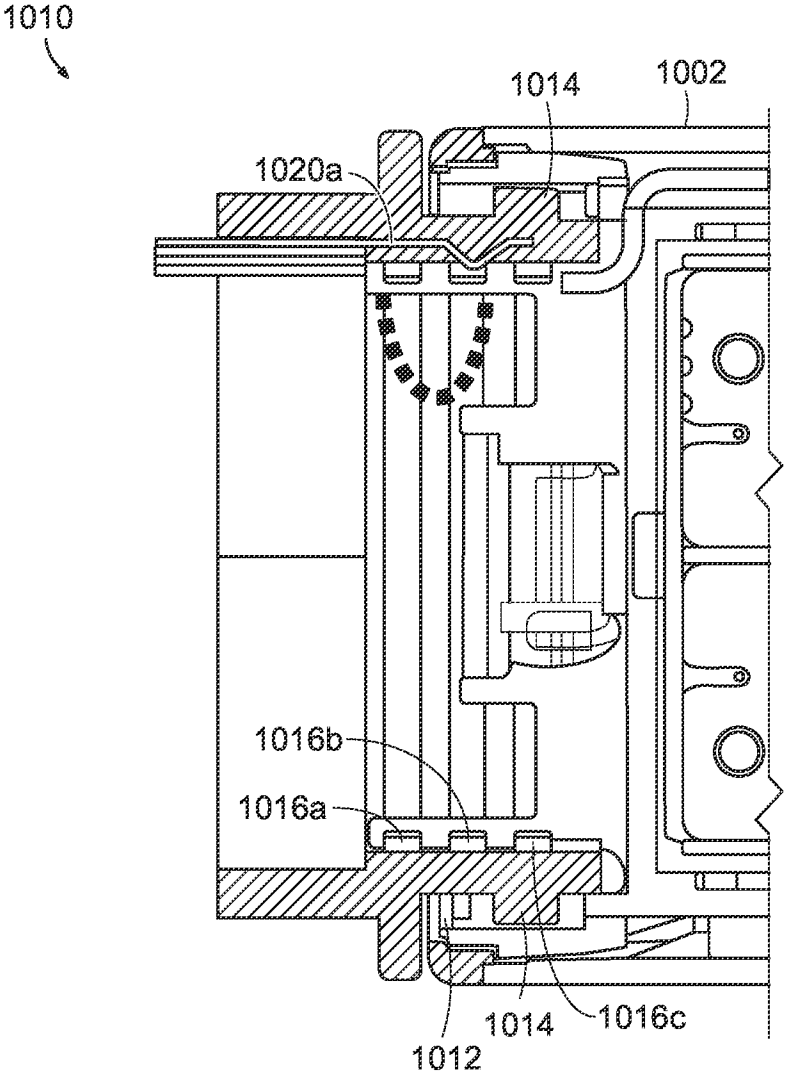
FIG. 30 is a side cross-sectional perspective view of the hair care appliance of FIG. 29 releasably coupled with the attachment coupling of FIG. 29.

FIGS. 29 and 30 illustrate another exemplary embodiment of a hair care appliance 1000 configured to identify an attachment (e.g., the attachment 204 of FIG. 6, the attachment 300 of FIG. 11, the attachment 400 of FIG. 16, the attachment 500 of FIG. 17, the attachment 602 of FIG. 18, the attachment 702 of FIG. 19, or other attachment) that is releasably coupled to the hair care appliance 1000. The hair care appliance 1000 is generally configured similar to the hair care appliance 100 of FIG. 1 but can have a variety of configurations, as described herein. The hair care appliance 1000 in this illustrated embodiment includes a rotational hinge joint (obscured in FIGS. 29 and 30) and is configured to move between a straight configuration and a bent configuration, similar to that discussed above. FIG. 29 shows the hair care appliance 1000 in the bent configuration with a body 1002 of the hair care appliance 1000 angled relative to a handle 1004 of the hair care appliance 1000. The handle 1004 and the body 1002 are each only partially shown in FIG. 29, and the body 1002 is only partially shown in FIG. 30 (the handle 1004 is not visible in FIG. 30).

The hair care appliance 1000 includes an attachment mating assembly 1006 that is at a distal end of the hair care appliance 1000 and that surrounds an outlet 1008 of the hair care appliance 1000. The attachment mating assembly 1006 is configured to releasably couple to an attachment coupling 1010 of an attachment. The attachment is not shown in FIGS. 22-25 but can be any of a variety of attachments, e.g., the curling attachment 204 of FIG. 6, the curling attachment 300 of FIG. 11, the concentrator attachment 400 of FIG. 16, the brush attachment 500 of FIG. 17, the curling attachment 602 of FIG. 18, the curling attachment 702 of FIG. 19, or other attachment).

The attachment mating assembly 1006 is configured to mechanically couple to the attachment coupling 1010 similar to the attachment mating assembly 908 and the attachment coupling 912 of FIGS. 22-25, e.g., the attachment mating assembly 1006 includes a plurality of slots 1012 configured to each receive therein one of a plurality of protrusions 1014 of the attachment coupling 1010. The attachment mating assembly 1006 includes four irregularly-shaped slots 1014 and the attachment coupling 1010 includes four teardrop-shaped protrusions 1014, but as discussed above, another number of protrusion/slot pairs and/or other shapes are possible.

The attachment mating assembly 1006 is also configured to electrically couple to the attachment coupling 1010 similar to the attachment mating assembly 908 and the attachment coupling 912 of FIGS. 22-25, e.g., the attachment mating assembly 1006 includes a plurality of electrical connectors 1016*a*, 1016*b*, 1016*c* each in the form of a conductive ring extending circumferentially around the outlet 1008 and the attachment coupling 1010 includes a U-shaped conductive path 1018 including a plurality of electrical connectors 1020*a*, 1020*b* with a resistor (not shown) disposed therebetween. FIG. 29 also shows wiring 1022 extending from the appliance's electrical connectors 1016*a*, 1016*b*, 1016*c* to electrically couple the electrical connectors 1016*a*, 1016*b*, 1016*c* with a processor (e.g., on a PCB, etc.) in the handle 1004.

In this illustrated embodiment, the attachment mating assembly 1006 includes three electrical connectors 1016*a*, 1016*b*, 1016*c*. One of the electrical connectors 1016*c* is ground, while a remainder of the electrical connectors 1016*a*, 1016*b* are configured to couple with an attachment's electrical connector. However, only one non-ground electrical connector 1016*a*, 1016*b* at a time is configured to couple with an attachment's electrical connector. Thus, depending on which one of the non-ground electrical connector 1016*a*, 1016*b* is electrically coupled with an attachment via the attachment coupling 1010, the hair care appliance 1000 is configured to identify the attachment. A number of different attachment to which the hair care appliance 1000 is configured to couple is thus defined by a number of the appliance's electrical connectors, which in this illustrated embodiment is three. Conversely, the hair care appliance 900 of FIGS. 22-25 is not so limited, as any number of different attachments can be attached to and identified by the hair care appliance 900 with each of the different attachments having a resistor of a different value in its conductive path.

A length of the first electrical connector 1020*a* in the attachment's conductive path 1018 is configured to facilitate the hair care appliance's identification of the attachment and its associated set of predetermined settings, as discussed above. Different accessories have first electrical connectors with different lengths, either corresponding to a length to engage the appliance's first electrical connector 1016*a* or a length to engage the appliance's second electrical connector 1016*b*. Thus, the particular current detected for the returned electrical signal is configured to identify the type of attachment that is currently coupled to the hair care appliance 1000 since the current will be different for different attachments since the return electrical path will be different, either through the appliance's first electrical connector 1016*a* having a first known resistor value in its path or through the appliance's second electrical connector 1016*b* having a second known resistor value in its path.

Figure 31:
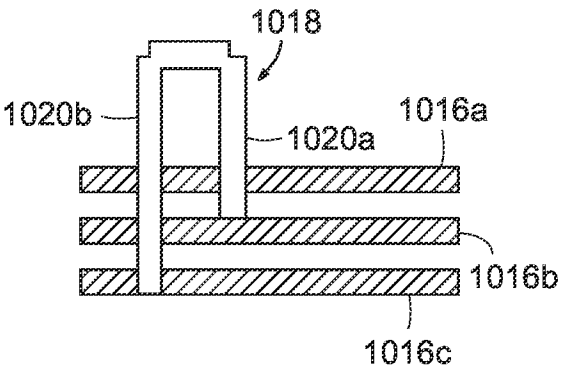
FIG. 31 is a schematic view of a conductive path of the attachment coupling of FIG. 29 engaged with electrical connectors of the hair care appliance of FIG. 29.
Figure 32:
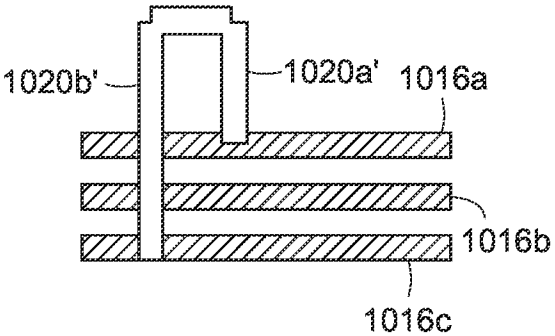
FIG. 32 is a schematic view of a conductive path of another exemplary embodiment of an attachment coupling engaged with electrical connectors of the hair care appliance of FIG. 29.

FIGS. 30 and 31 show the appliance's second and third electrical connectors 1016*b*, 1016*c* electrically coupled with the attachment's first and second electrical connectors 1020*a*, 1020*b*, respectively. FIG. 32 shows the appliance's first and third electrical connectors 1016*a*, 1016*c* electrically coupled with first and second electrical connectors 1020*a*',

1020*b*', respectively, of another attachment. In other embodiment, an attachment can include first, second, and third electrical connectors each configured to engage a different one of the appliance's first, second, and third electrical connectors 1016*a*, 1016*b*, 1016*c* so as to allow identification of a third type of attachment.

Figure 33:
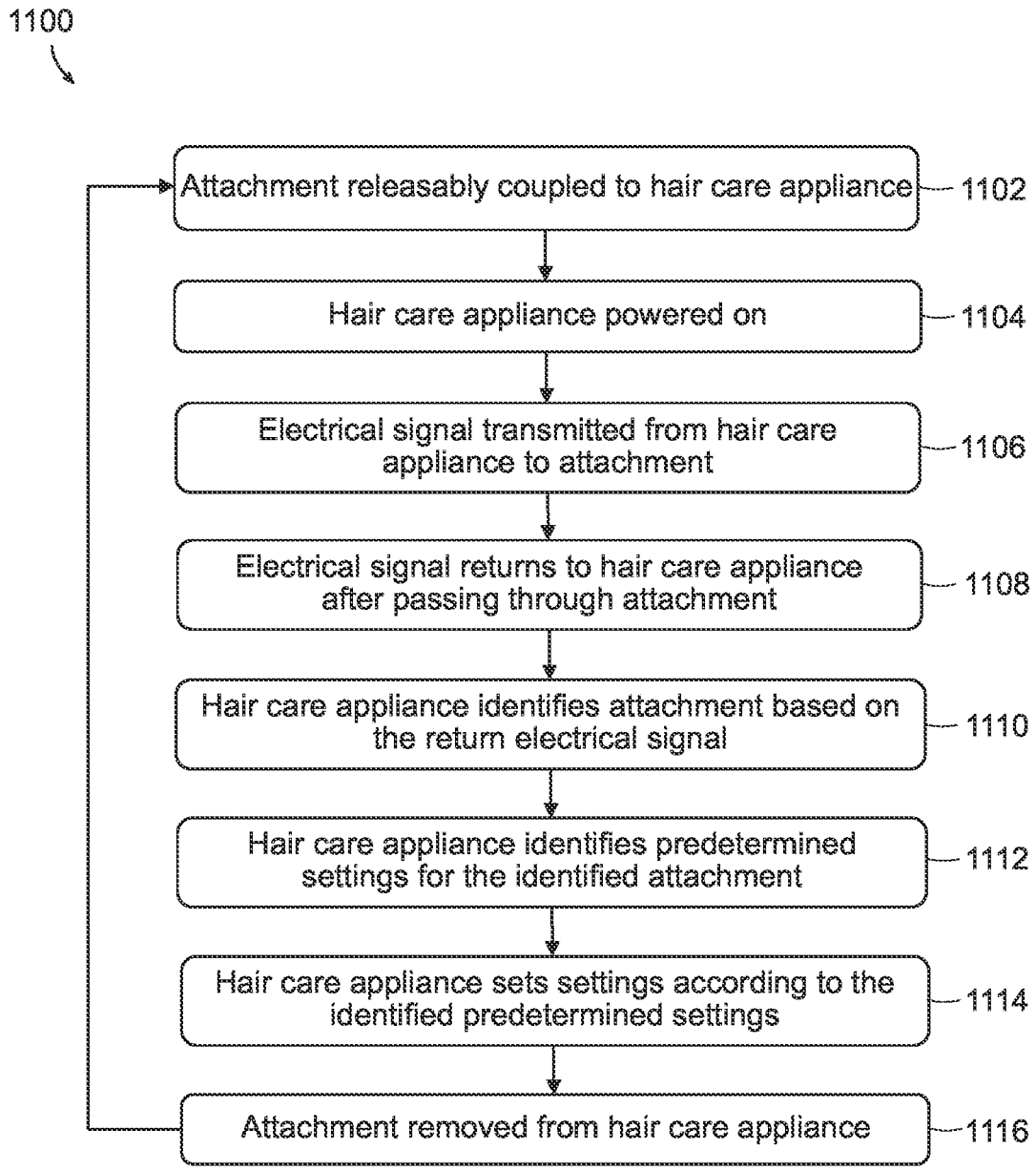
FIG. 33 is a flowchart of a method of identifying an attachment releasably coupled to a hair care appliance.

FIG. 33 illustrates one embodiment of a method 1100 of identifying an attachment releasably coupled to a hair care appliance. The method 1100 is described with respect to the hair care appliance 900 and the attachment coupling 912 of FIGS. 22-25 for ease of explanation but can be similarly performed with respect to other hair care appliances (e.g., the hair care appliance 100 of FIGS. 1-5, the hair care appliance 200 of FIGS. 6-10, the hair care appliance 700 of FIG. 19, the hair care appliance 800 of FIG. 20, or other hair care appliance) and/or other attachment couplings (e.g., the attachment coupling 212 of FIG. 7, the attachment coupling 314 of FIG. 11, the attachment coupling 400 of FIG. 16, the attachment coupling 1010 of FIG. 29, or other attachment coupling).

The method 1100 includes the attachment being releasably coupled 1102 to the hair care appliance 900 by a user coupling the attachment's attachment coupling 912 to the appliance's attachment mating assembly 908. The coupling of the attachment and the hair care appliance 900 typically occurs with the hair care appliance 900 powered off.

With the attachment releasably coupled 1102 to the hair care appliance 900, the hair care appliance 900 is powered on 1104 by the user, e.g., by the user actuating a power feature of the hair care appliance's user interface. Powering on 1104 the hair care appliance 900 automatically causes an electrical signal to be transmitted 1106 from the hair care appliance 900, e.g., from a source voltage at a PCB of the hair care appliance 900, to the attachment. The electrical signal travels along the wiring of the hair care appliance 900 to one of the appliance's electrical connectors 914*a*, 914*b*, then through the attachment's conductive path 916, and then returns 1108 to the hair care appliance 900 via the other one of the appliance's electrical connectors 914*a*, 914*b* and travels back along the wiring of the hair care appliance 900. The electrical signal can be returned to the PCB of the hair care appliance 900, as discussed above.

After receiving the return electrical signal, the hair care appliance 900, e.g., the processor thereof, automatically identifies 1110 the attachment based on the return electrical signal, e.g., by looking up the detected resistance and/or current of the return signal in a lookup table stored in a memory of the hair care appliance 900 that correlates resistances and/or currents with attachments. Based on the identification 1110 of the attachment, the hair care appliance 900, e.g., the processor thereof, automatically identifies 1112 predetermined settings for that attachment, e.g., by looking up the identified attachment in a lookup table stored in the memory of the hair care appliance 900 that correlates predetermined settings with attachments. The identification 1110 of the attachment and the identification 1112 of the predetermined settings are shown as separate actions in the method 1100 of FIG. 33. In other embodiments, the identification 1110 of the attachment and the identification 1112 of the predetermined settings is a single action, e.g., by looking up the detected resistance and/or current of the return signal in a lookup table stored in the memory of the hair care appliance 900 that correlates predetermined settings with resistances and/or currents.

After identifying 1112 the predetermined settings, the hair care appliance 900, e.g., the processor thereof, automatically sets 1114 settings of the hair care appliance 900 according to the predetermined settings, e.g., by changing control parameter(s) in a control algorithm stored in the memory of the hair care appliance 900 that the processor is configured to execute to control the hair care appliance 900.

Once the user has finished using the attachment, the user can decide to remove 1116 the attachment from the hair care appliance 900. The method 1100 then repeats any number of times with each subsequent coupling of an attachment (either the same attachment as previously coupled to the hair care appliance 900 or a different attachment) to the hair care appliance 900.

The attachment mating mechanisms and attachments of the improved hair care appliances and attachments described herein produce a number of advantages. For example, an attachment can be secured to the hair care appliance using a linear connection technique that enables power and communication circuitry to pass through the attachment mating mechanisms. In this way, attachments can include powered elements such as heating mechanisms, sensors, and user interfaces that can improve styling of hair and an enhanced user experience. The linear connection technique can also eliminate the need for rotational coupling of attachments and thus reduce wear and tear on the appliance and attachments. For another example, a hair care appliance can be configured to releasably coupled to each of one or more curling attachments that include a heating mechanism configured to improve curling of hair and maintain hair in a curled style for longer periods of time. For another example, one or more sensors configured in the attachment can provide smart or intelligent operation of the hair care appliance to which the attachment is coupled and can enable the hair care appliance to be used without manual input of temperature and airflow settings.

The subject matter described herein can be implemented in analog electronic circuitry, digital electronic circuitry, and/or in computer software, firmware, or hardware, including the structural means disclosed in this specification and structural equivalents thereof, or in combinations of them. The subject matter described herein can be implemented as one or more computer program products, such as one or more computer programs tangibly embodied in an information carrier (e.g., in a machine-readable storage device), or embodied in a propagated signal, for execution by, or to control the operation of, data processing apparatus (e.g., a programmable processor, a computer, or multiple computers). A computer program (also known as a program, algorithm, software, software application, or code) can be written in any form of programming language, including compiled or interpreted languages, and it can be deployed in any form, including as a stand-alone program or as a module, component, subroutine, or other unit suitable for use in a computing environment. A computer program does not necessarily correspond to a file. A program can be stored in a portion of a file that holds other programs or data, in a single file dedicated to the program in question, or in multiple coordinated files (e.g., files that store one or more modules, sub-programs, or portions of code).

The processes and logic flows described in this specification, including the method steps of the subject matter described herein, can be performed by one or more programmable processors executing one or more computer programs to perform functions of the subject matter described herein by operating on input data and generating output. The processes and logic flows can also be performed by, and apparatus of the subject matter described herein can be implemented as, special purpose logic circuitry, e.g., an FPGA (field programmable gate array) or an ASIC (application-specific integrated circuit).

Processors suitable for the execution of a computer program include, by way of example, both general and special purpose microprocessors, and any one or more processor of any kind of digital computer. Generally, a processor will receive instructions and data from a read-only memory or a random access memory or both. The essential elements of a computer are a processor for executing instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. Information carriers suitable for embodying computer program instructions and data include all forms of non-volatile memory, including by way of example semiconductor memory devices, (e.g., EPROM, EEPROM, and flash memory devices). The processor and the memory can be supplemented by, or incorporated in, special purpose logic circuitry.

The techniques described herein can be implemented using one or more modules. As used herein, the term "module" refers to computing software, firmware, hardware, and/or various combinations thereof. At a minimum, however, modules are not to be interpreted as software that is not implemented on hardware, firmware, or recorded on a non-transitory processor readable recordable storage medium (i.e., modules are not software per se). Indeed "module" is to be interpreted to always include at least some physical, non-transitory hardware such as a part of a processor or computer. Two different modules can share the same physical hardware (e.g., two different modules can use the same processor). The modules described herein can be combined, integrated, separated, and/or duplicated to support various applications. Also, a function described herein as being performed at a particular module can be performed at one or more other modules and/or by one or more other devices instead of or in addition to the function performed at the particular module.

Certain exemplary embodiments have been described to provide an overall understanding of the principles of the structure, function, manufacture, and use of the systems, devices, and methods disclosed herein. One or more examples of these embodiments have been illustrated in the accompanying drawings. Those skilled in the art will understand that the systems, devices, and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present invention. Further, in the present disclosure, like-named components of the embodiments generally have similar features, and thus within a particular embodiment each feature of each like-named component is not necessarily fully elaborated upon.

Approximating language, as used herein throughout the specification and claims, may be applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

One skilled in the art will appreciate further features and advantages of the invention based on the above-described embodiments. Accordingly, the present application is not to be limited by what has been particularly shown and described, except as indicated by the appended claims. All publications and references cited herein are expressly incorporated by reference in their entirety.

What is claimed is:

1. A hair care assembly, comprising:

a hair care appliance including a motor, a heater, a fan, and a processor, the motor being configured to drive the fan, the fan being configured to draw air in through an air inlet and to expel air from an air outlet, the heater being configured to heat air flow from the fan, and the processor being configured to control the motor and the heater; and an accessory configured to removably mate to the hair care appliance so that the accessory is communicable with the air outlet and is in electrical communication with the hair care appliance;

wherein, with the accessory removably mated to the hair care appliance, the processor is configured to receive a return signal from the accessory and is configured to modify at least one operating parameter of the hair care appliance based on the received return signal.

2. The hair care assembly of claim 1, wherein the hair care appliance includes a mating assembly;

the accessory includes a coupling configured to removably mate to the hair care appliance so that the accessory is removably mated to the hair care appliance; and the mating of the coupling and the mating assembly is configured to mechanically mate and electrically mate the accessory to the hair care appliance.

3. The hair care assembly of claim 1, wherein the removable mating of the accessory to the hair care appliance is configured to complete an electrical path from the hair care appliance to the accessory and returning to the hair care accessory.

4. The hair care assembly of claim 3, wherein the electrical path includes a resistor disposed in the accessory; and a resistance value of the resistor defines how the processor modifies the at least one operating parameter of the hair care appliance.

5. The hair care assembly of claim 1, wherein the processor is configured to identify the accessory based on the return signal, and the modification of the at least one operating parameter is based on the identification of the accessory.

6. The hair care assembly of claim 5, further comprising an additional accessory configured to removably mate to the hair care appliance;

wherein only one of the accessory and the additional accessory is mateable at a time to the hair care appliance; and with the additional accessory removably mated to the hair care appliance, the processor is configured to receive a signal from the additional accessory, is configured to identify the accessory based on the signal from the additional accessory, and is configured to modify at least one operating parameter of the hair care appliance based on the identification of the additional accessory.

7. The hair care assembly of claim 1, wherein the hair care appliance includes first and second electrical connectors;

the accessory includes third and fourth electrical connectors;

the removable mating of the accessory to the hair care appliance is configured to electrically mate the first and third electrical connectors and electrically mate the second and fourth electrical connectors; and the hair care appliance is configured to transmit a source signal to the accessory via the first electrical connector mated to the third electrical connector such that the source signal passes through the third electrical connector and thereafter the fourth electrical connector before returning to the hair care appliance via the second electrical connector.

8. The hair care assembly of claim 7, wherein a resistor is disposed between the third and fourth electrical connectors such that the source signal passes through the third electrical connector and thereafter the resistor and thereafter the fourth electrical connector.

9. The hair care assembly of claim 8, further comprising an additional accessory configured to removably mate to the hair care appliance;

wherein only one of the accessory and the additional accessory is mateable at a time to the hair care appliance;

the additional accessory includes fifth and sixth electrical connectors with a second resistor disposed between the fifth and sixth electrical connectors;

the second resistor has a resistance value that is different than a resistance value of the resistor of the accessory;

the removable mating of the additional accessory to the hair care appliance is configured to electrically mate the first and fifth electrical connectors and electrically mate the second and sixth electrical connectors; and the hair care appliance is configured to transmit a source signal to the additional accessory via the first electrical connector mated to the fifth electrical connector such that the source signal passes through the fifth electrical connector and thereafter the second resistor and thereafter the sixth electrical connector before returning to the hair care appliance via the second electrical connector such that the processor is configured to modify at least one operating parameter of the hair care appliance based on the signal returned via the second and sixth electrical connectors.

10. The hair care assembly of claim 7, wherein the first and second electrical connectors are not in electrical communication with each other until the accessory is removably mated to the hair care appliance.

11. The hair care assembly of claim 7, wherein the hair care appliance includes a fifth electrical connector;

the hair care assembly further comprises an additional accessory configured to removably mate to the hair care appliance;

only one of the accessory and the additional accessory is mateable at a time to the hair care appliance;

the additional accessory includes sixth and seventh electrical connectors;

the removable mating of the additional accessory to the hair care appliance is configured to electrically mate the first and sixth electrical connectors and electrically mate the fifth and seventh electrical connectors; and with the additional accessory removably mated to the hair care appliance, the processor is configured to receive a signal from the additional accessory and is configured to modify at least one operating parameter of the hair care appliance based on the signal received from the additional accessory.

12. The hair care assembly of claim 1, wherein the at least one operating parameter comprises at least one of a temperature of the heater and a speed of the fan.

13. The hair care assembly of claim 1, wherein the accessory includes at least one sensor; and the signal includes data from the at least one sensor on the accessory body, and the processor is configured to modify at least one operating parameter of the hair care appliance based on the received data.

14. The hair care assembly of claim 1, wherein the accessory is one of a brush attachment, a curling attachment, and a concentrator attachment.

15. A hair care system, comprising:

a hair care appliance comprising:

a processor; and a memory storing instructions that, when executed by the processor, cause the processor to perform operations comprising:

in response to releasable coupling of an accessory to the hair care appliance such that the accessory and the hair care appliance are mechanically and electrically coupled together, automatically identifying the accessory, and automatically setting at least one operational parameter of the hair care appliance based on the identification of the accessory.

16. The hair care system of claim 15, wherein the operations further comprise, in response to the releasable coupling of the accessory to the hair care appliance such that the accessory and the hair care appliance are mechanically and electrically coupled together, and before automatically identifying the accessory: causing a source signal to be transmitted from the hair care appliance to the accessory; and the identification of the accessory is based on a signal returned from the accessory to the hair care appliance.

17. The hair care system of claim 16, wherein the hair care appliance is configured to releasably couple to an additional accessory of a type different than the accessory;

the hair care appliance is configured to releasably couple to only one of the accessory and the additional accessory at a time;

the operations further comprise:

in response to releasable coupling of the additional accessory to the hair care appliance such that the additional accessory and the hair care appliance are mechanically and electrically coupled together, automatically identifying the additional accessory, and automatically setting the at least one operational parameter of the hair care appliance based on the identification of the additional accessory; and the identification of the additional accessory is based on a signal returned from the additional accessory to the hair care appliance.

18. The hair care system of claim 15, further comprising the accessory;

wherein the accessory is one of a brush attachment, a curling attachment, and a concentrator attachment.

19. A computer-implemented method, comprising:

in response to releasable coupling of an accessory to a hair care appliance such that the accessory and the hair care appliance are mechanically and electrically coupled together, automatically identifying the accessory; and automatically setting at least one operational parameter of the hair care appliance based on the identification of the accessory;

wherein the accessory is one of a brush attachment, a curling attachment, and a concentrator attachment.

20. The method of claim 19, further comprising, in response to the releasable coupling of the accessory to the hair care appliance such that the accessory and the hair care appliance are mechanically and electrically coupled together, and before automatically identifying the accessory: causing a source signal to be transmitted from the hair care appliance to the accessory.

* * * * *